US005091293A

United States Patent [19]

Nozawa et al.

[11] Patent Number: 5,091,293

[45] Date of Patent: Feb. 25, 1992

[54] COLOR NEGATIVE PHOTOGRAPHIC MATERIAL

[75] Inventors: Yasushi Nozawa; Hideto Ikoma; Keiji Mihayashi; Yoshihiko Shibahara, all Kanagawa, Japan

[73] Assignee: Fuji Photo Film Co., Ltd., Kanagawa, Japan

[21] Appl. No.: 542,690

[22] Filed: Jun. 25, 1990

Related U.S. Application Data

[63] Continuation of Ser. No. 91,159, Aug. 31, 1987, abandoned.

[30] Foreign Application Priority Data

| | | | |
|---|---|---|---|
| Aug. 29, 1986 | [JP] | Japan | 61-201756 |
| Oct. 17, 1986 | [JP] | Japan | 61-246983 |
| Oct. 17, 1986 | [JP] | Japan | 61-246984 |
| Jun. 26, 1987 | [JP] | Japan | 62-159115 |

[51] Int. Cl.[5] ..... G03C 1/46

[52] U.S. Cl. ..... 430/503; 430/544; 430/555; 430/558; 430/567; 430/569; 430/572; 430/573

[58] Field of Search ..... 430/505, 506, 544, 555, 430/558, 567, 569, 572, 573, 503

[56] References Cited

U.S. PATENT DOCUMENTS

| | | | |
|---|---|---|---|
| 4,444,877 | 4/1984 | Koitabashi et al. | 430/567 |
| 4,596,764 | 6/1986 | Ishimaru | 430/393 |
| 4,603,104 | 7/1986 | Philip, Jr. | 430/572 |
| 4,607,004 | 8/1986 | Ikenoue et al. | 430/523 |
| 4,707,434 | 11/1987 | Koboshi et al. | 430/393 |
| 4,745,048 | 5/1988 | Kishimoto et al. | 430/555 |
| 4,746,601 | 5/1988 | Mihayashi et al. | 430/567 |
| 4,748,106 | 5/1988 | Hayashi | 430/503 |
| 4,764,456 | 8/1988 | Watanabe et al. | 430/550 |
| 4,766,058 | 8/1988 | Sampei et al. | 430/496 |

FOREIGN PATENT DOCUMENTS

| | | |
|---|---|---|
| 60-122759 | 6/1985 | Japan . |
| 2176304 | 12/1986 | United Kingdom . |

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A high-speed color negative photographic material which comprises, a support having provided thereon, at least one red-sensitive silver halide emulsion layer, at least one green-sensitive silver halide emulsion layer and at least one blue-sensitive emulsion layer, and is designated so as to acquire a specific photographic sensitivity (defined in detailed description of the invention) of 800 or above, and has a combined total of silver coverages ranging from 3.0 g/m$^2$ to 9.0 g/m$^2$ so as to minimize an increase in fog, a decrease in photographic speed and deterioration in granularity, which heretofore have occurred in high-speed photographic materials during long-range storage before used. In addition, the present photographic material enables enhancement of pressure resistance and processing efficiency.

16 Claims, 1 Drawing Sheet

FIGURE
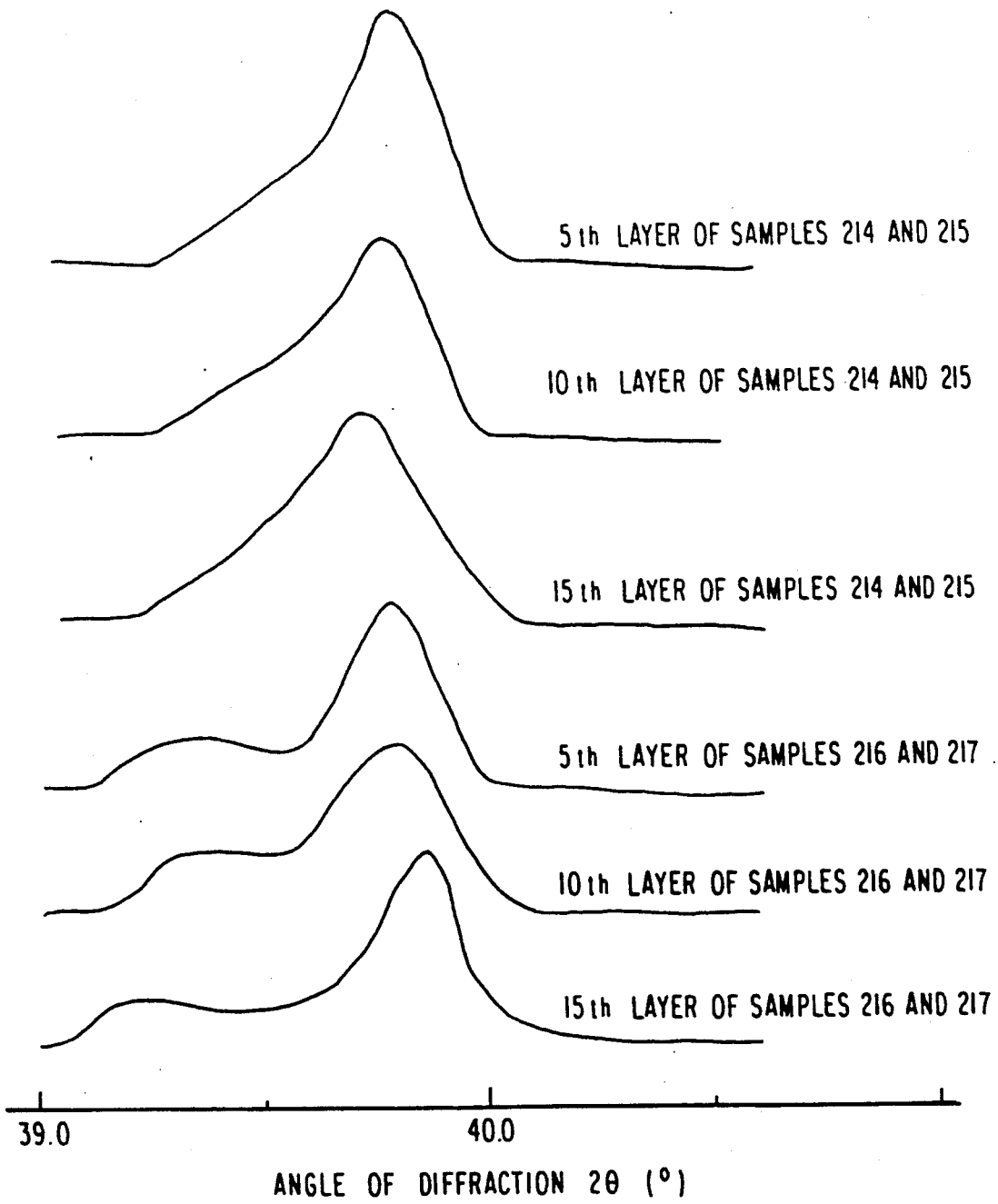

COLOR NEGATIVE PHOTOGRAPHIC MATERIAL

This is a continuation of application Ser. No. 07/091,159 filed Aug. 31, 1987, now abandoned.

FIELD OF THE INVENTION

The present invention relates to a color negative photographic material, and, more particularly, to a color negative photographic material of high photographic speed for photograph-taking use, wherein improvements are made with respect to an increase in fog, a drop in photographic sensitivity and a deterioration of granularity, all of which tend to be caused over the course of time between the production of the photographic material and the use thereof. Further, the invention relates to a color negative photographic material of high photographic speed for photograph-taking use which acquires enhanced sharpness and color reproducibility by preventing deterioration in granularity over the course of time. Furthermore, the invention relates to a color negative photographic material of high photographic speed for photograph-taking use which has excellent pressure resistance and improved processability.

BACKGROUND OF THE INVENTION

Due to the recent progress in the art of photosensitive materials for photograph-taking use, newly developed photosensitive materials of high photographic speed have been highly commercialized. The expansion of the photographing environment depends on the attainment of high photographic speed in photosensitive materials, for instance, photographing in a dark room without a strobe light, photographing of, e.g., sports scenes, through a telephoto lens while rapidly handling the shutter, photographing requiring many hours of exposure, e.g., taking astrophotographs, and so on.

For the purpose of increasing the photographic speed of a photosensitive material, considerable efforts have been expended. A great number of methods for forming silver halide grains having a desired form and composition, chemical sensitization, spectral sensitization, additives, coupler structures, and so on have been developed. One method involves combining a method of enlarging the size of the silver halide grains with another method of increasing the photographic speed. This method has been a typical measure for producing a photosensitive material of high photographic speed in the photographic arts. However, the progress of the art of photography is still behind the requirements for photosensitive materials of a high photographic speed.

More specifically, although enlargement of the size of the silver halide emulsion grains can increase the photographic speed to some extent, it necessarily leads to a decrease in the number of silver halide emulsion grains, provided that the content of silver halide in the emulsion is maintained constant. As a results, the number of development initiation centers is decreased. Therefore, the increase in size of the silver halide grains entails a disadvantage in that the graininess is greatly spoiled. In order to offset this disadvantage, various methods have been proposed. For instance, a method of using a photosensitive material containing at least two emulsion layers which has the same color sensitivity, but different photographic speeds, that is, different grain sizes, respectively, as described in British Patent 923,045 and Japanese Patent Publication No. 15495/74; a method of using a rapidly reacting coupler, as described in Japanese Patent Application (OPI) No. 62454/80 (the term "OPI" as used herein means an "unexamined published application"); a method of using a so-called DIR coupler or DIR compound, as described in U.S. Pat. Nos. 3,227,554 and 3,632,435; a method of using a coupler capable of producing a diffusible dye, as described in British Patent 2,083,640; a method of using silver halide grains having a high mean silver iodids content, as described in Japanese Patent Application (OPI) No. 128443/85; and so on are well-known. Although these methods each has a great effect and can be said to be an excellent invention, they are still insufficient to meet many of the requirements for heightening both the photographic speed and the image quality. Therefore, in order to increase the grain size of the silver halide emulsion and at the same time, to increase the number of development initiation centers to as large as possible, high-speed color negative photosensitive materials have been designed to contain silver halide emulsion grains in the largest amount as possible so that various properties, such as the desilvering capacity at the time of bleach-fix processing, are not adversely effected. However, the thus produced photosensitive materials having a high photographic speed and a high image quality have turned out to suffer from the following undesirable disadvantages.

A first disadvantage is the deterioration of photographic properties, including an increase in fog, a decrease in the photographic speed, a deterioration in the graininess, and so on, which occur during the preservation period, i.e. between the production of the photosensitive material and the use thereof. In particular, deterioration in the graininess is a serious problem. It has been found in our investigations that the main cause of the deterioration is that the light-sensitive silver halide emulsion grains are exposed to natural radiations, such as Gammarays, emitted from building materials, the ground, etc., cosmic rays, and so on. Although the properties of a photosensitive material were already known to be deteriorated by irradiation with X-rays or high energy radiations, it was newly found that with regard to a high-speed color negative photosensitive material having a specific photographic sensitivity of 800 or above, the definition of which is described hereinafter, the photographic properties thereof are deteriorated greatly beyond anticipation even by exposure to very weak natural radiation.

In order to prevent the deterioration of the above-described kind, a method of shielding radiations by using a material having a high absorption coefficient with respect to radiations, such as lead, for a packing material or as a material for making a preservatory, as described, e.g., in *Research Disclosure*, No. 25610 (August 1985) can be employed. However, it is necessary to use a heavy metal, like lead, in a considerable thickness in order to carry this method into perfection. If the thickness is insufficient, the above-described aim cannot be achieved. Accordingly, it is nearly impossible to supply such a material as described above to the consuming public with ease at a low price.

A second disadvantage is the impossibility of fulfilling the severe requirements for the image quality of the photosensitive materials recently developed.

A third disadvantage is the inferiority of the photosensitive material in terms of pressure resistance, and more specifically in terms of generating abrasive fog (sensitization) upon the speeding-up of processing, and upon the use of cameras fitted with a high speed automatic rolling-up mechanism.

In addition, a fourth disadvantage is poor fixation or poor desilvering in the conventional photosensitive material of the high-speed type upon a decrease in the development processing time and a decrease in the amount of replenisher added to the processing solution.

SUMMARY OF THE INVENTION

Therefore, a first object of the present invention is to provide a color negative photosensitive material having high image quality and high photographic speed.

A second object of the present invention is to provide a high-speed color negative photographic material which minimizes an increase in fog, a decrease in photographic speed and deterioration in graininess which occur during the preservation period after the production thereof.

A third object of the present invention is to provide a photograph-taking color negative photographic material having high image quality and high photographic speed in which deterioration in graininess due to passage of time after the production thereof is prevented, and thereby sharpness and color reproducibility are enhanced.

A fourth object of the present invention is to provide a high-speed color negative photographic material excellent in pressure resistance and improved in processing efficiency.

The above-described objects of the present invention have been met by a color negative photographic material comprising, on a support, at least one red-sensitive silver halide emulsion layer (RL), at least one green-sensitive silver halide emulsion layer (GL) and at least one blue-sensitive silver halide emulsion layer (BL), and having a specific photographic sensitivity of at least 800, wherein the total amount of silver (hereinafter "a combined total of silver coverages") ranges from 3.0 g to 9.0 g/m$^2$.

BRIEF DESCRIPTION OF DRAWING

The FIGURE is a graph showing X-ray diffraction profiles of the emulsion grains contained in the emulsions characterizing the samples 214 to 217, respectively, prepared in Example 5.

DETAILED DESCRIPTION OF THE INVENTION

A combined total of silver coverages has been adjusted to from 9.5 g/m$^2$ to 12 g/m$^2$, or above in recently developed high-speed color negative photographic materials in order to achieve specific photographic sensitivity of 800 or above. As discussed above, high-speed color photographic materials, particularly those having a specific photographic sensitivity of 800 or more, have been found to be greatly influenced by natural radiation. Under these circumstances, it has been found in the present invention that even when a high-speed color negative photographic material having a specific photographic sensitivity of 800 or above is employed, the influence of natural radiation can be reduced to a great extent by maintaining the specific photographic sensitivity of 800 or more, particularly from 800 to about 6400, by using the following various ways of increasing the photographic speed, and at the same time by controlling the combined total of silver coverages to from 3.0 g/m$^2$ to 9.0 g/m$^2$, thereby achieving the present invention:

(1) employing yellow filter dyes as described hereinafter, and the like, (2) using sensitizing dyes (especially a supersensitizing dyes described hereinafter), (3) selecting the halogen composition of the silver halide, (4) using two-equivalent couplers (particularly in GL), (5) using rapidly reacting couplers, (6) designing so that each color sensitive layer is constituted by at least two layers, and the silver coverage may be reduced in the upper constituent layer (a layer located farther away from the support), there efficiently using light at the lower constituent layer.

In the present invention, the specific photographic sensitivity as described in detail and defined below is the photographic speed of the photographic light-sensitive materials. The reason for this is as follows.

In general, the ISO speed, which is the international standard, is used as the photographic speed of photographic light-sensitive materials. In determining the ISO speed, the photosensitive materials are subjected to development-processing on the fifth day after exposure, using the developing process specified by each company. In the present invention the period from the conclusion of exposure to the start of development is reduced to 0.5 to 6 hours. The specific photographic sensitivity described below is the photographic speed then determined under the definite development-processing condition.

More specifically the term "specific photographic sensitivity" of a photosensitive material as used in the present invention refers to the photographic sensitivity determined according to the testing method described below, which follows the ISO speed, more specifically follows JIS K 7614-1981.

(1) Testing Condition

The test is carried out in a room kept at a temperature of 20°±5° C. and a relative humidity of 60±10%, and a photosensitive material is submitted to the test after it is allowed to stand for at least one hour under the above-described condition.

(2) Exposure (i) The relative spectral energy distribution of the standard light on the exposed surface is so designed as to have the distribution described in Table A below.

TABLE A

| Wavelength (nm) | Relative Spectral Energy(1) |
|---|---|
| 360 | 2 |
| 370 | 8 |
| 380 | 14 |
| 390 | 23 |
| 400 | 45 |
| 410 | 57 |
| 420 | 63 |
| 430 | 62 |
| 440 | 81 |
| 450 | 93 |
| 460 | 97 |
| 470 | 98 |
| 480 | 101 |
| 490 | 97 |
| 500 | 100 |
| 510 | 101 |
| 520 | 100 |
| 530 | 104 |
| 540 | 102 |
| 550 | 103 |
| 560 | 100 |
| 570 | 97 |
| 580 | 98 |

TABLE A-continued

| Wavelength (nm) | Relative Spectral Energy[1] |
|---|---|
| 590 | 90 |
| 600 | 93 |
| 610 | 94 |
| 620 | 92 |
| 630 | 88 |
| 640 | 89 |
| 650 | 86 |
| 660 | 86 |
| 670 | 89 |
| 680 | 85 |
| 690 | 75 |
| 700 | 77 |

Note
[1]The energy at 560 nm was standardized and taken as 100 and the other energy values were determined relative thereto.

(ii) The illumination on the exposed surface is changed by using an optical wedge, and the optical wedge to be employed is one which is designed so that fluctuation of the spectral transmission density in any part thereof is not more than 10% in the wavelength region of from 360 nm to less than 400 nm, and not more than 5% in the wavelength region of from 400 nm to 700 nm.

(iii) The exposure time is adjusted to 1/100 second.

(3) Development Processing (i) The photosensitive material to be tested is preserved in an atmosphere controlled to a temperature of 20°±5° C. and a relative humidity of 60±10% during the period from exposure to development processing.

(ii) The development processing is concluded within 30-minute to 6-hour after exposure.

(iii) The development processing is achieved by carrying out the following steps:

| | |
|---|---|
| 1. Color development | 3 min. 15 sec., 38.0 ± 0.1° C. |
| 2. Bleaching | 6 min. 30 sec., 38.0 ± 3.0° C. |
| 3. Washing | 3 min. 15 sec., 24~41° C. |
| 4. Fixation | 6 min. 30 sec., 38.0 ± 3.0° C. |
| 5. Washing | 3 min. 15 sec., 24~41° C. |
| 6. Stabilization | 3 min. 15 sec., 38 ± 3.0° C. |
| 7. Drying | below 50° C. |

The compositions of processing solutions used in the foregoing steps, respectively, are as follows.

| | |
|---|---|
| Color Developing Solution | |
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-Ethyl-N-β-hydroxyethylamino)-2-methylaniline Sulfate | 4.5 g |
| Water to make | 1.0 l |
| pH | 10.0 |
| Bleaching Solution | |
| Ammonium Ethylenediaminetetraacetatoferrate(III) | 100.0 g |
| Disodium Ethylenediaminetetraacetate | 10.0 g |
| Ammonium Bromide | 150.0 g |
| Ammonium Nitrate | 10.0 g |
| Water to make | 1.0 l |
| pH | 6.0 |
| Fixing Solution | |
| Disodium Ethylenediaminetetraacetate | 1.0 g |
| Sodium Sulfite | 4.0 g |
| Aqueous Solution of Ammonium Thiosulfate (70%) | 175.0 ml |

-continued

| | |
|---|---|
| Sodium Bisulfite | 4.6 g |
| Water to make | 1.0 l |
| pH | 6.6 |
| Stabilizing Solution | |
| Aqueous Solution of Formaldehyde (40%) | 2.0 ml |
| Polyoxyethylene-p-monononylphenyl Ether (average polymerization degree: 10) | 0.3 g |
| Water to make | 1.0 l |

(4) Measurement of Density

The density is represented by $\log_{10}(\Phi_0/\Phi)$. $\Phi_0$ is the luminous flux of lighting for the density measurement, and $\Phi$ is the luminous flux transmitted by the area to be measured. A geometric relationship of the density measurement is as follows: The luminous flux for lighting is the parallel flux whose incident direction is perpendicular to the surface to be luminated, and all of the luminous flux transmitted by the photosensitive material, and diffusing into the half-space, is adopted as the standard of the transmitted luminous flux. When the measurement is carried out using a method other than the above-described one, correction is made using the standard density. When the measurement is carried out, the emulsion film surface is set so as to face the light-receiving apparatus. In determining the density, standard M densities of blue, green and red, respectively, are adopted, and spectral characteristics thereof are so designed as to become the values shown in Table B by taking into account collectively the characteristics of a light source installed in the densitometer used, the optical system used, the optical filters used and the light-receiving apparatus used.

| Wavelength (nm) | Blue | Green | Red |
|---|---|---|---|
| 400 | * | * | * |
| 410 | 2.10 | * | * |
| 420 | 4.11 | * | * |
| 430 | 4.63 | * | * |
| 440 | 4.37 | * | * |
| 450 | 5.00 | * | * |
| 460 | 4.95 | * | * |
| 470 | 4.74 | 1.13 | * |
| 480 | 4.34 | 2.19 | * |
| 490 | 3.74 | 3.14 | * |
| 500 | 2.99 | 3.79 | * |
| 510 | 1.35 | 4.25 | * |
| 520 | ** | 4.61 | * |
| 530 | ** | 4.85 | * |
| 540 | ** | 4.98 | * |
| 550 | ** | 4.98 | * |
| 560 | ** | 4.80 | * |
| 570 | ** | 4.44 | * |
| 580 | ** | 3.90 | * |
| 590 | ** | 3.15 | * |
| 600 | ** | 2.22 | * |
| 610 | ** | 1.05 | * |
| 620 | ** | ** | 2.11 |
| 630 | ** | ** | 4.48 |
| 640 | ** | ** | 5.00 |
| 650 | ** | ** | 4.90 |
| 660 | ** | ** | 4.58 |
| 670 | ** | ** | 4.25 |
| 680 | ** | ** | 3.88 |
| 690 | ** | ** | 3.49 |
| 700 | ** | ** | 3.10 |
| 710 | ** | ** | 2.69 |
| 720 | ** | ** | 2.27 |
| 730 | ** | ** | 1.86 |
| 740 | ** | ** | 1.45 |
| 750 | ** | ** | 1.05 |

-continued

| Wavelength (nm) | Blue | Green | Red |
|---|---|---|---|
| | | | ** |

Note
*Slope of Red: 0.260/nm, Slope Green: 0.106/nm, and Slope of Blue: 0.250/nm.
**Slope of Red: 0.040/nm, Slope of Green: 0.120/nm, and Slope of Blue: 0.220/nm.

(5) Detarmination of Specific Photographic Sensitivity

The specific photographic sensitivity is determined using the results obtained by processing and submitting the photosensitive material to the density measurement under the foregoing conditions (1) to (4) in accordance with the following procedure.

(i) Exposures corresponding to the densities higher than the minimum densities of their respective colors, blue, green and red, by 0.15, are expressed in terms of lux,sec, and represented by $H_B$, $H_G$ and $H_R$, respectively.

(ii) Of values $H_B$ and $H_R$, one having the larger value (lower sensitivity) is taken as $H_S$.

(iii) The specific photographic sensitivity S is calculated according to the following equation.

$$S = \sqrt{\frac{2}{H_G \times H_S}}$$

It is well known that sensitivities to Gamma-rays and X-rays increase with an increase in the number of silver halide emulsion grains, and there is a description of such a phenomenon, e.g., in R. H. Herz, *The Photographic Action of Ionizing Radiations*, published by Wiley-Interscience in 1969, and so on. However, it has never been imargined that when the combined total silver coverages increase beyond a certain limit, a high-speed color negative photographic material as described hereinbefore, causes exposure, increase in fog, deterioration of graininess, and like deteriorations in the photographic properties by exposure to very weak natural radiations like Gamma-rays present in the environment during the actual period of preservation. The hypothesis that deterioration of the photographic properties caused in a high-speed color negative photographic material during preservation is due to the influences of natural radiations thereon can be proved by comparing the properties of a photosensitive material of the above-described kind preserved under normal conditions with those of the photosensitive material of the same kind preserved under conditions such that it is surrounded by thick lead shield, and thereby the influences of natural radiations upon the photosensitive material are removed. This proof is further illustrated hereinafter in the description of an experiment carried out as an example of this invention.

Designing a high-speed color negative photosensitive material so as to contain the largest possible amount of silver halide emulsion grains for the purpose of improvement on graininess no matter how small it may be, as described above and in Japanese Patent Application (OPI) 147744/83, etc., was the general way employed to date in the art photographic. As the result of taking a new look at this common knowledge from the viewpoint of deterioration of the photographic properties due to storage, it has been found in the present invention that a photosensitive material suffers severe deterioration during preservation when its combined total of silver coverages is greater than 9.0 g/m$^2$, and there is a considerable difference in the photographic properties of a photosensitive material used after being preserved for a usual period of time and one which is used immediately after the production thereof. It has also been found in the present invention that when the combined total of silver coverages is increased beyond a certain extent, the graininess improving effect, which is a primary objective, becomes small, and, at last, there occurs a reverse phenomenon in that after the storage over a period of, e.g., a half year, the photosensitive material having a smaller combined total of silver coverages has much more excellent graininess than one which has a greater combined total of silver coverages because of less deterioration in graininess during storage.

The combined total of silver coverages in the color negative photosensitive material of the present invention must be within the range of 3.0 g/m$^2$ to 9.0 g/m$^2$. A preferred range of the combined total of silver coverages depends on the layer structure of the photosensitive material, the kind of a coupler incorporated, etc., so it cannot be concretely set forth. When a photosensitive material having a specific photographic sensitivity of 800 or above contains silver at a combined total of silver coverages of more than 9.0 g/m$^2$, its sensitivity and graininess are deteriorated, to such an extent as to come into question from the viewpoint of practical use, by exposure to natural radiations over a period of from about half a year to 2 years. On the other hand, the maximum density required of a color negative photosensitive material cannot be ensured by a combined total of silver coverages of less than 3.0 g/m$^2$. A preferred combined total of silver coverages ranges from 3.0 g/m$^2$ to 8.5 g/m$^2$, more particularly from 3.0 g/m$^2$ to 8.0 g/m$^2$, in photographic materials having a specific photographic sensitivity of 800 or above. In addition, it is to be desired that the color negative photosensitive materials have a specific sensitivity of more than 1,000, particularly more than 1,200.

The combined total of silver coverages as used herein relates to the total content of all silver compounds contained in the photosensitive material, including silver halides, metal silver and the like, and is calculated on a silver basis per square meter. In order to determine a combined total of silver coverages, an elemental analysis utilizing a fluorescent X-ray method is convenient, though any method may be employed.

The present invention can be applied to a multilayer color negative photographic material having at least two different spectral sensitivities on a support. A multilayer color negative photographic material has, in general, at least one red-sensitive emulsion layer, at least one green-sensitive emulsion layer and at least one blue-sensitive emulsion layer on a support. The order of these layers can be varied as desired. In general, a red-sensitive layer, a green-sensitive layer and a blue-sensitive layer are arranged in that order on the support side. It is desirable from the standpoint of heightening the attainable photographic sensitivity to design each color-sensitive emulsion layer described above so as to have two or more constituent layers differing in photographic speed. More preferably, each color-sensitive layer is designed so as to have a three-layer construction for the purpose of improvement in graininess in addition to photographic sensitivity. When a photographic material has a color-sensitive emulsion layer comprises two constituent layers the toe sensitivity difference of these two layers is preferably from 0.05 to 1.5 by $\Delta$ log E unit (E: exposure), and when a photographic material has a color-sensitive layer comprises three constituent layers each toe sensitivity difference between two adjacent layers thereof is preferably from 0.05 to 1.0 by Δ log E unit. These arts are described in British Patent 923,045 and Japanese Patent Publication 15495/74, respectively.

It is known in the art that in producing a color negative photographic material comprising emulsion layers sensitive to the same color and being constituted with two or more layers differing in photographic speed, that in order to ensure high image quality the constituent layer having a higher (faster) photographic speed is designed so as to have the higher silver content because a so-called graininess disappearing effect can be utilized. However, the high-speed color negative photographic materials having a specific photographic sensitivity of 800 or above have turned out to suffer from an unexpected disadvantage that deterioration in the photographic properties due to storage is more serious in the case where silver is contained in a larger amount in the constituent layer of a higher photographic speed than in the case where silver is contained in a larger amount in the constituent layer of a lower photographic speed. Accordingly, it is preferred to design the constituent layer having the highest photographic speed among those having the same color sensitivity so as not contain as much silver. The combined total of silver coverages of the constituent layer having the highest photographic speed among those having the same color sensitivity, that is, red sensitivity, green sensitivity or blue sensitivity, ranges from 0.3 $g/m^2$ to 1.8 $g/m^2$, preferably from 0.3 $g/m^2$ to 1.6 $g/m^2$, and more preferably from 0.3 $g/m^2$ to 1.4 $g/m^2$.

In order to acquire both high photographic speed and high image quality, various inventions regarding the order of the layer arrangement have been made. The techniques proposed in these invention may be used in combination. The inventions regarding the order of the layer arrangement are described, e.g., in U.S. Pat. Nos. 4,184,876, 4,129,446 and 4,186,016, British Patent 1,560,965, U.S. Pat. Nos. 4,186,011, 4,267,264, 4,173,479, 4,157,917 and 4,165,236, British Patents 2,138,962, and 2,137,372. Japanese Patent Application (OPI) Nos. 177,552/84, 180556/84 and 204038/84, and so on.

In addition, a light-insensitive layer may be arranged between any two of the constituent layers having the same color sensitivity.

A reflecting layer comprising fine-grained silver halide or the like may be provided beneath a high-speed constituent emulsion layer, particularly the high-speed blue-sensitive constituent emulsion layer for the purpose of further enhancement of the photographic speed, e.g., as described in Japanese Patent Application (OPI) No. 160135/84.

Although it is general to incorporate a cyan forming coupler in a red-sensitive emulsion layer, a magenta forming coupler in a green-sensitive emulsion layer, and a yellow forming coupler in a blue-sensitive emulsion layer, combinations other than the above-described one can be employed, if needed. For instance, a pseudocolor photographic material or photographic materials suitable for exposure to a semiconductor laser can be obtained by combining an infrared-sensitive emulsion layer with green- and red-sensitive emulsion layers.

Other specific examples of photographic materials which can be used in the present invention include a photographic material having RL, GL and BL as described above and an emulsion layer containing neutral-dye forming coupler provided at the position farthest away from the support, as described in U.S. Pat. No. 3,497,350, or a photographic material having a light-sensitive layer unit in the high sensitivity color emulsion layer area wherein the light-sensitive layer unit is capable of producing a color density of from 0.05 to 0.4 upon development, the remaining color density being produced by a second light-sensitive layer unit comprising a blue-sensitive layer, a green-sensitive layer and a red-sensitive layer which is provided between the light-sensitive layer unit and the support. The unit comprises:

(a) a silver halide light-sensitive layer which contains a color-forming combination of (a-1) a yellow image-forming coupler, (a-2) a magenta image-forming coupler, and (a-3) a cyan colored coupler, and which is blue-sensitive and green sensitive; and (b) a silver halide light-sensitive layer which contains a color-forming combination of (b-1) a cyan image-forming coupler, (b-2) a magenta image-forming coupler, and (b-3) a yellow colored coupler, and which is green-sensitive and red-sensitive, as described in U.S. Pat. No. 4,647,527 (corresponding to Japanese Patent Application (OPI) No. 214853/84) can be employed.

In the photographic emulsion layer of the silver halide photographic material of the present invention, silver bromide, silver iodobromide, silver iodochlorobromide, silver chlorobromide or silver chloride may be used as the silver halide. The preferred silver halide is silver iodobromide having an iodide content of less than 30 mole %. In particular, silver iodobromide having an iodide content ranging from 2 to 20 mole % is advantageously employed in the present invention. In order to obtain both high photographic speed and high image quality, the average of iodide contents in all of the silver halides contained in all of the emulsion layers is preferably adjusted to 8 mole % or more, particularly to from 8 mole % to 20 mole %, as described in Japanese Patent Application (OPI) No. 128443/85. It is known that graininess can be greatly improved by an increase in the average silver iodide content. On the other hand, an increase in the silver iodide content beyond a certain limit retards the progress of development, desilvering, fixation and so on. In the present invention, however, these defects do not arise even when the silver iodide content is increased more and more. This is believed to be because the total content of silver in the photographic material of the present invention is low. This matter is also favorable.

It is to be desired that silver halide grains used for photograhic emulsions which constitute the silver halide photographic material of the present invention should have a double-layer structure constructed by a core made up substantially of silver iodobromide having silver iodide content of more than 5 mole %, and a shell surrounding the core, which is made up substantially of silver iodobromide having a silver iodide content lower than that in the core or silver bromide. A preferred silver iodide content in the core is at least 10 mole %, and a particularly preferred one is within the range of from 20 mole % to 44 mole %. A preferred silver iodide content in the shell is not more than 5 mole %.

The core may contain silver iodide homogeneously, or may have a multiple structure consisting of some phases differing in silver iodide content. In the latter case, the silver iodide content in the phase having the highest silver iodide content is 5 mole % or more, more preferably 10 mole % or more, while the silver iodide content in the shell may be lower than the highest silver iodide content among those in the core phases. The expression "made up substantially of silver iodobromide" means that the main component is silver iodobromide, but another component may be contained in a fraction of at most about 1 mole % or so.

A more preferred embodiment of silver halide grains to be used for the photographic emulsion layers to constitute the silver halide photographic material of the present invention is as follows: When the intensities of diffraction of Cu-K$\beta$ rays taking place at the (220) face of the silver halide are plotted against the diffraction angles ($2\theta$) ranging from 38° to 42°, a diffraction peak corresponding to the core part, and a diffraction peak corresponding to the shell part and having two diffraction maxima and one minimum present therebetween appear. As for these two peaks, it is desirable for the structure of the silver halide grains that the diffraction intensity corresponding to the core part is controlled to 1/10 to 3/1 times, preferably 1/5 to 3/1 times, and more preferably 1/3 to 3/1 times, that corresponding to the shell part.

Owing to the above-described double structure, it becomes feasible to use a silver iodobromide emulsion having a high iodide content without being accompanied by a decrease in the developing speed. As a result, a photosensitive material having excellent graininess, notwithstanding the smallness of the combined total of silver coverages, can be attained.

The silver halide grains to be used for the photographic emulsion layers to constitute the silver halide photographic material of the present invention are preferably monodisperse. The terminology "emulsion made up of monodisperse silver halide grains" as used in the present invention refers to the emulsion made up of silver halide grains having a variation coefficient of not more than 16%. The variation coefficient is defined as the value obtained by dividing the standard deviation of the grain sizes (S) by a mean grain size ($\bar{r}$) and further multiplying the quotient by 100, as shown by the following equation:

$$S/\bar{r} \times 100 \leqq 16\%$$

In the above formula, S is the general standard deviation used in statistics. The grain size as used herein refers to the diameter of the grain, in case of spherical silver halide grains, while it refers to the diameter of the circle having the same area as the projected area of the grain, in case of grains having a shape other than spherical one. The average grain size is the average value of the diameters defined above. When the number of grains having a grain diameter of $r_1$ is $n_1$, the average grain size ($\bar{r}$) is defined by the following equation:

$$\bar{r} = \frac{\Sigma n_1 r_1}{\Sigma n_1}$$

Monodisperse silver halide grains as described above may have a double structure or a multiple structure.

The shape of the monodisperse silver halide grains may be that of a cube, octahedron, tetradecahedron or the like, or that of a sphere, plate or so on.

Monodisperse silver halide grains can be used to advantage because they can provide not only excellent graininess, but also excellent image sharpness when their sizes are within the range where light scattering occurs to a small extent. As for the monodisperse silver halide grains, there are detailed descriptions in Japanese Patent Application (OPI) Nos. 48521/79, 99419/79, 16124/81 and 78831/81, U.S. Pat. Nos. 4,444,877, 4,446,228, Japanese Patent Application (OPI) Nos. 182730/82, 49938/83, 37635/83, 106532/83, 107530/83, 126531/83, 149037/83, 10947/84, 29243/84, 72440/84, 140443/84, 148049/84, 177535/84 and 152438/84, and so on.

The silver halide emulsion layers to be used in the present invention preferably contain chemically sensitized silver halide grains in which metal impurities other than gold and iridium are contained in a total amount of less than 3 ppm. By using the silver halide emulsions as described above, high-speed silver halide photographic material can be obtained.

In order to prepare such a silver halide emulsion comprising silver halide grains having a very small metal impurities content (other than gold and iridium), metal impurities contained in the starting materials, including water, hydrophilic colloids, such as gelatin, water-soluble silver salts, such as silver nitrate, water-soluble alkali halides, such as KBr, KCl, KI, NaBr, NaCl, etc., and so on, are removed by purification and various measures are taken to prevent the reaction system from being contaminated with metal impurities eluted from the reaction vessels used for preparing the silver halide emulsion, to control the reaction temperature and the reaction condition, and so on.

The mean grain size of the silver halide grains (the term grain size as used herein refers to the grain diameter in the case of grains spherical or approximately spherical in shape, while it refers to an edge length in the case of cubic grains, represented by the mean based on the projected areas of the grains) ranges preferably from 0.05 microns to 10 microns, though it is not critical in the invention. In the case where each emulsion layer is constituted by two or more layers having the same color sensitivity, a preferred mean grain size of the silver halide grains in the constituent layer having the highest sensitivity with respect to each color sensitivity ranges from 0.5 microns to 4 microns, particularly from 0.8 microns to 2.5 microns.

Silver halide grains in the photographic emulsions may have a regular crystal form, such as that of a cube, an octahedron, etc., or an irregular crystal form, such as that of a sphere, a plate or so on. Also, the grains may have a composite form of these crystal forms.

Moreover, emulsions containing super-tabular silver halide grains having a diameter greater than its thickness by a factor of at least 5 in an amount of at least 50% of the entire silver halide grains therein on a projective area basis may be used.

These photographic emulsions can be prepared using various methods as described, e.g., in P. Grafkides, *Chimie et Physique Photographique*, Paul Montel, Paris (1967), G. F. Duffin, *Photographic Emulsion Chemistry*, The Focal Press, London (1966), V. L. Zelikman, et al, *Making and Coating Photographic Emulsion*, The Focal Press, London (1966) and so on. More specifically, any processes, e.g., the acid process, the neutral process, the ammoniacal process and so on, can be employed.

Suitable methods for reacting a water-soluble silver salt with a water-soluble halide include, e.g., a single jet method, a double jet method or a combination thereof.

Also, a method in which the silver halide grains are produced in the presence of excess silver ion (the so-called reverse mixing method) can be employed. Moreover, the so-called controlled double jet method, in which the pAg of the liquid phase in which the silver halide grains are to be precipitated is maintained constant, may be employed. According to this method, silver halide emulsions having a regular crystal form and an almost uniform grain size can be obtained.

Two or more kinds of silver halide emulsions prepared separately may be used in a form of mixture.

Silver halide grains having a crystal face defined by Miller indices (n n 1) (n is an integer number of 2 or more) at the outer surface, as described in Kokai Giho No. 86-9598, are preferably contained in the silver halide emulsion to be used in the present invention.

Also, silver halide emulsion grains the insides of which have cavities running from the surface towards the inner part, as described in Japanese Patent Application (OPI) No. 75337/86, can be used. As the above-described silver halide emulsion grains have a great specific surface area, they can easily acquire high sensitivity by color sensitization, compared with those having the same volume. Therefore, the silver halide emulsion grains of the foregoing kind can achieve fully their effect in the combination with the present invention.

In addition, composite grains obtained by using a silver salt differing in composition from the host grains and producing the epitaxial growth of the silver salt on the individual surfaces of the host grains, as described in Japanese Patent Application (OPI) Nos. 133540/82, 108526/83 and 162540/84, can be preferably used in the present invention. Since such composite grains possess high sensitivity and high contrast, they are favorable for use in the present invention.

Further, silver halide emulsion grains made to grow in the presence of tetrazaindenes, as described in Japanese Patent Application (OPI) Nos. 14630/86 and 122935/85, can be favorably employed as those for the present invention because they can attain a high iodide content and excellent monodispersibility and thereby, can provide a high photographic speed and excellent graininess.

Furthermore, silver halide emulsions which have undergone gold-sulfur sensitization or gold-selenium sensitization in the presence of a nitrogen-containing heterocyclic compound, as described in Japanese Patent Application (OPI) No. 126526/83, are used to advantage in the present invention because they can achieve low fog density and high photographic sensitivity.

Moreover, slightly roundish cubic or tetradecahedral grains, as described in Japanese Patent Application (OPI) Nos. 149345/84 and 149344/84, are used to advantage in the present invention because they can attain high photographic sensitivity.

In a process of producing silver halide grains or allowing the produced silver halide grains to ripen physically, cadmium salts, zinc salts, lead salts, thallium salts, iridium salts or complexes, rhodium salts or complexes, iron salts or complexes and/or the like may be present.

In particular, silver halide emulsions comprising grains produced in the presence of iridium (as described Japanese Patent Publication Nos. 4935/68 and 32738/70) are preferred over others in the present invention because of their high photographic sensitivity.

After formation of silver halide precipitates or physical ripening thereof, soluble salts are removed from the emulsion. The removal can be effected using the noodle washing method which comprises gelling the gelatin, or using a sedimentation process (thereby causing flocculation in the emulsion) taking advantage of an inorganic salt comprising a polyvalent anion, such as sodium sulfate, an anionic surface active agent, an anionic polymer (e.g., polystyrene sulfonic acid), or a gelatin derivative (e.g., an aliphatic acylated gelatin, an aromatic acylated gelatin, an aromatic carbamoylated gelatin, etc.).

In general, the silver halide emulsions are chemically sensitized. Chemical sensitization can be carried out using processes described, for example, in H. Frieser, *Die Grndlagen der Photographischen Prozesse mit Sibler-halogeniden*, pp. 675–734, Akademische Verlagsgesellschaft (1968).

More specifically, sulfur sensitization using active gelatin, or compounds containing sulfur capable of reacting with silver ions (e.g., thiosulfates, thioureas, mercapto compounds, and rhodanines); reduction sensitization using reducing materials (e.g., stannous salts, amines, hydrazine derivatives, formamidine sulfinic acid, and silane compounds); noble metal sensitization using noble metal compounds (e.g., gold complexes, and complexes of other Group VIII metals such as Pt, Ir, Pd, etc.); and so on can be employed individually or as a combination thereof.

The photographic emulsions to be used in the present invention are spectrally sensitized using methine dyes or other dyes, if desired. Suitable spectral sensitizing dyes which can be used include cyanine dyes, merocyanine dyes, complex cyanine dyes, complex merocyanaine dyes, holopolar cyanine dyes, hemicyanine dyes, styryl dyes, and hemioxonol dyes. Especially useful dyes are cyanine dyes, merocyanine dyes and complex merocyanine dyes. Any nuclei usually present in cyanine dyes can be the basic heterocyclic nuclei of these dyes. More specifically, basic heterocyclic nuclei include pyrroline, oxazoline, thiazoline, pyrrole, oxazole, thiazole, selenazole, imidazole, tetrazole, pyridine and like nuclei; nuclei formed by fusing together one of the above-described nuclei and an alicyclic hydrocarbon ring; and nuclei formed by fusing together one of the above-described nuclei and an aromatic hydrocarbon ring. Specific examples of these nuclei include indolenine, benzindolenine, indole, benzoxazole, naphthoxazole, benzothiazole, naphthothiazole, benzoselenazole, benzimidazole, quinoline and like nuclei. Each of these nuclei may also be substituted on a carbon atom of each of these nuclei.

The merocyanine and complex merocyanine dyes can contain 5- or 6-membered heterocyclic nuclei such as pyrazoline-5-one, thiohydantoin, 2-thioxazolidine-2,4-dione, thiazolidine-2,4-dione, rhodanine, thiobarbituric acid and the like nuclei, as ketomethylene structure-containing nuclei.

Specific examples of useful sensitizing dyes include those described in German Patent 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Patent 1,242,588, and Japanese Patent Publication Nos. 14030/69 and 24844/77.

These sensitizing dyes may be used individually or in combination. A combination of sensitizing dyes are often used for the purpose of supersensitization. Typical examples of supersensitizing combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patent 1,344,281 and 1,507,803, Japanese Patent Publication 4936/68 and 12375/78, and Japanese Patent Application (OPI) Nos. 110618/77 and 109925/77.

Materials which can exhibit a supersensitizing effect in combination with a certain sensitizing dye, although they themselves do not spectrally sensitize silver halide emulsions or do not absorb light in the visible region, may be incorporated in the emulsion. For example, aminostyryl compounds substituted with a nitrogen-containing heterocyclic group (such as those described in U.S. Pat. Nos. 2,933,390 and 3,635,721), aromatic organic acid-formaldehyde condensates (e.g., those described in U.S. Pat. No. 3,743,510), cadmium salts, azaindene compounds and so on may be incorporated. Combinations which are disclosed in U.S. Pat. Nos. 3,615,613, 3,615,641, 3,617,295 and 3,635,721 are especially useful.

Silver halide emulsions to be used in the color negative photographic materials of the present invention, which are characterized by their specific photographic sensitivity of 800 or above, are spectrally sensitized using the above-described methods in order to heighten their sensitivities to visible rays of the wavelengths required. For the purpose of minimizing deterioration of the photographic properties by natural radiations, it is desired that the radiation sensitivity of the silver halide emulsions should be controlled to the lowest possible level. It has been found in the present invention that the radiation sensitivity of a silver halide emulsion has good correlation with the so-called intrinsic sensitivity, but a correlation is not always present between the radiation sensitivity and the so-called dye-sensitized sensitivity. Therefore, emulsions having high dye-sensitized sensitivity but low intrinsic sensitivity are used to advantage in order to diminish the extent of deterioration caused in the photographic properties by natural radiations. Specifically, the above-described supersensitizing agents which can increase the dye-sensitized sensitivity alone without changing the intrinsic sensitivity can be particularly preferably employed for the above purpose. On the other hand, it is also advantageous that the intrinsic sensitivity is reduced by the so-called intrinsic desensitization which consists of the addition of a sensitizing dye in the largest possible amount so that the addition causes only a small lowering of the dye-sensitized sensitivity. Further, tabular silver halide grains having an aspect ratio of 5 or above, which can be spectrally sensitized by sensitizing dyes at high efficiency, are favorably employed in a photographic material of a high photographic speed of the present invention.

Tabular grains can be prepared with ease using methods as described, e.g., Gutoff, *Photographic Science and Engineering*, Vol. 14, pp. 248–257 (1970), U.S. Pat. Nos. 4,434,226, 4,414,310, 4,433,048 and 4,439,520, British Patent 2,112,157, and so on.

In the present invention, the silver halide emulsions which have received supersensitization using the compounds represented by the following general formula (I), which are disclosed in Japanese Patent Application No. 122759/85, are employed to particular advantage:

(I)

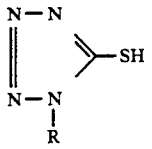

(wherein R represents an aliphatic, aromatic or heterocyclic residue substituted with at least one —COOM or —$SO_3M$; M represents a hydrogen atom, an alkali metal, a quanternary ammonium or a quaternary phosphonium).

Specific examples of the compounds represented by the foregoing general formula (I) which can be preferably used in the present invention are illustrated below. However, the invention should not be construed as being limited to these examples.

(1)

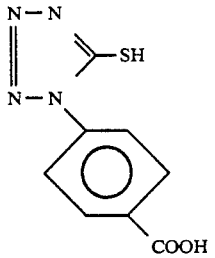

(2)

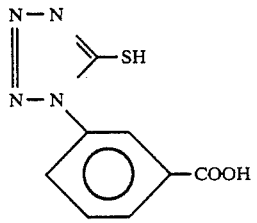

(3)

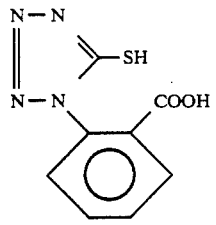

(4)

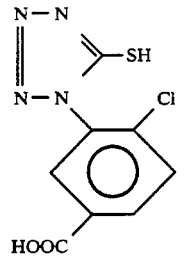

(5)

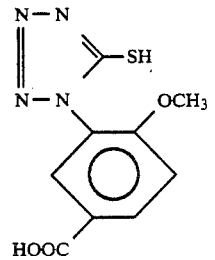

-continued (6)

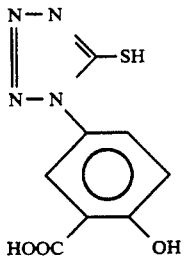

(7)

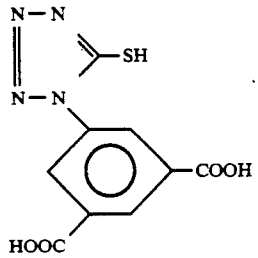

(8)

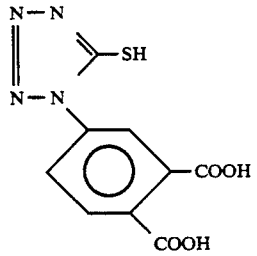

(9)

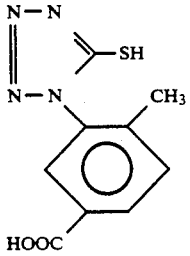

(10)

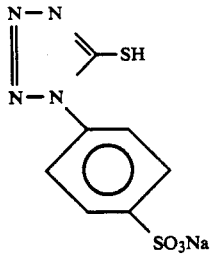

(11)

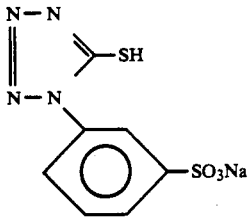

-continued (12)

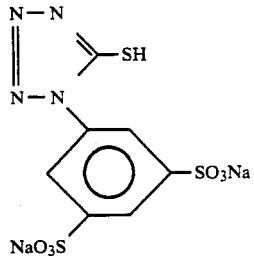

(13)

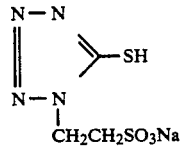

(14)

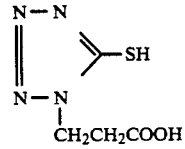

(15)

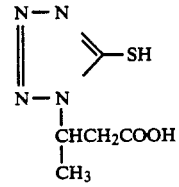

Into the photographic emulsion layers to be used in the present invention, color couplers are incorporated as dye image forming substances.

Suitable examples of magenta couplers include 5-pyrazolone couplers, pyrazolobenzimidazole couplers, cyanoacetylcoumarone couplers, open-chain acylacetonitrile couplers and so on. Examples of yellow couplers include acylacetoamide couplers (e.g., benzoylacetoanilides and pivaroylacetoanilides) and so on. Examples of cyan couplers include naphthol couplers, phenol couplers and so on. It is desired that these couplers are rendered nondiffusible by containing a hydrophobic group called a ballast group or being in a polymerized form. Moreover, though couplers may be either two-equivalent or four-equivalent to the silver ion, two-equivalent color couplers are preferred to four-equivalent couplers in order to reduce the silver coverage, because the former has higher efficiency in utilizing silver. When the color sensitive emulsion layers each, that is, a red-sensitive layer, a green-sensitive layer and a blue-sensitive layer each, is constituted by two or more layers having the same color sensitivity but different photographic speeds, it is advantageous in the invention that the constituent layer having the highest photographic speed among those having the same color sensitivity contains a two-equivalent coupler.

Conversion of four-equivalent couplers to two-equivalent couplers has been studied, and a number of two-equivalent cyan and yellow couplers are put to practical use owing to their high color-formability and high stability. As for the two-equivalent magenta couplers, however, they are difficult to use practically because of their inferiority in terms of stability and color formability. For instance, there have been proposed many attempts to convert 5-pyrazolone type couplers, which have mainly been used as magenta couplers, to two-equivalent ones. Specifically, they are substituted at the 4-position by a thiocyano group as described in U.S. Pat. Nos. 3,214,437 and 3,253,924, by an aryloxy group as described in U.S. Pat. No. 3,419,391, by a 2-triazol group as described in U.S. Pat. No. 3,617,291, by a halogen atom as described in U.S. Pat. No. 3,522,052, and by an alkylthio group, an arylthio group or a heterocyclylthio group as described in U.S. Pat. No. 3,227,554, respectively.

However, these pyrazolone couplers substituted at the 4-position have disadvantages in that they cause marked generation of color fog, their coupling activities are too small to be used practically, they are unstable chemically and change to compounds incapable of forming colors over the course of time, they are difficult to synthesize, and/or so on.

The above-described disadvantages of two-equivalent couplers can be overcome by using magenta couplers represented by the following general formula (II) or (III). Accordingly, it is preferred to use the magenta couplers represented by the general formula (II) or (III) as a two-equivalent magenta coupler to be employed in the green-sensitive constituent layer having the highest photographic speed.

(II)

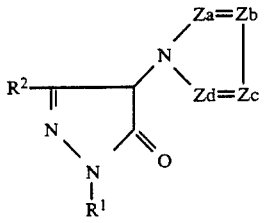

wherein $R^1$ represents an aromatic, aliphatic or heterocyclic group; $R^2$ represents a substituent group; and Za, Zb, Zc and Zd each represents an unsubstituted or substituted methine group, or —N=.

Suitable substituent groups for the magenta couplers of formula (II) are described in detail below.

In general formula (II), the aliphatic group represented by $R^1$ is one which has 1 to 32, preferably 1 to 22, carbon atoms, with specific examples including straight or branched chain alkyl groups (such as methyl, isopropyl, tert-butyl, hexyl, dodecyl; etc.), alkenyl groups (such as allyl), cyclic alkyl groups (such as cyclopentyl, cyclohexyl, norbornyl, etc.), aralkyl groups (such as benzyl, β-phenylethyl, etc.), and cyclic alkenyl groups (such as cyclopentenyl, cyclohexenyl, etc.). These aliphatic groups each may be substituted by a halogen atom, a nitro group, a cyano group, an aryl group, an alkoxy group, an aryloxy group, a carboxyl group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, an ureido group, an urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group, a mercapto group, or so on.

When $R^1$ represents an aromatic group (e.g., a phenyl group, α- or β-naphtyl group, etc.), it may be substituted by one or more groups. Specific examples of substituent groups suitable for the aromatic group include an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxyl group, an alkoxycarbonyl group, an aryloxycarbonyl group, a sulfo group, a sulfamoyl group, a carbamoyl group, an acylamino group, a diacylamino group, an ureido group, an urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group, a mercapto group, and so on. A preferred aromatic group as $R^1$ is a phenyl group substituted by an alkyl group, an alkoxy group, a halogen or so on at at least one ortho-position. This is because the magenta couplers containing the above-described phenyl groups as $R^1$ cause only a slight coloration by exposure to light or heat when they remain in processed photographic films.

Further, $R^1$ may represent a heterocyclic group (including 5- or 6-membered heterocyclic single or condensed rings containing at least one nitrogen, oxygen and sulfur atoms, e.g., a pyridyl group, a quinolyl group, a furyl group, a benzothiazolyl group, an oxazolyl group, an imidazolyl group, a naphthoxazolyl group, etc.), a heterocyclic group substituted by one of the substituent groups cited as examples of those for the above-described aromatic group, or a heterocyclic group substituted by an aliphatic or aromatic acyl group, an alkylsulfonyl group, an arylsulfonyl group, an alkylcarbamoyl group, an arylcarbamoyl group, an alkylthiocarbamoyl group or an arylthiocarbamoyl group.

$R^2$ in formula (II) represents a hydrogen atom or a substituent group, with specific examples including, aliphatic groups containing 1 to 32, preferably 1 to 22, carbon atoms (i.e., straight and branched chain alkyl, alkenyl, cycloalkyl, aralkyl and cycloalkenyl groups, which each may be substituted by one of the substituent groups cited above as examples of those for aliphatic groups represented by $R^1$), aromatic groups (which may be substituted by one of the substituent groups cited above as examples of those for aromatic groups represented by $R^1$), heterocyclic groups (which may be substituted by one of the substituent groups cited above as examples of those for heterocyclic groups represented by $R^1$), alkoxycarbonyl groups (e.g., methoxycarbonyl groups, ethoxycarbonyl groups, stearyloxycarbonyl groups, etc.), aryloxycarbonyl groups (e.g., phenoxycarbonyl groups, naphthoxycarbonyl groups, etc.), aralkyloxycarbonyl groups (e.g., benzyloxycarbonyl groups, etc.), alkoxy groups (e.g., methoxy groups, ethoxy groups, heptadecyloxy groups, etc.), aryloxy groups (e.g., phenoxy groups, tolyloxy groups, etc.), alkylthio groups (e.g., ethylthio groups, dodecylthio groups, etc.), arylthio groups (e.g., phenylthio groups, α-naphthylthio groups, etc.), carboxyl groups, acylamino groups (e.g., acetylamino groups, 3-[(2,4-di-tert-amylphenoxy)acetamido]benzamido groups, etc.), diacylamino groups, N-alkylacylamino groups (e.g., N-methylpropionamido groups, etc.), N-arylacylamino groups (e.g., N-phenylacetamido groups, etc.), ureido groups (e.g., ureido group, N-arylureido groups, N-alkylureido groups, etc.), thioureido groups (e.g., thioureido groups, N-alkylthioureido groups, etc.), urethane group, thiourethane group, arylamino groups (e.g., phenylamino groups, N-methylanilino groups, diphenylamino groups, N-acetylanilino groups, 2-chloro-5-tetradecanamidoanilino groups, etc.), alkylamino groups (e.g., n-butylamino groups, methylamino groups, cyclohexylamino groups, etc.), cycloamino groups (e.g., piperidino, pyrrolidino, etc.), heterocyclic amino groups (e.g., 4-pyridylamino groups, 2-benzoxazolylamino groups, etc.), alkylcarbonyl groups (e.g., methylcarbonyl groups, etc.), arylcarbonyl groups (e.g., phenylcarbonyl groups, etc.), sulfonamido groups (e.g., alkylsulfonamido groups, arylsulfonamido groups, etc.), carbamoyl groups (e.g., ethylcarbamoyl groups, dimethylcarbamoyl groups, N-methyl-phenylcarbamoyl group, N-phenylcarbamoyl groups, etc.), sulfamoyl groups (e.g., N-alkylsulfamoyl groups, N,N-dialkylsulfamoyl groups, N-arylsulfamoyl groups, N-alkyl-N-arylsulfamoyl groups, N,N-diarylsulfamoyl groups, etc.), acyloxy groups (e.g., benzoyloxy groups, etc.), sulfonyloxy groups (e.g., benzenesulfonyloxy groups, etc.), cyano groups, hydroxy groups, mercapto groups, halogen atoms, nitro groups, and sulfo groups.

Among the magenta couplers represented by general formula (II), particularly preferred ones are those containing an anilino group, an acylamino group or an arylureido group as $R^2$, and an aryl group substituted by a chlorine atom at at least one ortho-position as $R^1$.

When Za, Zb, Zc or Zd in general formula (II) represents a substituted methine, the substituent group is selected from those cited as examples for $R^2$.

A nitrogen-containing ring constructed by Za, Zb, Zc and Zd may be fused together with another ring (e.g., a 5- or 6-membered ring containing any of the moieties, Za-Zb, Zb-Zc and Zc-Zd, preferably a hydrocarbon ring such as a cyclohexene, cyclopentene, benzene or naphthalene ring, or a heterocyclic ring such as a pyridine, pyrimidine, dihydrofuran or dihydrothiophene ring, which each may be substituted by one or more substituents the same as those cited as examples for $R^2$). Za, Zb, Zc and Zd may be the same as or different from one another, but benzotriazolyl-1 and benzotriazolyl-2 are excluded.

The most preferred magenta couplers in the present invention are those which contain as the moiety

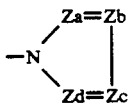

in formula (II) (a) a single 5-membered nitrogen-containing aromatic hetero ring whose members each is selected from among methine, a substituted methine or —N=, or (b) a condensed ring of the formula

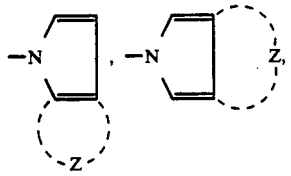

-continued

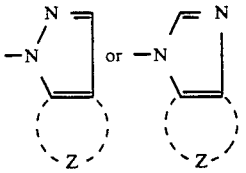

(wherein Z represents nonmetal atoms necessary to complete a 5- or 6-membered ring, and the substituted methine has the same meaning as described above).

The above-cited condensed rings,

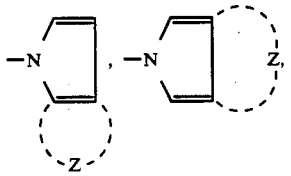

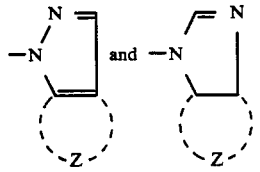

each may be substituted by a group the same as those set forth above as substituent groups regarding the substituted methine. In addition, specific examples of 5- or 6-membered rings completed by Z and fused together with the ring constructed by N, Za, Zb, Zc and Zd are the same as those set forth in the description of general formula (II).

Suitable examples of nitrogen-containing heterocyclic groups represented by

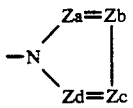

include 1-imidazolyl, 2-methyl-1-imidazolyl, 2-methylthio-1-imidazolyl, 2-ethylthio-1-imidazolyl, 2,4-dimethyl-1-imidazolyl, 4-methyl-1-imidazolyl, 4-nitro-1-imidazolyl, 4-chloro-1-imidazolyl, 4-phenyl-1-imidazolyl, 4-acetyl-1-imidazolyl, 4-tetradecanamido-1-imidazolyl, 1-pyrrolyl, 3,4-dichloro-1-pyrrolyl, 2-isoindolyl, 1-indolyl, 1-pyrazolyl, 1-benzimidazolyl, 5-bromo-1-benzimidazolyl, 5-octadecanamido-1-benzimidazolyl, 2-methyl-1-benzimidazolyl, 5-methyl-1-benzimidazolyl, 7-purinyl, 2-indazolyl, 2,2,4,4-triazolyl, 1,2,3-1-triazolyl, 1-tetrazolyl, and so on.

Further, the compound represented by general formula (II) may be connected to the main chain of a polymer via $R^1$, $R^2$ or

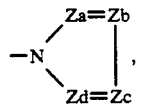

in analogy with the compounds described in Japanese Patent Application (OPI) Nos. 94752/82, 224352/83 and 35730/85.

The magenta couplers represented by general formula (III) are described in detail below.

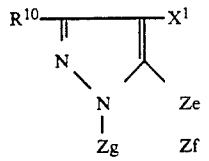

(III)

wherein, $R^{10}$ represents a hydrogen atom or a substituent group; $X^1$ represents a hydrogen atom, or a group capable of splitting away from the coupler by reacting with an oxidation product of an aromatic primary amine developing agent; and Ze, Zf and Zg each represents a methine group, a substituted methine group, =N— or —NH—. Either of the Ze-Zf bond or the Zf-Zg bond is a single bond, and the remainder is a double bond. When the Zf-Zg is a C—C double bond, it may constitute a part of an aromatic ring. The magenta coupler of formula (III) may form a polymer (including a dimer) via $R^{10}$ or $X^1$. When Ze, Zf or Zg represents a substituted methine, formation of the polymer may also be taken place via the substituted methine.

More specifically, the term polymer as used in the description of general formula (III) means a compound containing two or more of coupler moiety derived from the magenta coupler of formula (III) in a molecule, including bis-compounds and polymeric couplers. The polymeric couplers may be homopolymers constituted only by the monomers containing the coupler moiety derived from the coupler represented by formula (III) (preferably those having a vinyl group, called vinyl monomers hereinafter), or copolymers prepared from the above-described vinyl monomers and ethylenic unsaturated monomers incapable of undergoing a coupling reaction with the oxidation products of aromatic primary amine developers and consequently, in capable of forming colors.

Of the pyrazoloazole type magenta couplers represented by general formula (III), those represented by the following general formulae (a), (b), (c), (d), (e), (f) and (g), respectively, are preferred over others.

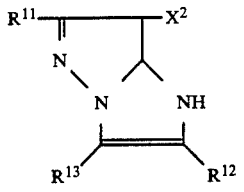

(a)

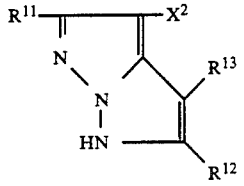

(b)

-continued

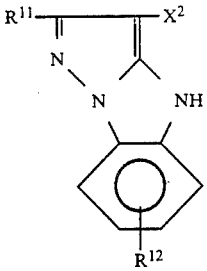

(c)

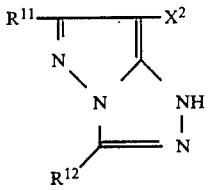

(d)

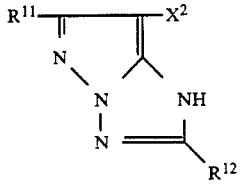

(e)

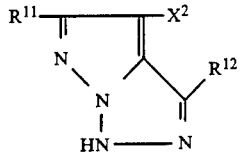

(f)

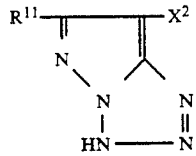

(g)

In general formula (a) to (g), $R^{11}$, $R^{12}$ and $R^{13}$ may be the same or different, and each represents a hydrogen atom, a halogen atom, an alkyl group, an aryl group, a heterocyclic group, a cyano group, an alkoxy group, an aryloxy group, a heterocyclyloxy group, an acyloxy group, a carbamoyloxy group, a silyloxy group, a sulfonyloxy group, an acylamino group, an anilino group, an ureido group, an imido group, a sulfamoylamino group, a carbamoylamino group, an alkylthio group, an arylthio group, a heterocyclylthio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycaronyl group. These groups may be further substituted once or twice with a substituent such as those recited above. $X^2$ represents a hydrogen atom, a halogen atom, a carboxy group, or a coupling eliminable group which is attached to the carbon atom located at the coupling position through its oxygen, nitrogen or sulfur atom. In addition, $R^{11}$, $R^{12}$, $R^{13}$ or $X^2$ may be a divalent group, and in this case a bis-compound may be formed via the divalent group.

Further, coupler moieties of the couplers represented by general formula (a) to (g) may be present in the main or side chains of polymers. In particular, polymers derived from vinyl monomers containing one of the moieties derived from compounds represented by general formula (a) to (g) are advantageously employed in the present invention. In such a case $R^{11}$, $R^{12}$, $R^{13}$ or $X^2$ represents a substituted or unsubstituted vinyl group or a vinyl group bonded with the coupler moiety through a linkage group.

In more detail, $R^{11}$, $R^{12}$ and $R^{13}$ each represents a hydrogen atom, a halogen atom (e.g., chlorine, bromine, etc.), an alkyl group (e.g., methyl, propyl, t-butyl, trifluoromethyl, tridecyl, 3-(2,4-di-t-amylphenoxy)propyl, ally, 2-dodecyloxyethyl, 3-phenoxypropyl, 2-hexylsulfonylethyl, cyclopentyl, benzyl, etc.), an aryl group (e.g., phenyl, 4-t-butylphenyl, 2,4-di-t-amylphenyl, 4-tetradecanamidophenyl, etc.), a heterocyclic group (e.g., 2-furyl, 2-thienyl, 2-pyrimidinyl, 2-benzothiazolyl, etc.), a cyano group, an alkoxy group (e.g., methoxy, ethoxy, 2-methoxyethoxy, 2-dodecyloxyethoxy, 2-methanesulfonylethoxy, etc.), an aryloxy group (e.g., phenoxy, 2-methylphenoxy, 4-t-butylphenoxy, etc.), a heterocyclyloxy group (e.g., 2-benzimidazolyloxy, etc.), an acyloxy group (e.g., acetoxy, hexadecanoyloxy, etc.), a carbamoyloxy group (e.g., N-phenylcarbamoyloxy, N-ethylcarbamoyloxy, etc.), a silyloxy group (e.g., trimethylsilyloxy, etc.), a sulfonyloxy group (e.g., dodecylsulfonyloxy, etc.), an acylamino group (e.g., acetamido, benzamido, tetradecanamido, α-(2,4-di-t-amylphenoxy)butylamido, γ-(3-t-butyl-4-hydroxyphenoxy)butylamido, α-{4-(4-hydroxyphenylsulfonyl)phenoxy}decanamido, etc.), an anilino group (e.g., phenylamino, 2-chloroanilino, 2-chloro-5-tetradecanamidoanilino, 2-chloro-5-dodecyloxycarbonylanilino, N-acetylanilino, 2-chloro-5-{α-(3-t-butyl-4-hydroxyphenoxy)-dodecanamido}anilino, etc.), an ureido group (e.g., phenylureido, methylureido, N,N-dibutylureido, etc.), an imido group (e.g., N-succinimido, 3-benzylhydantoinyl, 4-(2-ethylhexanoylamino)phthalimido, etc.), a sulfamoylamino group (e.g., N,N-dipropylsulfamoylamino, N-methyl-N-decylsulfamoylamino, etc.), a carbamoylamino group (e.g., methyl carbamoylamino, p-cyanophenyl carbamoylamino, etc.), an alkylthio group (e.g., methylthio, octylthio, tetradecylthio, 2-phenoxyethylthio, 3-phenoxypropylthio, 3-(4-t-butylphenoxy)propylthio, etc.), an arylthio group (e.g., phenylthio, 2-butoxy-5-t-octylphenylthio, 3-pentadecylphenylthio, 2-carboxyphenylthio, 4-tetradecanamidophenylthio, etc.), a heterocylilthio group (e.g., 2-benzothiazolylthio, etc.), an alkoxycarbonylamino group (e.g., methoxycarbonylamino, tetradecyloxycarbonylamino, benzyloxycarbonylamino, etc.), an aryloxycarbonylamino group (e.g., phenoxycarbonylamino, 2,4-di-tert-butylphenoxycarbonylamino, etc.), a sulfonamido group (e.g., methanesulfonamido, hexadecanesulfonamido, benzenesulfonamido, p-toluenesulfonamido, octadecanesulfonamido, 2-methyloxy-5-t-butylbenzenesulfonamido, etc.), a carbamoyl group (e.g., N-ethylcarbamoyl, N,N-dibutylcarbamoyl, N-(2-dodecyloxyethyl)carbamoyl, N-methyl-N-dodecylcarbamoyl, N-{3-(2,4-di-tert-amylphenoxy)propyl}carbamoyl, etc.), an acyl group (e.g., acetyl, (2,4-di-tert-amylphenoxy)acetyl, benzoyl, etc.), a sufamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl, etc.), a sulfonyl group (e.g., methanesulfonyl, octanesulfonyl, benzenesulfonyl, toluenesulfonyl, etc.), a sulfinyl group (e.g., octanesulfinyl, dodecylsulfinyl, phenylsulfinyl, etc.), an alkoxycarbonyl group (e.g., methoxycarbonyl, a butyloxycarbonyl, dodecyloxycarbonyl, octadecyloxycarbonyl, etc.), or an aryloxycarbonyl group (e.g., phenyloxycarbonyl, 3-pentadecyl oxyphenyloxycarbonyl, etc.).

$X^2$ represents a hydrogen atom, a halogen atom (e.g., chlorine, bromine, iodine, etc.), a carboxyl group, a group capable of connecting to the ring-forming carbon via an oxygen atom (e.g., acetoxy, propanoyloxy, benzoyloxy, 2,4-dichlorobenzoyloxy, ethoxyoxaloyloxy, pyruvinyloxy, cinnamoyloxy, phenoxy, 4-cyanophenoxyl, 4-methanesulfonamidophenoxy, 4-methanesulfonylphenoxy, α-naphthoxy, 3-pentadecylphenoxy, benzyloxycarbonyloxy, ethoxy, 2-cyanoethoxy, benzyloxy, 2-phenetyloxy, 2-phenoxyethoxy, 5-phenyltetrazolyloxy, 2-benzothiazolyloxy, etc.), a group capable of connecting to the ring-forming carbon via a nitrogen atom (e.g., benzenesulfonamido, N-ethyltoluenesulfonamido, heptafluorobutanamido, 2,3,4,5,6-pentafluorobenzamido, octanesulfonamido, p-cyanophenylureido, N,N-diethylsulfamoylamino, 1-piperidyl 5,5-dimethyl-2,4-dimethyl-2,4-dioxo-3-oxazolidinyl, 1-benzyl-ethoxy-3-hydantoinyl, 2N-1,1-dioxo-3(2H)-oxo-1,2-benzoisothiazolyl, 2-oxo-1,2-dihydro-1-pyridinyl, imidazolyl, pyrazolyl, 3,5-diethyl-1,2,4-triazole-1-yl, 5- or 6-bromobenzotriazole-1-yl, 5-methyl-1,2,4-triazole-1-yl, benzimidazolyl, 3-benzyl-1-hydantoinyl, 1-benzyl-5-hexadecyloxy-3-hydantoinyl, 5-methyl-1-tetrazolyl, and arylazo groups such as 4-methoxyphenylazo, 4-pivaloylaminophenylazo, 2-naphthylazo, 3-methyl-4-hydroxyphenylazo, etc.), or a group capable of connecting to the ring-forming carbon via a sulfur atom (e.g., phenylthio, 2-carboxyphenylthio, 2-methoxy-5-t-octylphenylthio, 4-methanesulfonylphenylthio, 4-octanesulfonamidophenylthio, 2-butoxyphenylthio, 2-(2-hexasulfonylethyl)-5-tert-octylphenylthio, benzylthio, 2-cyanoethylthio, 1-ethoxycarbonyltridecylthio, 5-phenyl-2,3,4,5-tetrazolythio, 2-benzothiazolythio, 2-dodecylthio-5-thiophenylthio, 2-phenyl-3-dodecyl-1,2,4-triazolyl-t-thio, etc.).

In the couplers of general formulae (a) and those of general formula (b), $R^{12}$ and $R^{13}$ may combine with each other to form a 5- to 7-membered ring.

Of the couplers represented by general formulae (a) to (g), those of formula (a), those of formula (d) and those of formula (e) are preferred over others. In particular, the couplers of formula (e) are employed to great advantage.

When $R^{11}$, $R^{12}$, $R^{13}$ or $X^2$ represents a divalent group and therethrough, a bis-compound is formed, preferred examples of divalent groups represented by $R^{11}$, $R^{12}$ or $R^{13}$ include substituted or unsubstituted alkylene groups (e.g., methylene, ethylene, 1,10-decylene, $—CH_2CH_2—O—CH_2CH_2—$, etc.), substituted or unsubstituted phenylene groups (e.g., 1,4-phenylene, 1,3-phenylene,

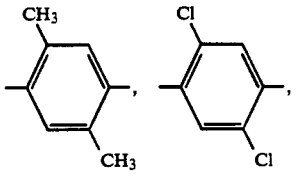

etc.), —NHCO—$R^{14}$—CONH— groups (wherein $R^{14}$ represents a substituted or unsubstituted alkylene or phenylene group, such as $—NHCOCH_2CH_2CONH—$, $—NHCOCH_2C(CH_3)_2CH_2—CONH—$,

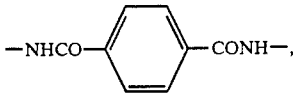

etc.), or —S—$R^{15}$—S— group (wherein $R^{15}$ represents a substituted or unsubstituted alkylene group, such as —S—$CH_2CH_2$—S—, —S—$CH_2C(CH_3)_2$—$CH_2$—S—, etc.), while $X^2$ represents a divalent group derived from any of the monovalent groups cited above as specific examples of $X^2$.

Specific examples of the groups represented by $R^{11}$, $R^{12}$, $R^{13}$ or $X^2$, when the coupler represented by general formula (a), (b), (c), (d), (e), (f) and (g) are vinyl monomers include those formed by combining the vinyl group and two or more of linkage groups selected from among substituted or unsubstituted alkylene groups (such as methylene, ethylene, 1,10-decylene, —$CH_2CH_2OCH_2CH_2$—, etc.), substituted or unsubstituted phenylene groups (such as 1,4-phenylene, 1,3-phenylene,

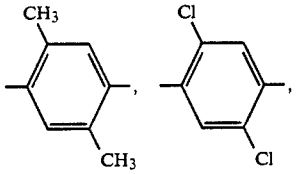

etc.), —NHCO—, —CONH—, —O—, —OCO—, and aralkylene groups (such as

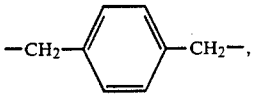

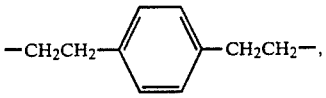

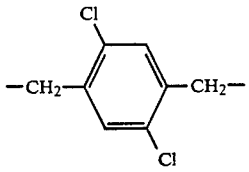

etc.).

As suitable example of such linkage groups, mention may be made of —NHCO—, —$CH_2CH_2$—,

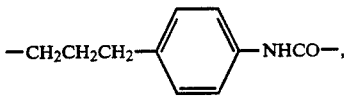

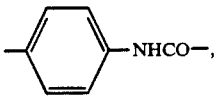

—$CH_2CH_2$NHCO—, —$CH_2CH_2$—OCO—, —CONH—$CH_2CH_2$NHCO—, —$CH_2CH_2OCH_2CH_2$NHCO—,

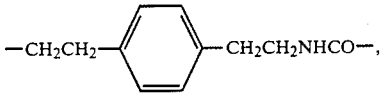

etc.

When the coupler represented by general formula (a), (b), (c), (d), (e), (f) or (g) has a vinyl group, the vinyl group may be substituted by another group. Preferable examples include an unsubstituted vinyl group and substituted group with a chlorine atom, a lower alkyl group containing 1 to 4 carbon atoms, and so on.

The monomers represented by general formula (a), (b), (c), (d), (e), (f) or (g) may form copolymers together with ethylenic unsaturated monomers incapable of undergoing the coupling reaction with oxidation products of aromatic primary amine developers.

Specific examples of ethylenic unsaturated monomers of the above-described kind include acrylic acid, α-chloroacrylic acid, α-alkylacrylic acids (e.g., methacrylic acid, etc.), amides or esters derived from the above-described acrylic acids (e.g., acrylamide, n-butylacrylamide, t-butylacrylamide, diacetoneacrylamide, methacrylamide, methylacrylate, ethylacrylate, n-propylacrylate, n-butylacrylate, t-butylacrylate, isobutylacrylate, 2-ethylhexylacrylate, n-octylacrylate, laurylacrylate, methylmethacrylate, ethylmethacrylate, n-butylmethacrylate, and β-hydroxymethacrylate), methylenebisacrylamide, vinyl esters (e.g., vinyl acetate, vinyl propionate, and vinyl laurate), acrylonitrile, methacrylonitrile, aromatic vinyl compounds (e.g., styrene and its derivatives, vinyltoluene, divinylbenzene, vinylacetophenone, and sulfostyrene), itaconic acid, citraconic acid, crotonic acid, vinylidene chloride, vinyl alkyl ethers (e.g., vinyl ethyl ether), maleic acid, maleic anhydride, maleic acid esters, N-vinyl-2-pyrrolidone, N-vinylpyridine, 2- and 4-vinylpyridine, and so on. Two or more of these noncoloring ethylenic unsaturated monomers may also be used together in the copolymerization. For instance, a combination of n-butylacrylate and methylacrylate, that of styrene and methacrylic acid, that of methacrylic acid and acrylamide, that of methylacrylate and diacetoneacrylamide, and so on may be used.

As well-known in the arts of polymeric color couplers, noncoloring ethylenic unsaturated monomers which undergo copolymerization with solid water-insoluble monomeric couplers are chosen so as to exert favorable influences upon the physical and/or chemical properties of the resulting copolymers, e.g., solubility, compatibility with a binder contained in a photographic colloidal composition, e.g., gelatin, flexibility, thermal stability, and so on.

Polymeric couplers which can be used in the present invention may be either soluble or insoluble in water. In particular, it is preferred to use them in the form of latex.

Couplers having high reactivity, so-called high-speed reacting couplers, can be employed as the couplers to be used in the present invention.

The coupling reactivity of the couplers can be determined relatively by mixing two kinds of couplers M and N, which produce different dyes capable of being clearly separated from each other, adding the resulting mixture to an emulsion, subjecting the emulsion to color development to form a dye image, and measuring the respective amounts of dyes contained in the dye image.

When the maximum color density attained by coupler M is represented by (DM)max and a color density obtained by the coupler M at a halfway stage of development is represented by DM, and, similarly, those regarding coupler N are represented by (DN)max and DN, respectively, the ratio of reactivity of coupler M to that of coupler N, RM/RN, is defined by the following equiation:

$$\frac{RM}{RN} = \frac{\log 1 - \frac{DM}{(DM)\text{max}}}{\log 1 - \frac{DN}{(DN)\text{max}}}$$

More specifically, the coupling reactivity ratio RM/RN can be determined as follows: Emulsions containing the above-described coupler mixture are subjected to exposures in various stages, respectively, and then to development-processing. Several pairs of the thus obtained DM and DN values are plotted as axes perpendicular to each other in the form of log(1−D/D-max), and the reactivity ratio RM/RN is calculated from the slope of the log(1−DM/(DM)max) vs. log(1−DN/(DN)max) plots.

Accordingly, if values of the ratio RM/RN are calculated in the above-described manner using a fixed coupler as coupler N, and various couplers as coupler M, the coupling reactivities of the couplers examined can be determined relatively.

For instance, the couplers having the structural formulae illustrated below can be employed as coupler N.

Coupler N for Cyan Coupler

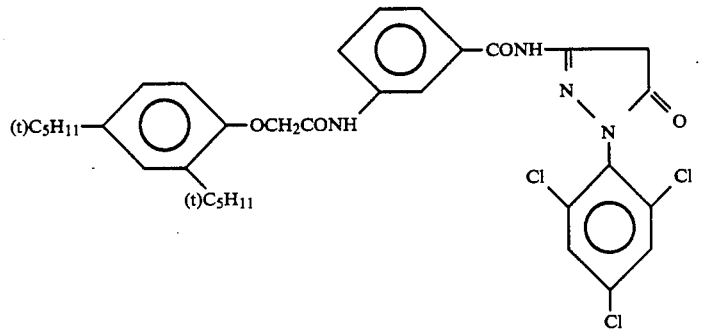

Coupler N for Magenta and Yellow Couplers

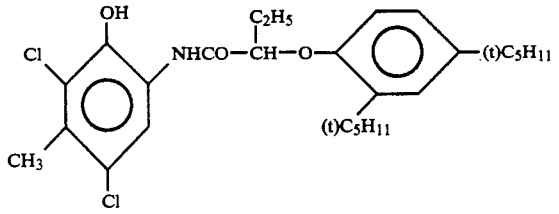

As for the high-speed reacting couplers which can be employed in the present invention, couplers whose RM/RN ratios, determined using the above-illustrated coupler N, are 1.5 or above in case of cyan couplers, 2.5 or above in case of magenta couplers, and 1 or above in case of yellow couplers are preferred.

Specific examples of high-speed reacting couplers which can be preferably used are illustrated below. However the invention should not be construed as being limited to the following example. In these examples, the values in parentheses represent RM/RN values determined using the corresponding coupler N illustrated above.

Examples of Cyan Coupler

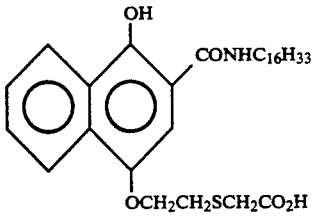

(2.9) (CYAN-1)

-continued
Examples of Cyan Coupler
(CYAN-2)
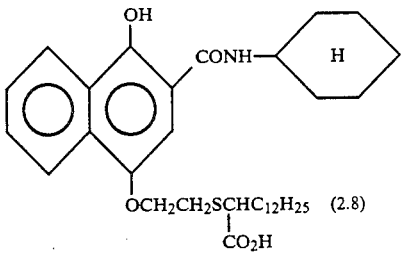
(2.8)
(CYAN-3)
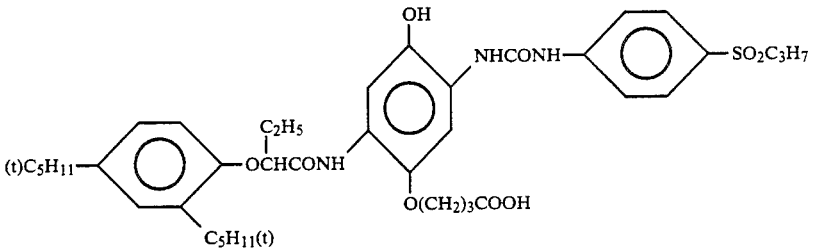
(3.2)
(CYAN-4)
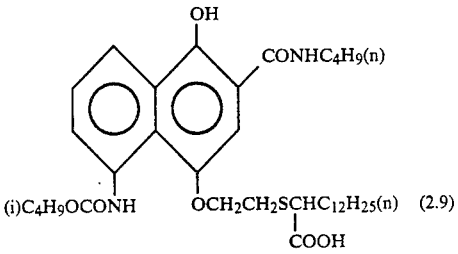
(2.9)
(CYAN-5)
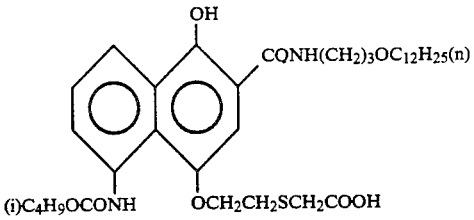
(2.7)
(CYAN-6)
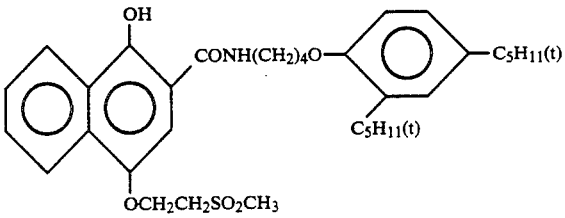
(2.3)
Examples of Magenta Coupler -continued
Examples of Cyan Coupler
(MAGENTA-1)
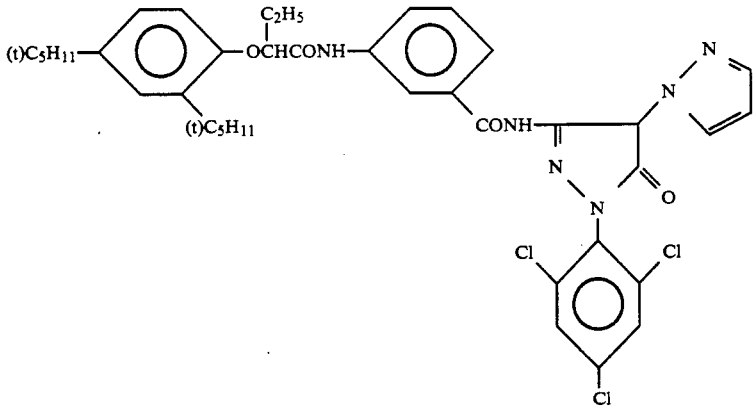
(8.2)
(MAGENTA-2)
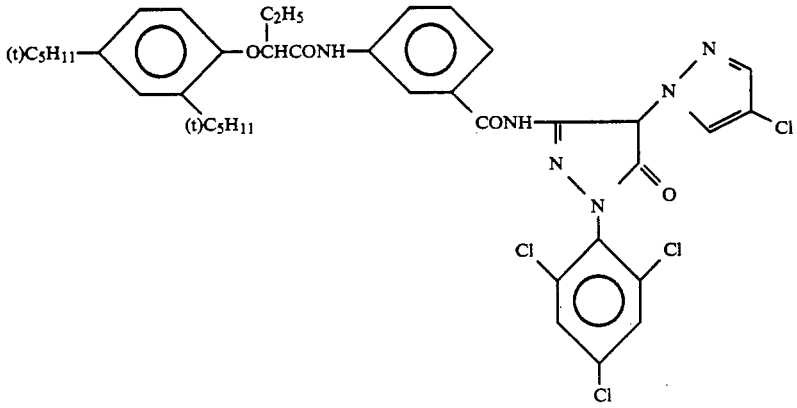
(14)
(MAGENTA-3)
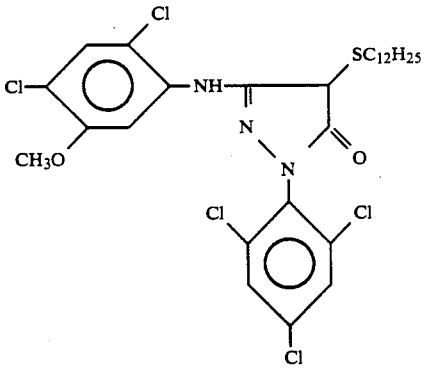
(5)
(MAGENTA-4)
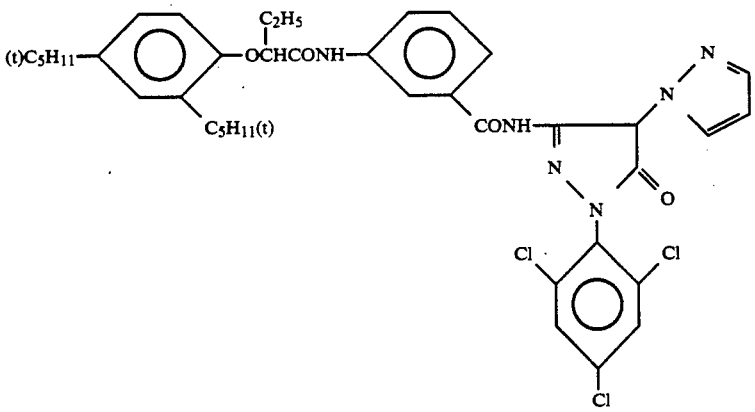
(7.4)

-continued
Examples of Cyan Coupler
(MAGENTA-5)
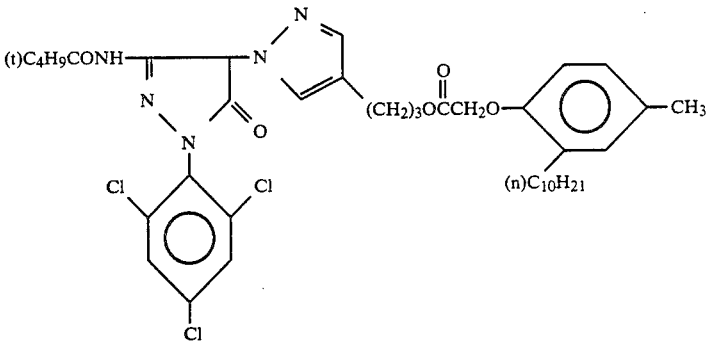
(8.3)
(MAGENTA-6)
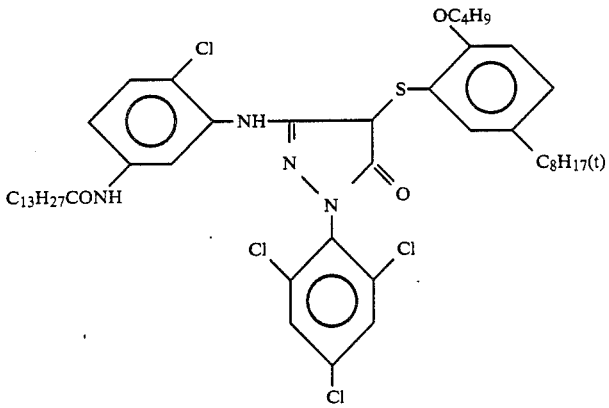
(7.5)
(MAGENTA-7)
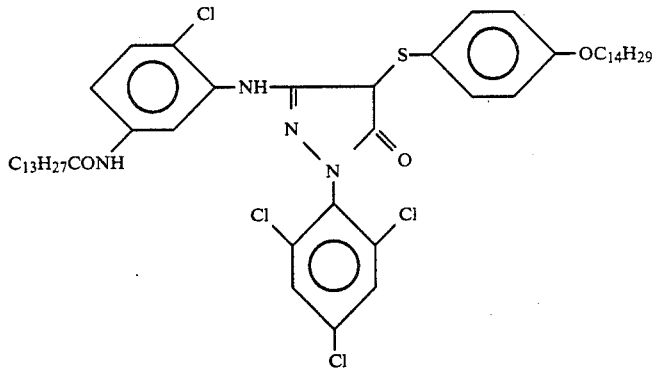
(6.9)
(MAGENTA-8)
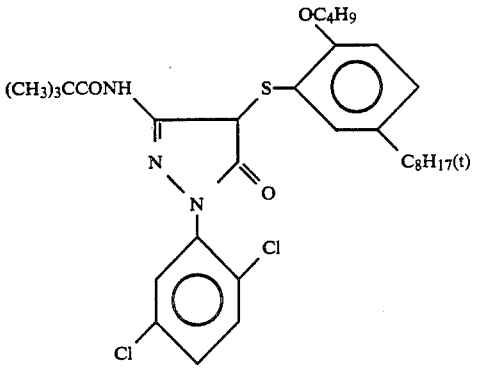
(3.5)

-continued
Examples of Cyan Coupler
(MAGENTA-9)
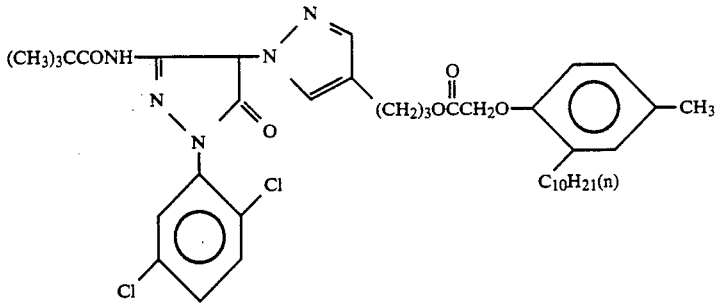
(5.5)
(MAGENTA-10)
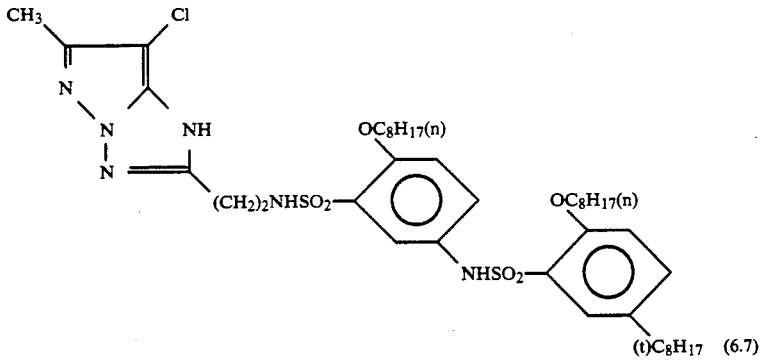
(6.7)
(MAGENTA-11)
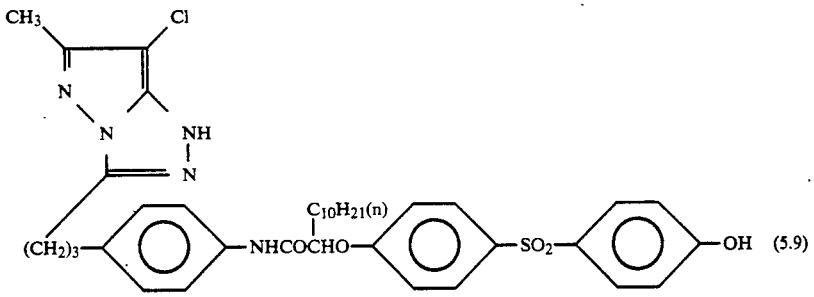
(5.9)
(MAGENTA-12)
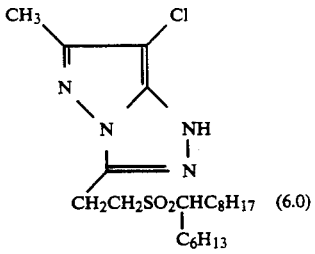
(6.0)
(MAGENTA-13)
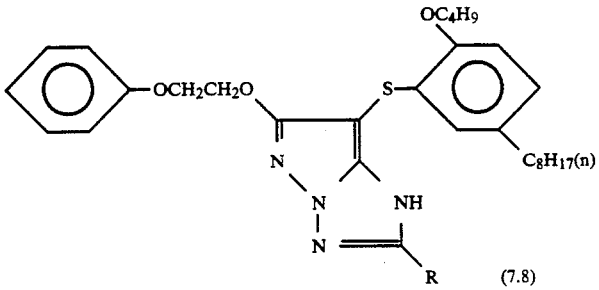
(7.8)

-continued
Examples of Cyan Coupler
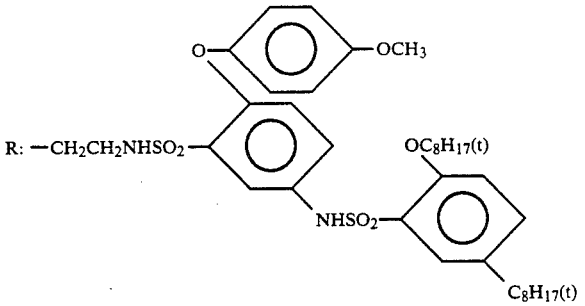
Examples of Yellow Coupler
(YELLOW-1)
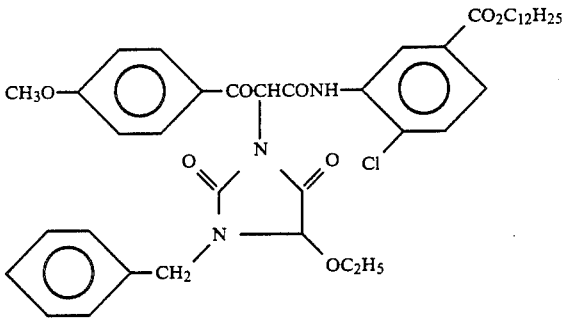
(1.8)
(YELLOW-2)
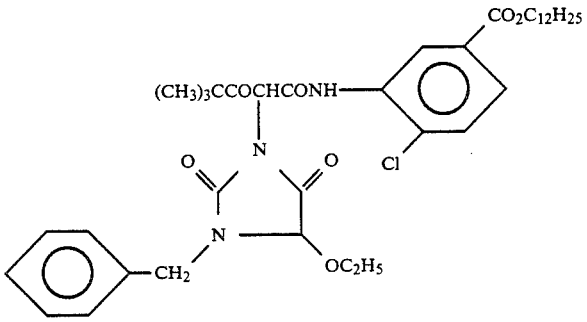
(1.7)
(YELLOW-3)
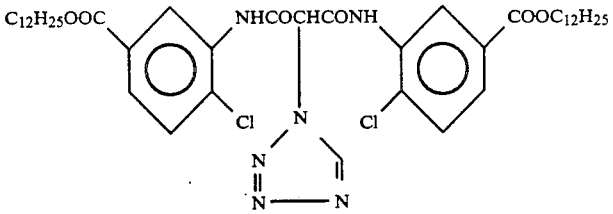
(4.3)
(YELLOW-4)
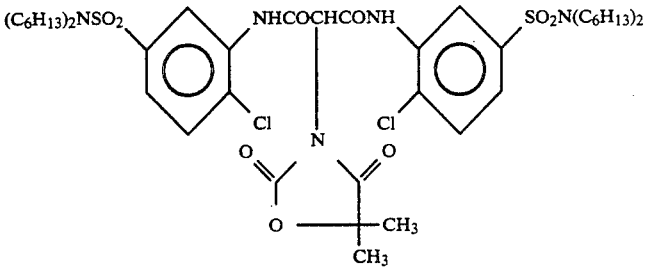
(4.0)

-continued

Examples of Cyan Coupler (YELLOW-5)

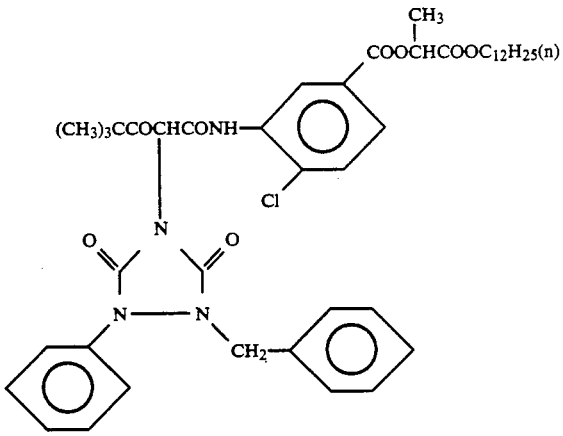

(1.7)

(YELLOW-6)

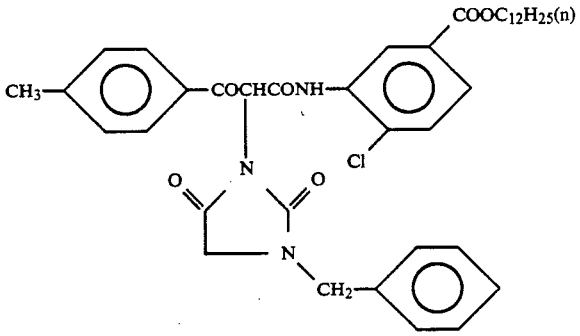

(1.7)

In the present invention, it is favorable that the color sensitive emulsion layers each contain a high-speed reacting coupler as illustrated above in at least the constituent layer having the highest photographic speed of those having the same color sensitivity. The invention has no particular restriction as to the amount of high-speed reacting coupler to be used. However, it is desirable to use high-speed reacting cyan, magenta and yellow couplers each in an amount of 0.005 to 0.1 mole per mole of silver.

Further, nondiffusible couplers capable of producing dyes having moderate diffusibilities, as prescribed in claim 1 and claims 3 to 8 of U.S. Pat. No. 4,420,556, Japanese Patent Application (OPI) 191036/84, and so on, can be also employed in the present invention with the intention of increasing a photographic speed through an increase in the covering power, and improving graininess. Such couplers can be synthesized with ease using methods as described in the foregoing patents, and Japanese Patent Application (OPI) Nos. 1938/81, 3934/82 and 105226/78, U.S. Pat. No. 4,264,723, and so on.

Specific examples of the couplers of the above-described kind are illustrated below.

(Y-1)

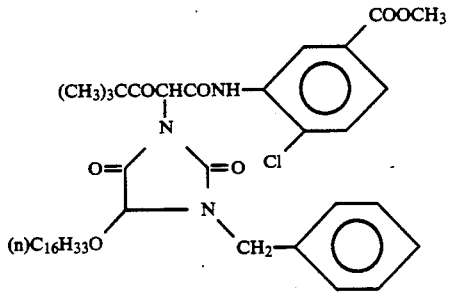

-continued
(Y-2)
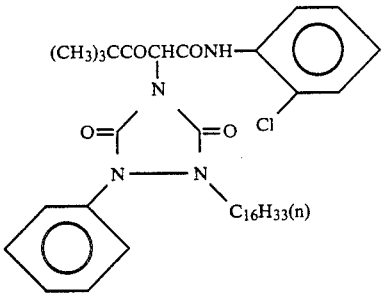
(Y-3)
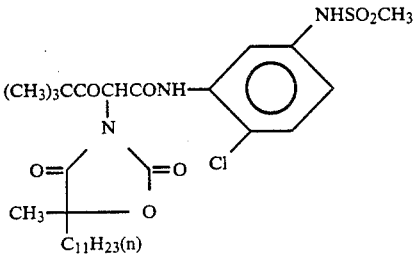
(Y-4)
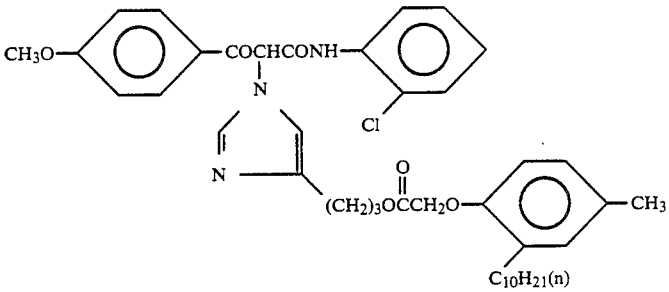
(Y-5)
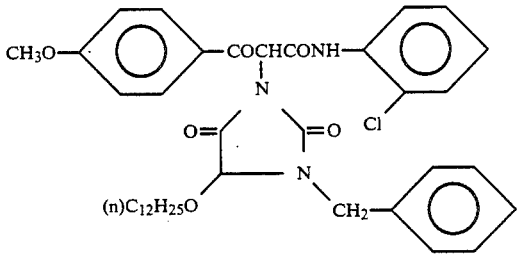
(Y-6)
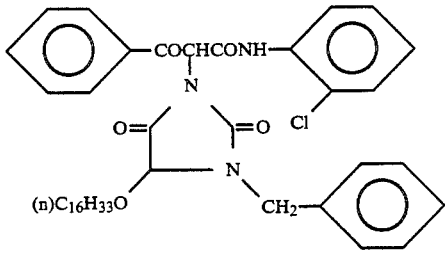
(Y-7)
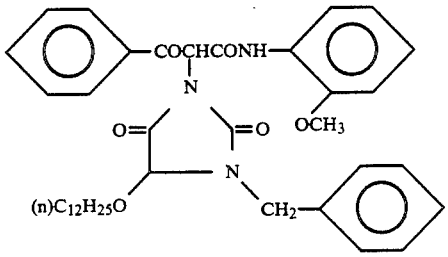

-continued
(M-1)
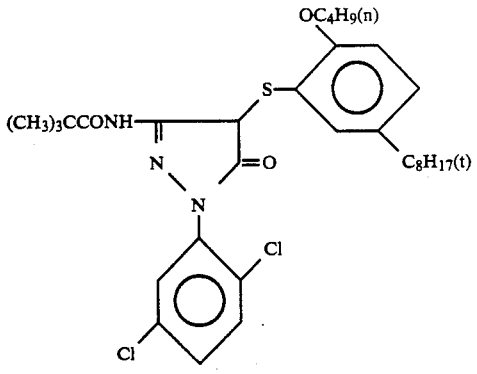
(M-2)
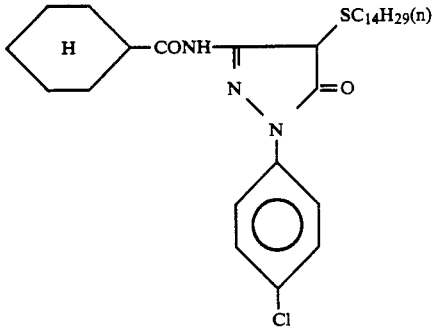
(M-3)
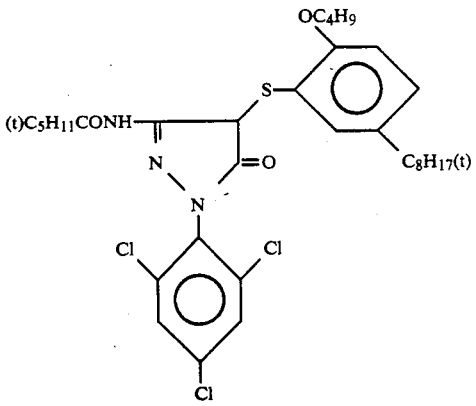
(M-4)
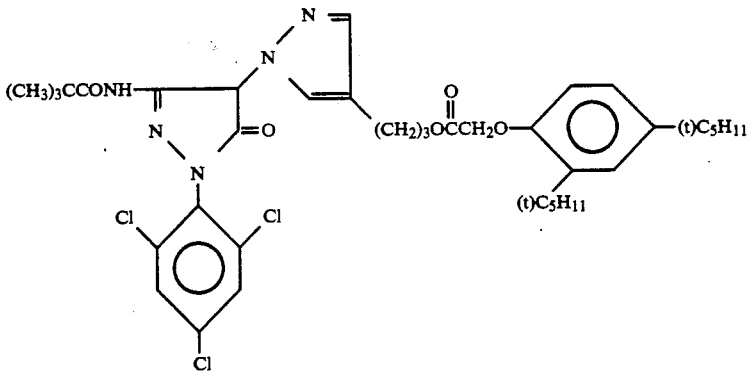

-continued (C-1)

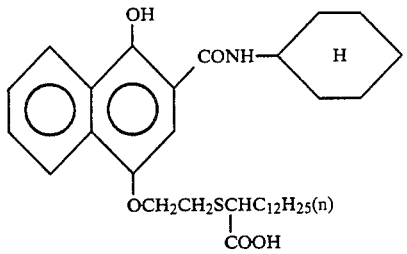

(C-2)

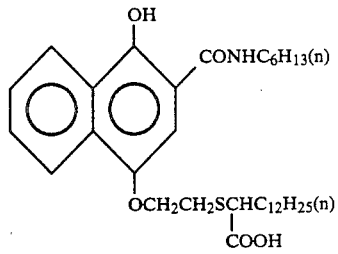

(C-3)

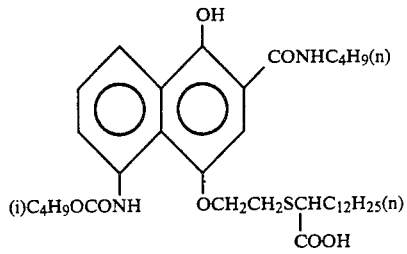

(C-4)

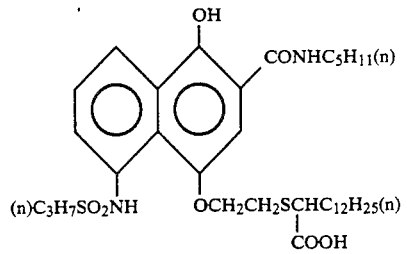

(C-5)

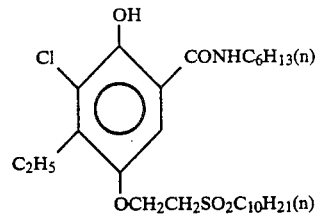

In addition to the above-described couplers, colored couplers having a color correction effect, or couplers capable of releasing a development inhibitor in proportion to the progress of development (so-called DIR couplers) may be contained in the color negative photographic material of the present invention.

Also, colorless DIR coupling compounds which can yield colorless products and release a development inhibitor by a coupling reaction may be employed.

The compounds represented by the following general formula (IV) are preferably used in the present invention as a compound capable of releasing a development inhibitor, including a DIR coupler, a colorless DIR coupling compound and so on, (which are collectively called DIR compounds).

$$A-(TIME)_n-B \qquad (IV)$$

Wherein, A represents a coupler residue capable of splitting off from $(TIME)_n-B$ by a coupling reaction with an oxidation product of an aromatic primary amine developer, TIME represents a timing group which is attached to the coupling active site of A and can release B after splitting-off from A by the coupling reaction, B represents a moiety capable of inhibiting the development of silver halide, and n represents 0 or 1. When n is 0, B is attached directly to A.

The DIR compounds represented by general formula (IV) are described in detail below.

Coupler residues represented by A in formula (IV) include those which can form dyes (e.g., yellow, magenta, cyan and other dyes) by the coupling reaction with oxidation products of aromatic primary amine developers, and those which can yield coupling reaction products having, in a substantial sense, no absorption in the visible region.

Suitable examples of yellow dye image-forming coupler residues represented by A include coupler residues of pivaloylacetoanilide type, benzoylacetoanilide type, malonic diester type, malonic acid diamide type, dibenzoylmethane type, benzothiazolylacetamide type, malonic ester monoamide type, benzothiazolylacetate type, benzoxazolylacetamide type, benzoxazolylacetate type, benzimidazolylacetamide type or benzimidazolylacetate type; coupler residues derived from hetero ring-substituted acetamides or heterocyclic ring substituted acetates as described in U.S. Pat. No. 3,841,880; coupler residues derived from acylacetamides described in U.S. Pat. No. 3,770,446, British Patent 1,459,171, West German Patent Application (OLS) No. 2,503,099, Japanese Patent Application (OPI) No. 139738/75; coupler residues of a hetero ring type described in U.S. Pat. No. 4,046,574; and so on.

Suitable examples of magenta dye image-forming coupler residues represented by A include coupler residues having a 5-oxo-2-pyrazoline nucleus, a pyrazolo[1,5-a]benzimidazole nucleus, a pyrazoloimidazole nucleus, a pyrazolotriazole nucleus or a pyrazolotetrazole nucleus, and residues of cyanoacetophenone type couplers.

Suitable examples of cyan dye image-forming coupler residues represented by A include those containing a phenol nucleus us or an α-naphthol nucleus.

Even when DIR compounds having coupler residue which do not yield dye in a substantial sense after they release development inhibitors by the coupling with exidation products of developing agents, they are the same as DIR couplers in terms of the effects of DIR compounds. Suitable examples of the above-described kind of coupler residues represented by A are those described, e.g., in U.S. Pat. Nos. 4,052,213, 4,088,491, 3,632,345, 3,958,993 and 3,961,958, and so on.

Preferred examples of TIME in general formula (IV) include those represented by groups (1) to (3) below.

(1) Groups utilizing the cleavage reaction of a hemiacetal, as described, e.g., in U.S. Pat. No. 4,146,396, and Japanese Patent Application (OPI) Nos. 249148/85, 249149/85 and 218645/85, which are represented by general formula (i):

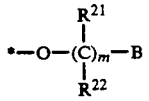

(i)

In the above formula, the mark * represents the position to be attached to the coupling site of A, $R^{21}$ and $R^{22}$ each represents a hydrogen atom or a substituent group, and m represents 1 or 1. When m is 2, two $R^{21}$ groups and two $R^{22}$ groups may be the same or different, and any two of them may combine with each other to form a ring structure. B has the same meaning as in the general formula (IV).

Preferable examples of $R^{21}$ and $R^{22}$ include a hydrogen atom, an alkyl group having from 1 to 8 carbon atoms (e.g., methyl and ethyl) and an aryl group having from 6 to 12 carbon atoms (e.g., phenyl), and the most preferable example for both of $R^{21}$ and $R^{22}$ is a hydrogen atom.

(2) Groups causing a cleavage reaction utilizing an intramolecular nucleophilic substitution reaction, for example, timing groups described in U.S. Pat. No. 4,248,962.

(3) Groups causing a cleavage reaction utilizing an electron transfer reaction along a conjugated system, for example, groups described in U.S. Pat. No. 4,409,323, and groups represented by the following general formula (ii) (i.e., those described in British Patent 2,096,782A):

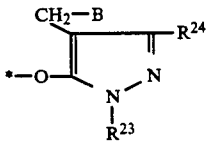

(ii)

In the above formula, the mark * represents the position to be attached to the coupling site of A, $R^{23}$ and $R^{24}$ each represents a hydrogen atom or a substituent group, and B has the same meaning as in general formula (IV).

Suitable examples of $R^{23}$ include alkyl groups containing 1 to 24 carbon atoms (such as methyl, ethyl, benzyl, dodecyl, etc.), and aryl groups containing 6 to 24 carbon atoms (such as phenyl, 4-tetradecyloxyphenyl, 4-methoxyphenyl, 2,4,6-trichlorophenyl, 4-nitrophenyl, 4-chlorophenyl, 2,5-dichlorophenyl, 4-carboxyphenyl, p-tolyl, etc.). Suitable examples of $R^{24}$ include a hydrogen atom, alkyl groups containing 1 to 24 carbon atoms (such as methyl, ethyl, undecyl, pentadecyl, etc.), aryl groups containing 6 to 36 carbon atoms (e.g., phenyl, 4-methoxyphenyl, etc.), a cyano group, alkoxy groups containing 1 to 24 carbon atoms (e.g., methoxy, ethoxy, dodecyloxy, etc.), amino groups containing 0 to 36 carbon atoms (such as amino, dimethylamino, piperidino, dihexylamino, anilino, etc.), carbonamido groups containing 1 to 24 carbon atoms (such as acetamido, benzamido, tetradecanamido, etc.), sulfonamido groups containing 1 to 24 carbon atoms (such as methylsulfonamido, phenylsulfonamido, etc.), a carboxy group, alkoxycarbonyl groups containing 2 to 24 carbon atoms (such as methoxycarbonyl, ethoxycarbonyl, dodecyloxycarbonyl, etc.), carbamoyl groups containing 1 to 24 carbon atoms (such as carbamoyl, dimethylcarbamoyl, pyrrolidinocarbonyl, etc.), and so on.

Preferred examples of B in general formula (IV) include groups represented by the following general formulae (V-a), (V-b), (V-c), (V-d), (V-e), (V-f), (V-g), (V-h), (V-i), (V-j), (V-k), (V-l), (V-m), (V-n), (V-o) and (V-p), respectively.

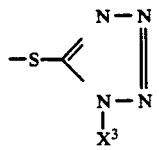

(V-a)

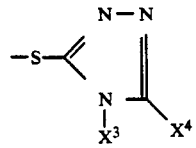

(V-b)

-continued (V-c)

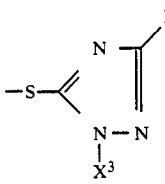

(V-d)

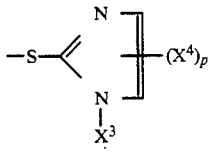

(V-e)

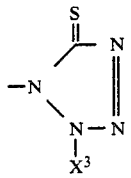

(V-f)

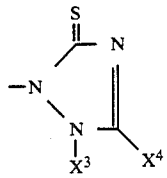

(V-g)

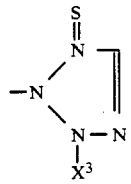

(V-h)

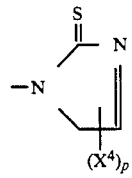

(V-i)

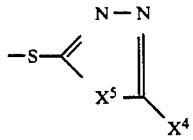

(V-j)

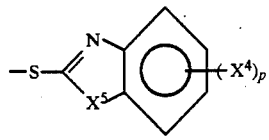

(V-k)

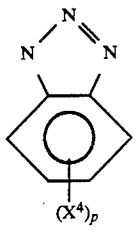

-continued (V-l)

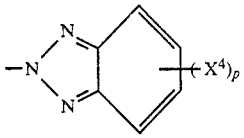

(V-m)

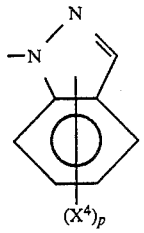

(V-n)

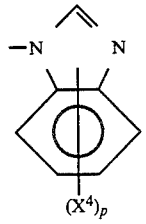

(V-o)

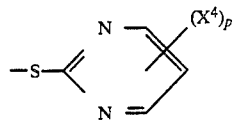

(V-p)

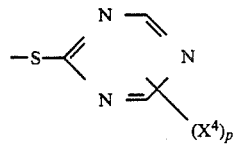

In the foregoing formulae, $X^3$ represents a substituted or unsubstituted aliphatic group containing 1 to 4 carbon atoms (as for the substituent group, it is selected from among an alkoxy group, an alkoxycarbonyl group, hydroxyl group, an acylamino group, a carbamoyl group, a sulfonyl group, a sulfonamido group, a sulfamoyl group, an amino group, an acyloxy group, cyano group, an ureido group, an acyl group, a halogen atom and an alkylthio group. The number of carbon atoms contained in these groups is 3 or less), or a substituted phenyl group (a substituent group thereof is selected from among hydroxy group, an alkoxycarbonyl group, an acylamino group, a carbamoyl group, a sulfonyl group, a sulfonamido group, a sulfamoyl group, an acyloxy group, an ureido group, carboxyl group, cyano group, nitro group, an amino group and an acyl group, and the number of carbon atoms contained in these groups is 3 or less). $X^4$ represents a hydrogen atom, an aliphatic group, a halogen atom, a hydroxyl group, an alkoxy group, an alkylthio group, an alkoxycarbonyl group, an acylamino group, a carbamoyl group, a sulfonyl group, a sulfonamido group, a sulfamoyl group, an acyloxy group, an ureido group, a cyano group, a nitro group, an amino group, an alkoxycarbonylamino group, an aryloxycarbonyl group, or an acyl group. $X^5$ represents an oxygen atom, a sulfur atom, or an imino group containing not more than 4 carbon atom. p represents an integer of 1 or 2. p $X^4$'s must have a combined total of 8 or less carbon atoms. When p is 2, two $X^4$'s may be the same or different.

Preferred examples of the substituent groups $X^3$, $X^4$ and $X^5$ in the groups represented by the foregoing general formulae (V-A) to (V-P) are described below.

Specific examples of $X^3$ include a methyl group, an ethyl group, a propyl group, a butyl group, a methoxyethyl group, an ethoxyethyl group, an iso-butyl group, an allyl group, a dimethylaminoethyl group, a propargyl group, a chloroethyl group, a methoxycarbonylmethyl group, a methylthioethyl group, a 4-hydroxyphenyl group, a 3-hydroxyphenyl group, a 4-sulfamoylphenyl group, a 3-sulfamoylphenyl group, a 4-carbamoylphenyl group, a 3-carbamoylphenyl group, a 4-dimethylaminophenyl group, a 3-acetoamidophenyl group, a 4-propanamidophenyl group, a 4-methoxyphenyl group, a 2-hydroxyphenyl group, a 2,5-dihydroxyphenyl group, a 3-methoxycarbonylaminophenyl group, a 3-(3-methylureido)phenyl group, a 3-(3-ethylureido)phenyl group, a 4-hydroxyethoxyphenyl group, a 3-acetamido-4-methoxyphenyl group, and so on.

Specific examples of $X^4$ include a hydrogen atom, a methyl group, an ethyl group, a benzyl group, a n-propyl group, a i-propyl group, a n-butyl group, a i-butyl group, a cyclohexyl group, a fluorine atom, a chlorine atom, bromine atom, an idodine atom, a hydroxymethyl group, a hydroxyethyl group, a hydroxy group, a methoxy group, an ethoxy group, a butoxy group, an allyloxy group, a benzyloxy group, a methylthio group, an ethylthio group, a methoxycarbonyl group, an ethoxycarbonyl group, an acetamido group, a propanamido group, a butanamido group, an octanamido group, a benzamido group, a dimethylcarbamoyl group, a methylsulfonyl group, a methylsulfonamido group, a phenylsulfonamido group, a dimethylsulfamoyl group, an acetoxy group, an ureido group, a 3-methylureido group, a cyano group, a nitro group, an amino group, a dimethylamino group, a methoxycarbonylamino group, an ethoxycarbonylamino group, a phenoxycarbonyl group, a methoxyethyl group, an acetyl group, and so on.

Specific examples of $X^5$ include a oxygen atom, a sulfur atom, an imino group, a methylimino group, and ethylimino group, a propylimino group, an allylimino group, and so on.

Of the groups represented by general formula (V-a) to (V-p), those represented by general formulae (V-a), (V-b), (V-i), (V-j), (V-k) and (V-l) are preferred over others, and those represented by (V-a), (V-i), (V-j) and (V-k) are particularly favorable.

Specific examples of the groups represented by B in general formula (IV) are illustrated below.

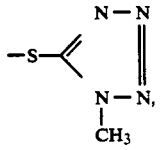

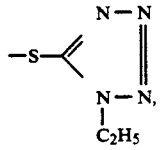

-continued

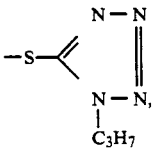

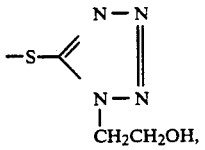

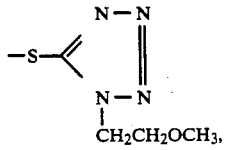

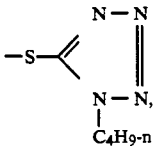

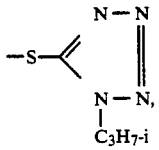

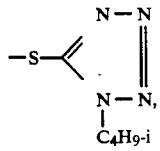

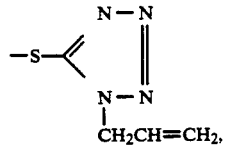

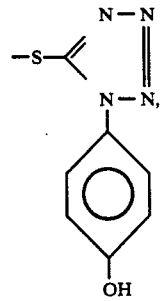

-continued
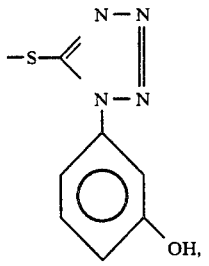
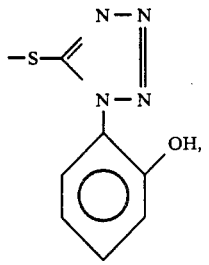
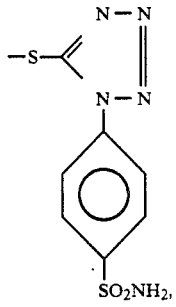
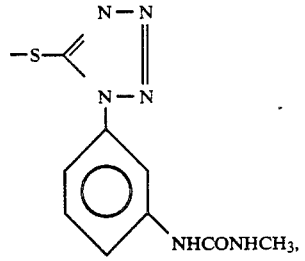
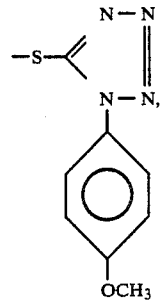
-continued
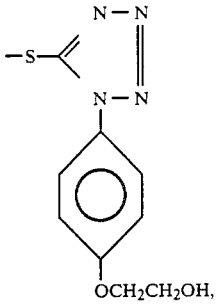
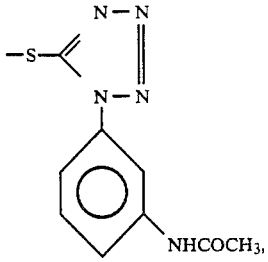
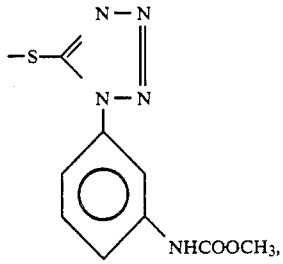
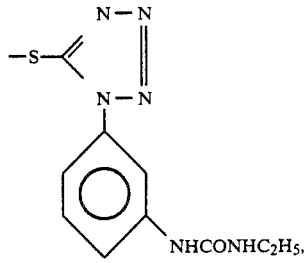
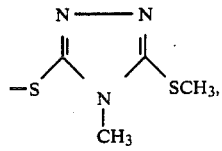
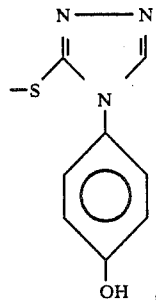

-continued
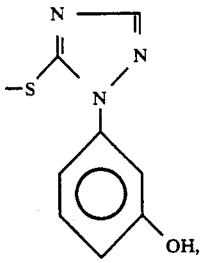
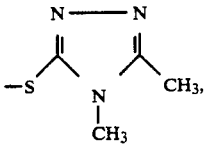
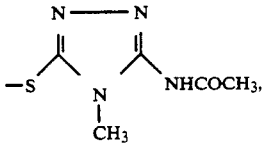
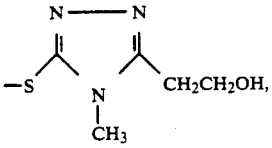
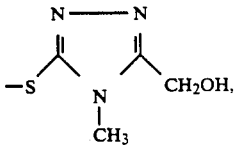
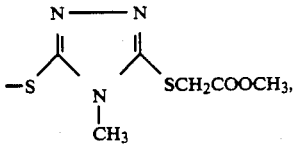
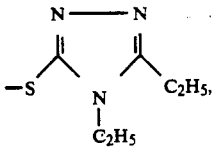
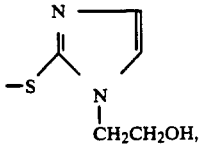
-continued
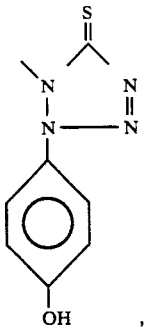
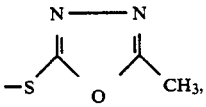
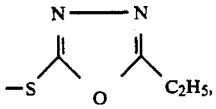
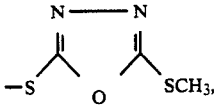
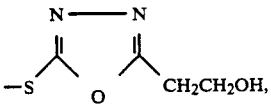
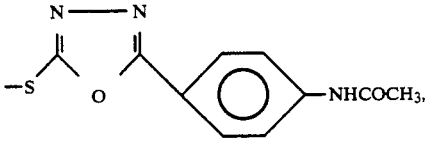
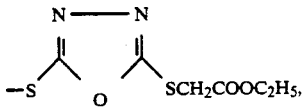
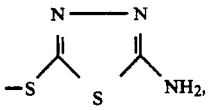
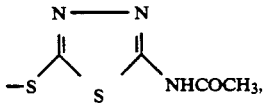
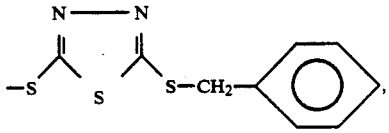
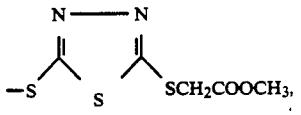

-continued
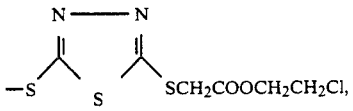
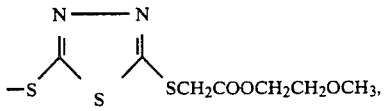
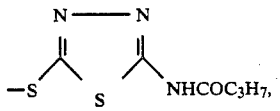
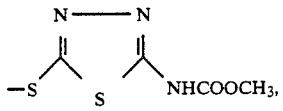
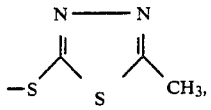
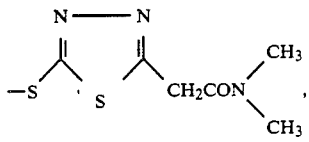
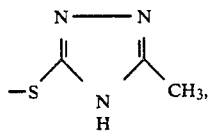
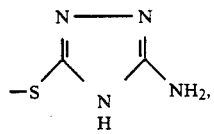
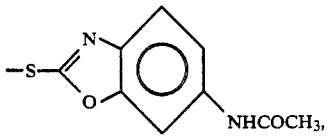
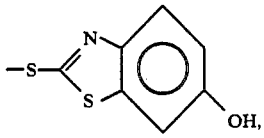
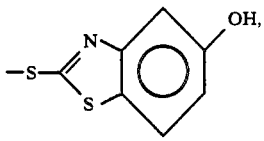
-continued
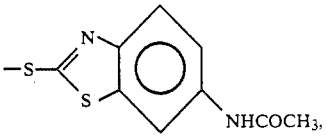
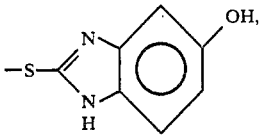
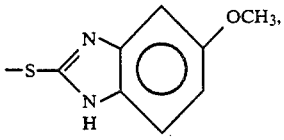
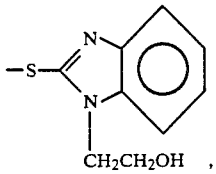
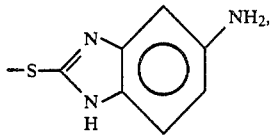
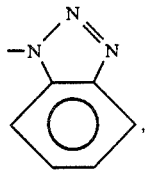
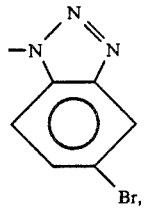
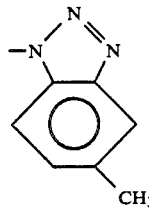
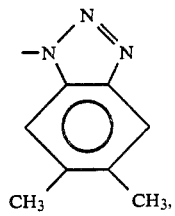

-continued

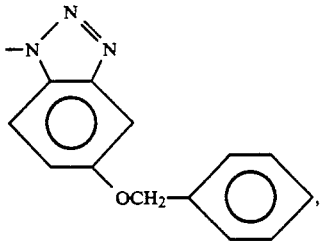

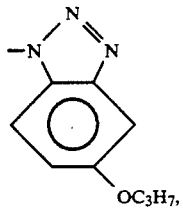

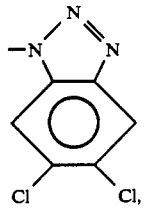

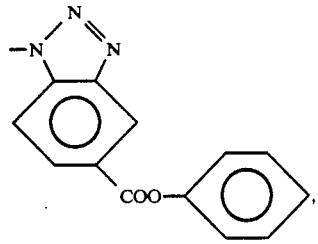

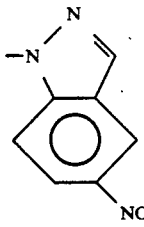

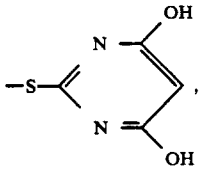

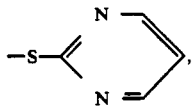

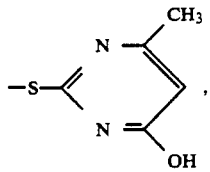

-continued

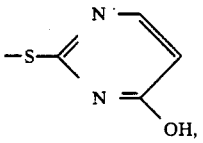

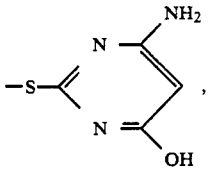

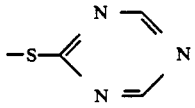

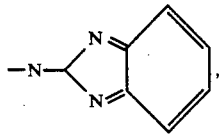

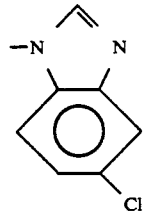

In general, DIR compounds of general formula (IV) are used in the present invention in the form of a mixture with a main coupler. The proportion of the DIR compound of general formula (IV) to the main coupler ranges from 0.1 mol % to 100 mol %, preferably from 1 mol % to 50 mol %. The amount of the DIR compound of formula (IV) used is from 0.01 mol % to 20 mol %, preferably from 0.5 mol % to 10 mol %, of silver halide present in the same layer or the adjacent layer.

The present invention can fully achieve its effect when coupler residues represented by the following general formulae (Cp-1), (Cp-2), (Cp-3), (Cp-4), (Cp-5), (Cp-6), (Cp-7), (Cp-8), (Cp-9), (Cp-10) and (Cp-11) are employed as A in general formula (IV). These DIR compounds are preferred because of their high coupling speeds.

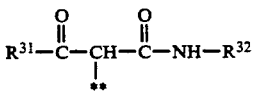

(Cp-1)

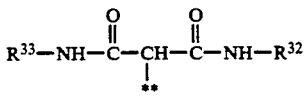

(Cp-2)

-continued (Cp-3)

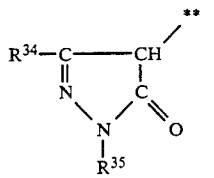

(Cp-4)

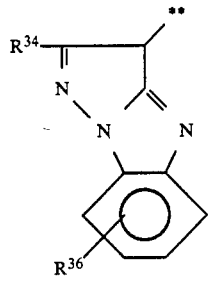

(Cp-5)

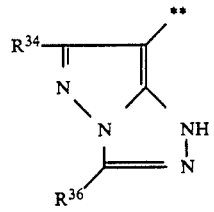

(Cp-6)

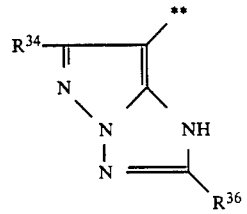

(Cp-7)

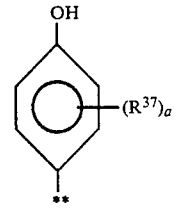

(Cp-8)

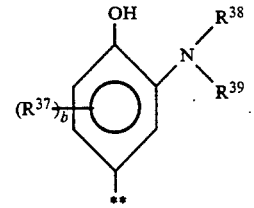

(Cp-9)

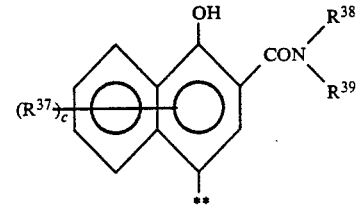

-continued (Cp-10)

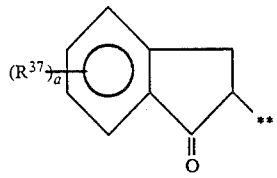

(Cp-11)

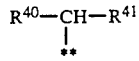

In the foregoing formulae, ** represents the bonding position of a coupling eliminable group (-(TIME)$_n$-B). When $R^{31}$, $R^{32}$, $R^{33}$, $R^{34}$, $R^{35}$, $R^{36}$, $R^{37}$, $R^{38}$, $R^{39}$, $R^{40}$ or $R^{41}$ is a nondiffusible group, the carbon number thereof is 8 to 32, preferably 10 to 22, while when it is not a nondiffusible group the carbon number thereof is preferably 15 or less.

In general formulae (Cp-1) and (Cp-2), $R^{31}$ represents an aliphatic, aromatic, aliphatic oxy or heterocyclic group, and $R^{32}$ and $R^{33}$ each represents an aromatic or heterocyclic group.

An aliphatic group represented by $R^{31}$ contains preferably 1 to 22 carbon atoms, may be substituted or not, and may take a straight or branched chain form. Substituent groups suitable for the aliphatic group (particularly for the alkyl group) include an alkoxy group, an aryloxy group, an amino group, an acylamino group, a halogen atom, and so on. These substituent groups may further have a substituent group. Specific examples of useful aliphatic groups as $R^{31}$ include an isopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(benzenesulfonamido)isopropyl group, α-(phthalimido) isopryl group, and so on.

When $R^{31}$, $R^{32}$ or $R^{33}$ represent an aromatic group (particularly a phenyl group), the aromatic group may be substituted. Specifically, such an aromatic group, e.g., a phenyl group, may be substituted, e.g., by a 1-32 C alkyl, alkenyl, alkoxy, alkoxycarbonyl, alkoxycarbonylamino, aliphatic amido, alkylsulfamoyl, alkylsulfonamido, alkylureido or alkyl-substituted succinimido group. An alkyl moiety of the above-described groups each may contain a divalent aromatic group like a phenylene group in its carbon chain. The phenyl group may also be substituted with an aryloxy group, an aryloxycarbonyl group, an arylcarbomovl group, an arylamido group, an arylsulfamoyl group, an arylsulfonamido group, an arylureido group or the like. An aryl moiety of these substituent groups each may further be substituted by at least one alkyl group containing 1 to 22 carbon atoms in total.

The phenyl group represented by $R^{31}$, $R^{32}$, or $R^{33}$ may furthermore be substituted by an amino group (including those substituted by a 1-6 C lower alkyl group), a hydroxy group, a carboxy group, a sulfo group, a nitro group, a cyano group, a thiocyano group, or a halogen atom.

Moreover, the substituent represented by $R^{31}$, $R^{32}$ or $R^{33}$ may be a group formed by fusing a phenyl group with another ring to form, e.g., a naphthyl group, a quinolyl group, an isoqluinolyl group, a chromanyl group, a coumaranyl group, or a tetrahydronaphthyl group. These substituent groups each may further have a substituent group.

When $R^{31}$ represents an aliphatic oxy group, an aliphatic moiety thereof may be a 1–32 C, preferably 1–22 C, straight- or branched-chain alkyl, alkenyl, cycloalkyl or cycloalkenyl group, and may be substituted by a halogen atom, an aryl group, an alkoxy group, or so on.

When $R^{31}$ or $R^{33}$, and $R^{32}$ represent residues of heterocyclic rings, they are attached to the carbon atom of the carbonyl group of the acyl group or nitrogen atom of the amido group in the α-acylacetamido moiety, respectively, via one of the carbon atoms which constitutes their respective rings. Specific examples of such heterocyclic rings include thiophene, furan, pyran, pyrrole, pyrazole, pyridine, pyrazine, pyrimidine, pyridazine, indolizine, imidazole, thiazole, oxazole, triazine, thiadiazine, oxazine and so on. These rings each may have a substituent group on the ring.

In general formula (Cp-3), $R^{35}$ represents a 1–32 C, preferably 1–22 C, straight- or branched-chain alkyl (e.g., methyl, isopropyl, tert-butyl, hexyl, dodecyl, etc.), alkenyl (e.g., allyl, etc.), cycloalkyl (e.g., cyclopentyl, cyclohexyl, norbornyl, etc.), aralkyl (e.g., benzyl, β-phenylethyl, etc.) or cycloalkenyl (e.g., cyclopentenyl, cyclohexenyl, etc.) group. These groups each may be substituted by a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, an ureido group, an urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxyl group, an mercapto group, or so on.

In addition, $R^{35}$ may represent an aryl group (e.g., a phenyl group, α- or β-naphthyl group, etc.). Such an aryl group may have one or more of a substituent group, e.g., an alkyl group, an alkenyl group, a cycloalkyl group, an aralkyl group, a cycloalkenyl group, a halogen atom, nitro group, cyano group, an aryl group, an alkoxy group, an aryloxy group, carboxyl group, an alkoxycarbonyl group, an aryloxycarbonyl group, sulfo group, a sulfamoyl group, a carbamoyl group, an acylamino group, a diacylamino group, an ureido group, an urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, hydroxy group, or so on.

Further, $R^{35}$ may represent a heterocyclic group (e.g., a residue of a 5- or 6-membered hetero ring or a condensed hetero ring, which contains nitrogen, oxygen, sulfur or/and other atoms, with specific examples including a pyridyl group, a quinolyl group, a furyl group, a benzothiazolyl group, an oxazolyl group, an imidazolyl group, a naphthoxazolyl group, and so on), a heterocyclic group substituted by one of the groups cited above as examples of substituent groups regarding the above-described aryl group, or a heterocyclic group substituted by an aliphatic or aromatic acyl group, an alkylsulfonyl group, an arylsulfonyl group, an alkylcarbamoyl group, an arylcarbamoyl group, an alkylthiocarbamoyl group or an arylthiocarbamoyl group.

In general formulae (Cp-3) to (Cp-6), $R^{34}$ represents a 1–32 C, preferably 1–22 C, straight- or branched-chain alkyl, alkenyl, cycloalkyl, aralkyl or cycloalkenyl group (which each may have such a substituent group such as cited in the foregoing description for $R^{35}$), an aryl or heterocyclic group (which each may have a substitutent group such as cited in the foregoing description for $R^{35}$), an alkoxycarbonyl group (e.g., methoxycarbonyl, ethoxycarbonyl, stearyloxycarbonyl, etc.), an aryloxycarbonyl group (e.g., phenoxycarbonyl, naphthoxycarbonyl, etc.), an aralkyloxycarbonyl group (e.g., benzyloxycarbonyl, etc.), an alkoxy group (e.g., methoxy, ethoxy, heptadecyloxy, etc.), an aryloxy group (e.g., phenoxy, tolyloxy, etc.), an alkylthio group (e.g., ethylthio, dodecylthio, etc.), an arylthio group (e.g., phenylthio, α-naphthylthio, etc.), a carboxy group, an acylamino group (e.g., acetylamino, 3-[(2,4-di-tert-aminophenoxy)acetamido]benzamido, etc.), a diacylamino group, an N-alkylacylamino group (e.g., N-methylpropionamido, etc.), an N-arylacylamino group (e.g., N-phenylacetamido, etc.), an ureido group (e.g., ureido group, an N-arylureido group, an N-alkylureido group, etc.), an urethane group, a thiourethane group, an arylamino group (e.g., phenylamino, N-methylanilino, diphenylamino, N-acetylanilino, 2-chloro-5-tetradecanamidoanilino, etc.), an alkylamino group (e.g., n-butylamino, methylamino, cyclohexylamino, etc.), a cycloamino group (e.g., piperidino, pyrrolidino, etc.), a heterocyclylamino group (e.g., 4-pyridylamino, 2-benzoxazolylamino, etc.), an alkylcarbonyl group (e.g., methylcarbonyl, etc.), an arylcarbonyl group (e.g., phenylcarbonyl, etc.), a sulfonamido group (e.g., an alkylsulfonamido group, an arylsulfonamido group, etc.), a carbamoyl group (e.g., ethylcarbamoyl, dimethylcarbamoyl, N-methyl-phenylcarbamoyl, N-phenylcarbamoyl, etc.), a sulfamoyl group (e.g., an N-alkylsulfamoyl group, an N,N-dialkylsulfamoyl group, an N-arylsulfamoyl group, an N-alkyl-N-arylsulfamoyl group, an N,N-diarylsulfamoyl group, etc.), a cyano group, a hydroxy group, or a sulfo group.

In general formulae (Cp-4) to (Cp-6), $R^{36}$ represents a hydrogen atom, or a 1–32 C, preferably 1–22 C, straight- or branched-chain alkyl, alkenyl, cycloalkyl, aralkyl or cycloalkenyl group. These groups each may have such a substituent group such as set forth in the foregoing description for $R^{35}$.

Further, $R^{36}$ may represent an aryl group, or a heterocyclic group. These groups each may also have a substituent group such as set forth in the foregoing description for $R^{35}$.

Furthermore, $R^{36}$ may represent a cyano group, an alkoxy group, an aryloxy group, a halogen atom, a carboxy group, an alkoxycarbonyl group, an aryloxycarbonyl group, an acyloxy group, a sulfo group, a sulfamoyl group, a carbamoyl group, an acylamino group, a diacylamino group, an ureido group, an urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, or a hydroxy group.

In general formulae (Cp-7) to (Cp-10), $R^{37}$, $R^{38}$ and $R^{39}$ each represents a group which can be used in conventional four-equivalent type phenol or α-naphthol couplers. Specifically, $R^{37}$ represents a hydrogen atom, a halogen atom, an alkoxycarbonylamino group, an aliphatic hydrocarbon residue, an N-arylureido group, an acylamino group, —O—$R^{42}$, or —S—$R^{42}$ (wherein $R^{42}$ represents an aliphatic hydrocarbon residue). When two or more $R^{37}$'s are present in a molecule, they may be the same or different. The aliphatic hydrocarbon residue may have a substituent group such as set forth in the foregoing description for $R^{35}$. When the above-cited groups contain an aryl moiety, the aryl moiety may have a substituent group such as set forth in the foregoing description for $R^{35}$.

Groups represented by $R^{38}$ and $R^{39}$ can be those selected from among aliphatic hydrocarbon residues, aryl groups and hetero ring residues. On the other hand, either of them may be a hydrogen atom. The above-described groups each may have a substituent group. Further, $R^{38}$ and $R^{39}$ may combine with each other to form a nitrogen-containing heterocyclic nucleus.

Aliphatic hydrocarbon residues which can be represented by $R^{38}$ and $R^{39}$ may be saturated or not, and may take a straight chain, branched chain or cyclic form. Preferred examples thereof include alkyl groups (such as methyl, ethyl, propyl, isopropyl, butyl, t-butyl, isobutyl, dodecyl, octadecyl, cyclobutyl, cyclohexyl, etc.), and alkenyl groups (e.g., allyl, octenyl, etc.).

Typical examples of aryl groups which can be represented by $R^{38}$ and $R^{39}$ include phenyl groups, naphthyl groups, and so on, and those of hetero ring residues include pyridinyl groups, quinolyl groups, thienyl groups, piperidyl groups, imidazolyl groups and so on. As examples of substituent groups which can be introduced into the above-described aliphatic hydrocarbon residues, aryl groups and hetero ring residues, mention may be made of halogen atoms, nitro groups, hydroxy groups, carboxyl groups, amino groups, substituted amino groups, sulfo groups, alkyl groups, alkenyl groups, aryl groups, heterocyclic groups, alkoxy groups, aryloxy groups, arylthio groups, arylazo groups, acylamino groups, carbamoyl groups, ester groups, acyl groups, acyloxy groups, sulfonamido groups, sulfamoyl groups, sulfonyl groups, morpholino groups, and so on.

a represents an integer of 1 to 4, b an integer of 1 to 3, and c an integer of 1 to 5.

In general formula (Cp-11), $R^{40}$ represents an arylcarbonyl group, a 2–32 C, preferably 2–22 C, alkanoyl group, an arylcarbamoyl group, a 2–32 C, preferably 2–22 C, alkanecarbamoyl group, a 1–32 C, preferably 1–22 C, alkoxycarbonyl group, or an aryloxycarbonyl group. These groups each may have a substituent group. Suitable examples of such substituent groups include alkoxy groups, alkoxycarbonyl groups, acylamino groups, alkylsulfamoyl groups, alkylsulfonamido groups, alkylsuccinimido groups, halogen atoms, nitro group, carboxyl group, nitrile group, alkyl groups, aryl groups and so on.

$R^{41}$ represents an arylcarbonyl group, a 2–32 C, preferably 2–22 C, alkanoyl group, an arylcarbamoyl group, a 2–32 C, preferably 2–22 C, alkanecarbamoyl group, a 1–32 C, preferably 1–22 C, alkoxycarbonyl group, an aryloxycarbonyl group, a 1–32 C, preferably 1–22 C, alkylsulfonyl group, an arylsulfonyl group, an aryl group, or a 5- or 6-membered heterocyclic group (containing, as a hetero atom, a nitrogen atom, an oxygen atom or/and a sulfur atom, with specific examples including a triazolyl group, an imidazolyl group, a phthalimido group, a succinimido group, a furyl group, a pyridyl group, a benzotriazolyl group, etc.). These groups each may have a substituent group such as described above for $R^{40}$.

Of the above-described coupler residues, preferred yellow couplers are those containing a t-butyl group or a substituted or unsubstituted aryl group as $R^{31}$ and a substituted or unsubstituted aryl group as $R^{32}$ in general formula (Cp-1), and those containing substituted or unsubstituted aryl groups as $R^{32}$ and $R^{33}$ in general formula (Cp-2).

Preferred magneta coupler residues are those containing an acylamino group, an ureido group or an arylamino group as $R^{34}$ and a substituted aryl group as $R^{35}$ in general formula (Cp-3), those containing an acylamino group, an ureido group or an arylamino group as $R^{34}$ and a hydrogen atom as $R^{36}$ in general formula (Cp-4), and those containing straight- or branched-chain alkyl or alkenyl groups, cycloalkyl groups, aralkyl groups or cycloalkenyl groups as $R^{34}$ and $R^{36}$ in general formulae (Cp-5) and (Cp-6).

Preferred cyan coupler residues are those represented by general formula (Cp-7) in which $R^{37}$ is an acylamino or ureido group located at the 2-position, an acylamino or alkyl group located at the 5-position, and a hydrogen or chlorine atom located at the 6-position, those represented by general formula (Cp-8) in which two $R^{37}$ groups are located at the 6-position and represents a hydrogen atom and at the 5-position and represents an acylamino group, $R^{38}$ represents an acyl group or a carbomoyl group, and $R^{39}$ represents a hydrogen atom, and those represented by general formula (Cp-9) in which $R^{37}$ is located at the 5-position and represents a hydrogen atom, an acylamino group, a sulfonamido group or an alkoxycaronyl group, $R^{38}$ is a hydrogen atom, and $R^{39}$ is a phenyl group, an alkyl group, an alkenyl group, an cycloalkyl group, an aralkyl group or a cycloalkenyl group.

Preferred colorless coupler residues are those containing an acylamino, sulfonamido or sulfamoyl group as $R^{37}$ in general formula (Cp-10), and those containing alkoxycarbonyl groups as $R^{40}$ and $R^{41}$ in general formula (Cp-11).

These coupler residues may form a polymeric moiety (including a bis moiety) via any part of $R^{31}$ to $R^{41}$, that is, these groups may contain an ethylenic unsaturated group in any part thereof to form homopolymers by themselves, or copolymers together with non-coloring monomers.

When coupler residues of the DIR compounds which can be used in the present invention represent polymer residues, the polymers are intended to include homopolymers having a repeating unit of the following general formula (Cp-13) derived from a monomeric coupler of the following general formula (Cp-12), and copolymers prepared from a monomeric coupler of general formula (Cp-12) and one or more of a non-coloring monomer containing at least one ethylene group which does not have an ability to couple with the oxidation product of an aromatic primary amine developing agent, wherein, two or more kinds of monomeric couplers may be polymerized together.

$$CH_2{=}\overset{\overset{\displaystyle R^{50}}{|}}{C}{-}(A_2)_i{-}(A_3)_j{-}(A_1)_k{-}Q \qquad \text{(Cp-12)}$$

-continued

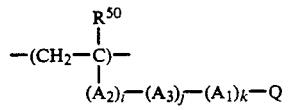

(Cp-13)

In the foregoing formulae, $R^{50}$ represents a hydrogen atom, a 1-4 C lower alkyl group, or a chlorine atom. $A_1$ represents $—CONR^{51}—$, $—NR^{51}CONR^{51}—$, $—NR^{51}COO—$, $—COO—$, $—SO_2—$, $—CO—$, $—NR^{51}CO—$, $—SO_2NR^{51}—$, $—NR^{51}SO_2—$, $—OCO—$, $—OCONR^{51}—$, $—NR^{51}$, or $—O—$. $A_2$ represents $—CONR^{51}—$, or $—COO—$. $R^{51}$ represents a hydrogen atom, an aliphatic group, or an aryl group. When two or more $R^{51}$'s are present in one moiety, they may be the same or different.

$A_3$ represents a 1-10 C unsubstituted or substituted alkylene group, an aralkylene group, or an unsubstituted or substitued arylene group. The alkylene group may be a straight chain or a branched chain alkylene group. As examples of an alkylene group, mention may be made of methylene, methylmethylene, dimethylmethylene, dimethylene, trimethylene, tetramethylene, pentamethylene, hexamethylene, decylmethylene and like groups. As examples of an aralkylene group, mention may be made of benzylidene group, etc. As examples of an arylene group, mention may be made of phenylene, naphthylene and like groups.

Q is one of the coupler residues represented by general formula (Cp-1) to (Cp-11), and attached to $A_1$ in general formula (Cp-12) or (Cp-13) via any part of $R^{31}$ to $R^{41}$ contained therein.

i, j and k each represents 0 or 1, provided that the case where i, j and k are all zero is excluded.

Suitable examples of substituent groups by which an alkylene, aralkylene or arylene group represented by $A_3$ can be substituted include aryl groups (e.g., phenyl), nitro groups, hydroxy groups, cyano groups, sulfo groups, alkoxy groups (e.g., methoxy), aryloxy groups (e.g., phenoxy), acyloxy groups (e.g., acetoxy), acylamino groups (e.g., acetylamino), sulfonamido groups (e.g., methanesulfonamido), sulfamoyl groups (e.g., methylsulfamoyl), halogen atoms (e.g., fluorine, chlorine, bromine, etc.), carboxy groups, carbamoyl groups (e.g., methylcarbamoyl), alkoxycarbonyl groups (e.g., methoxycarbonyl, etc.), and sulfonyl groups (e.g., methylsulfonyl). When the group represented by $A_3$ has two or more substituent groups, they may be the same or different.

Suitable examples of non-coloring ethylenic monomers which cannot undergo the coupling reaction with oxidation products of aromatic primary amine developers include acrylic acid, α-chloroacrylic acid, α-alkylacrylic acid, esters and amides derived from these acrylic acids, methylenebisacrylamide, vinyl esters, acrylonitrile, aromatic vinyl compounds, maleic acid derivatives, vinylpyridines, and so on. Two or more of these non-coloring ethylenic unsaturated monomers can be used together in the copolymerization.

When the DIR compounds represented by general formula (IV) to be used in the present invention are combined with methods of thinning a photographic layer, they can exert a particularly great effect on improvement in sharpness. An example of a method of thinning a photographic layer employes the reduction in the content of silver due to the use of two-equivalent couplers. Another example employs the reduction of the addition amount of a coupler due to the use of a bis type coupler or a polymeric coupler, because the quantity of color produced from the coupler per unit weight is increased by the use of such couplers. Still another example employs the reduction of the addition amount of a coupler due to the use of a coupler capable of producing an image-forming dye at high efficiency with only a slight side-reaction in the color-producing reaction of the coupler (e.g., a two-equivalent magenta coupler). These methods are already known for reducing the thickness of an emulsion layer with the object of improving sharpness. The sharpness attained when the DIR compounds of general formula (IV) are used particularly in combination with the above-described methods is predominantly high, compared with the sharpness obtained by using other known DIR couplers. The couplers exemplified above are used in the layers containing the DIR compounds of general formula (IV) or the upper layers thereof (the layers located farther away from the support). In a preferred embodiment, a color photographic light-sensitive material contains at least one two-equivalent yellow coupler in a blue-sensitive emulsion layer, at least one two-equivalent magenta coupler or polymeric magenta coupler (of the two-equivalent type or four-equivalent type) in a green-sensitive emulsion layer, and further contains the DIR compounds of general formula (IV) in at least one constituent layer of the green-sensitive emulsion layer and at least one constituent layer of the red-sensitive emulsion layer, respectively. In the blue-sensitive emulsion layer, the DIR compounds of general formula (IV) may or may not be contained.

Specific examples of the DIR compounds of general formula (IV) are illustrated below. However, the invention should not be construed as being limited to the following examples.

(IV-1)
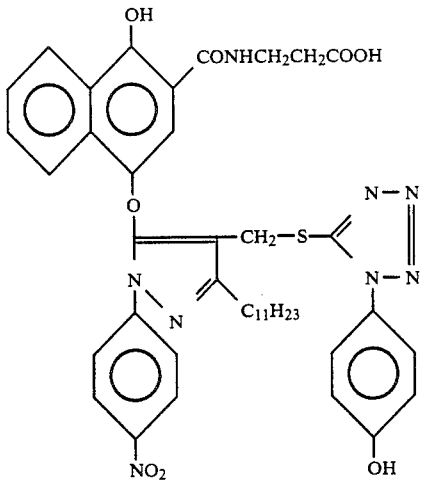
(IV-2)
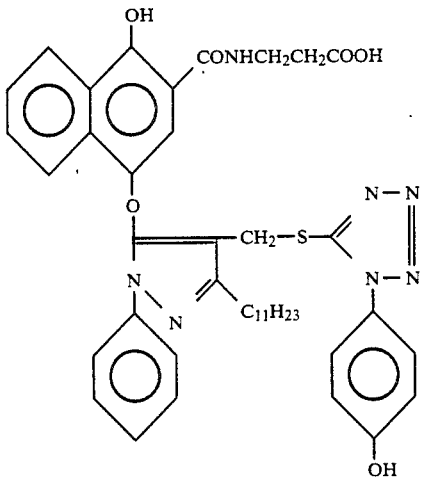
(IV-3)
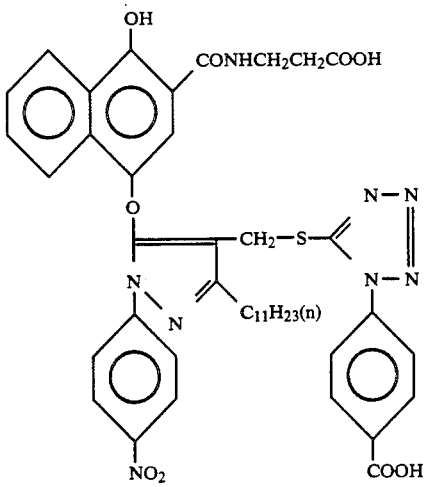

-continued
(IV-4)
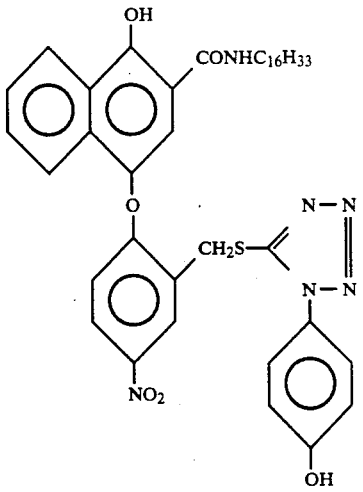
(IV-5)
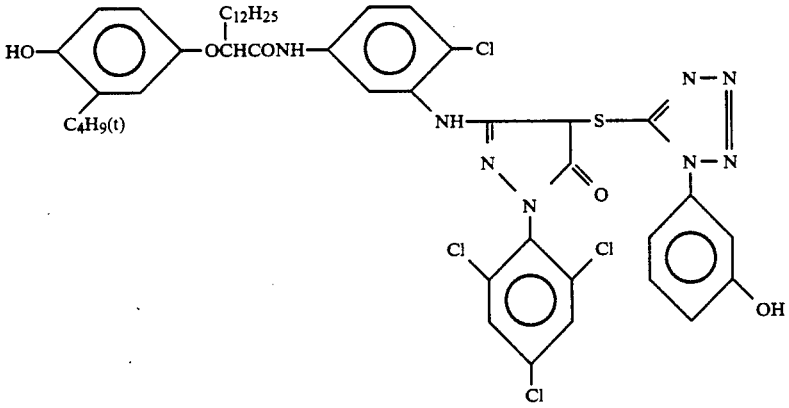
(IV-6)
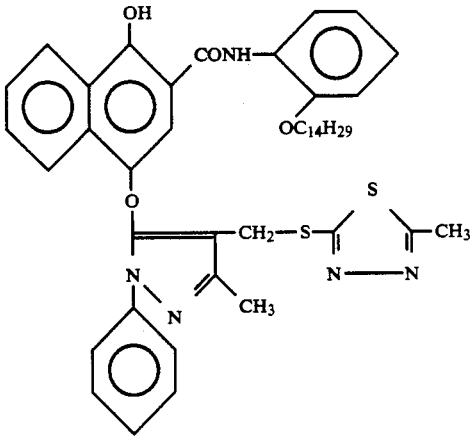

-continued
(IV-7)
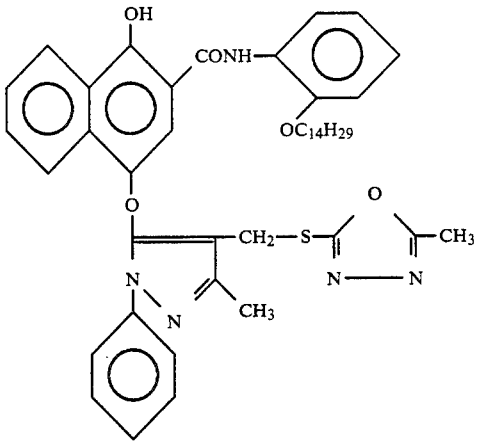
(IV-8)
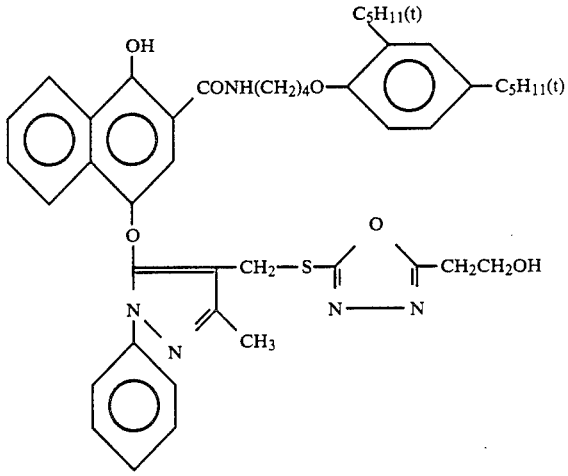
(IV-9)
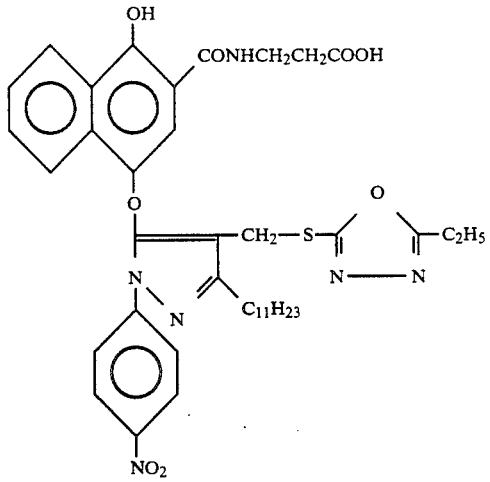
(IV-10)
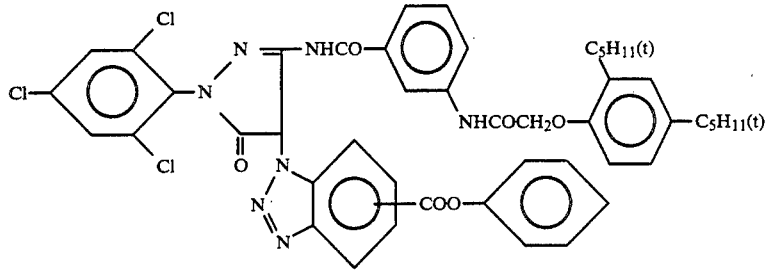

-continued
(IV-11)
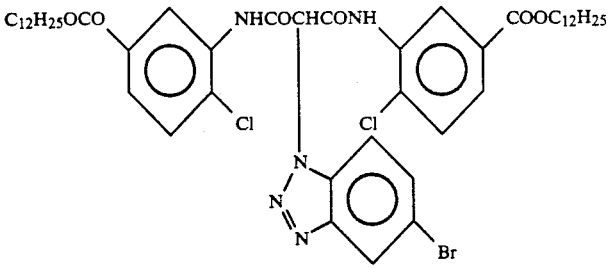
(IV-12)
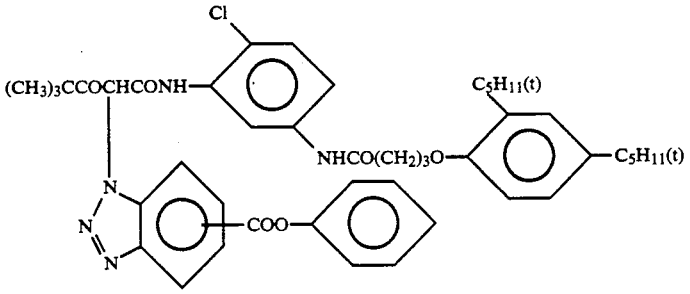
(IV-13)
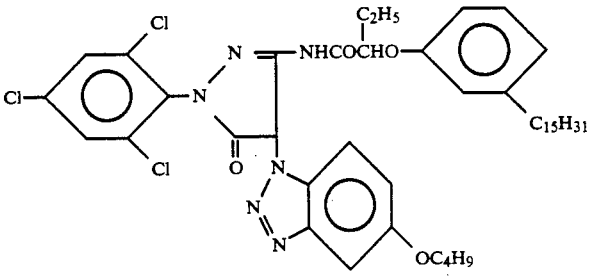
(IV-14)
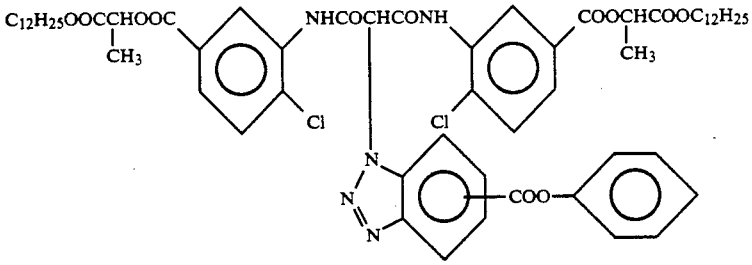
(IV-15)
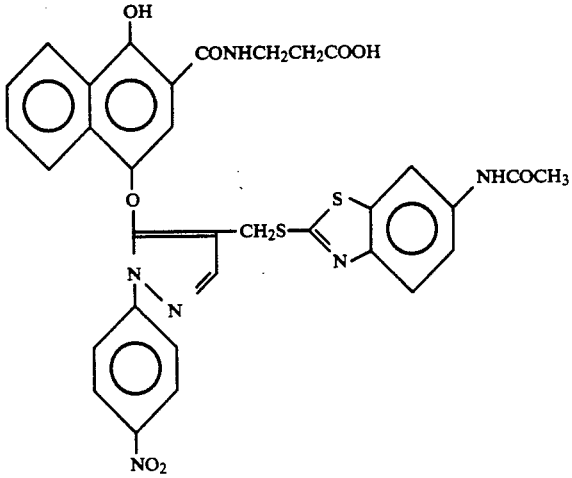

-continued
(IV-16)
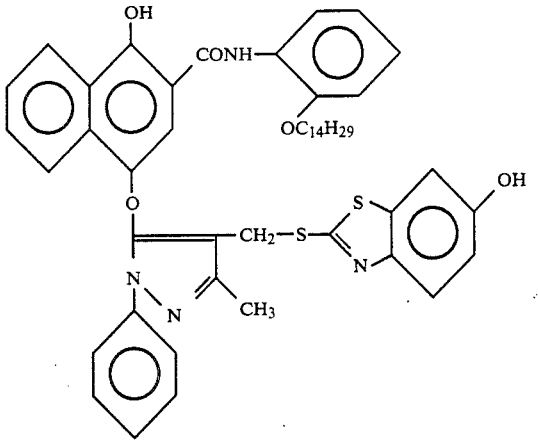
(IV-17)
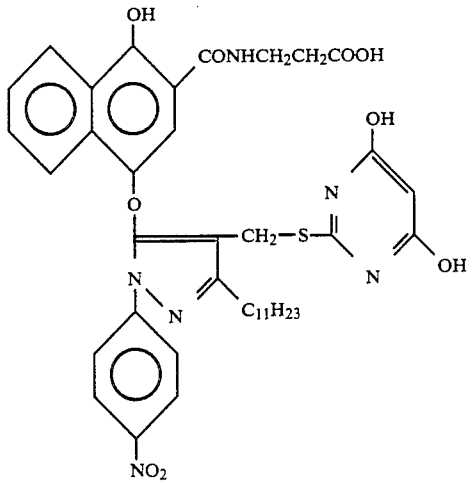
(IV-18)
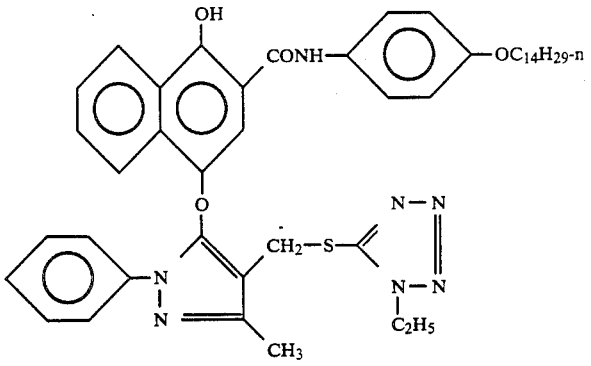
(IV-19)
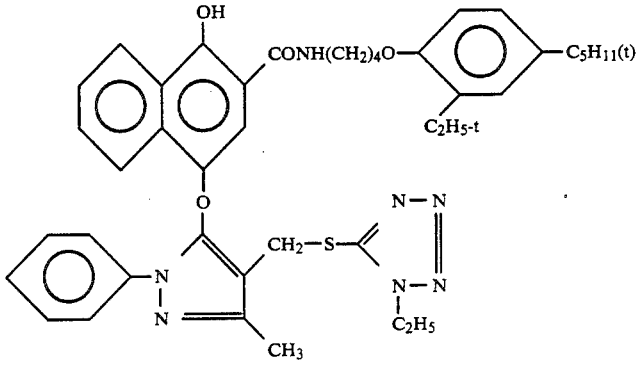

-continued
(IV-20)
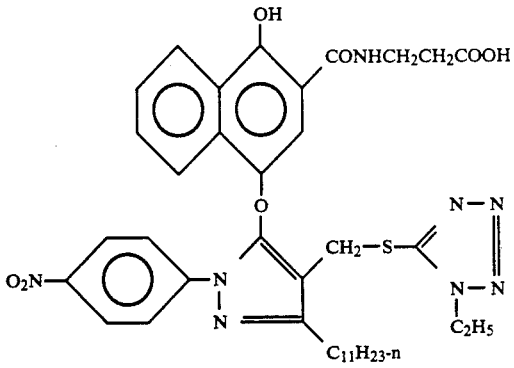
(IV-21)
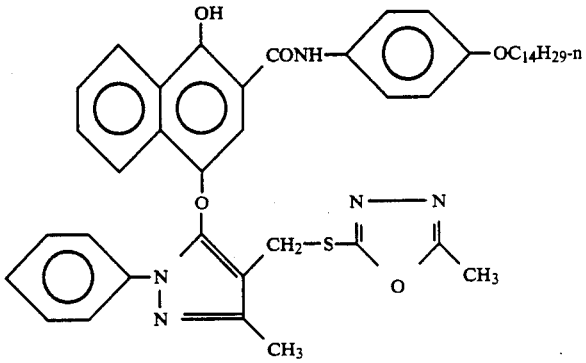
(IV-22)
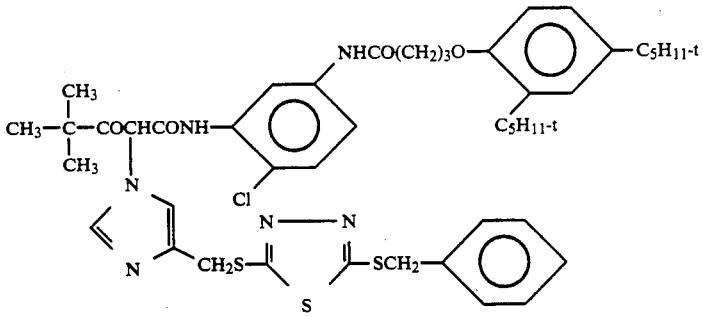
(IV-23)
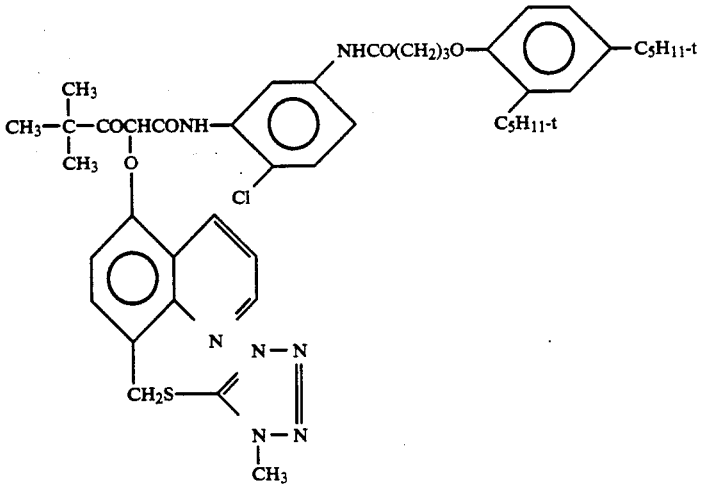

-continued
(IV-24)
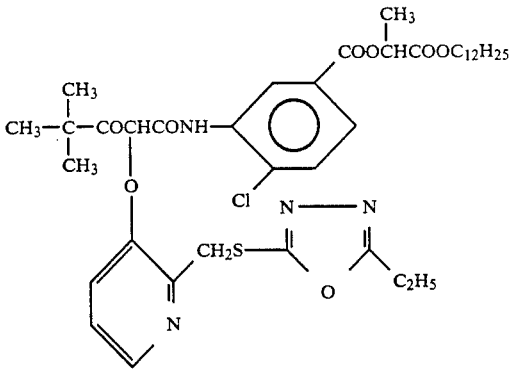
(IV-25)
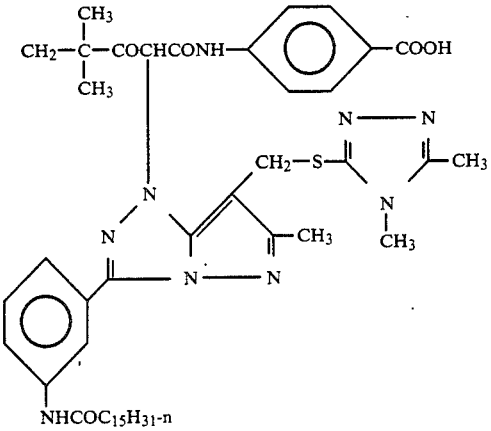
(IV-26)
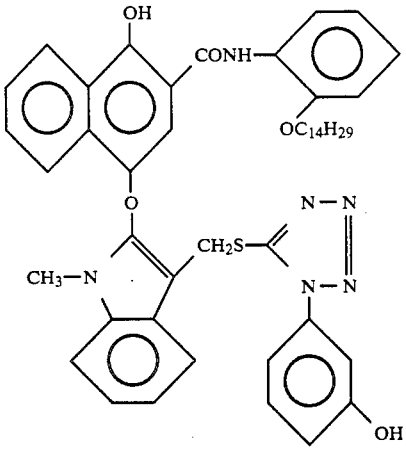
(IV-27)
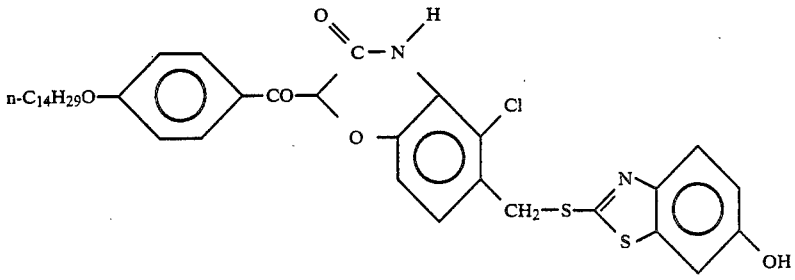

-continued
(IV-28)
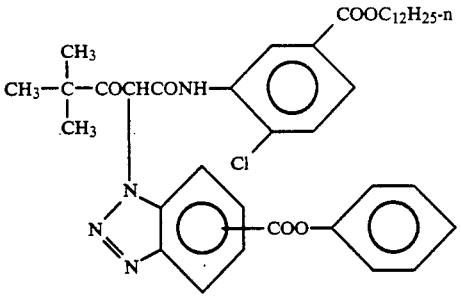
(IV-29)
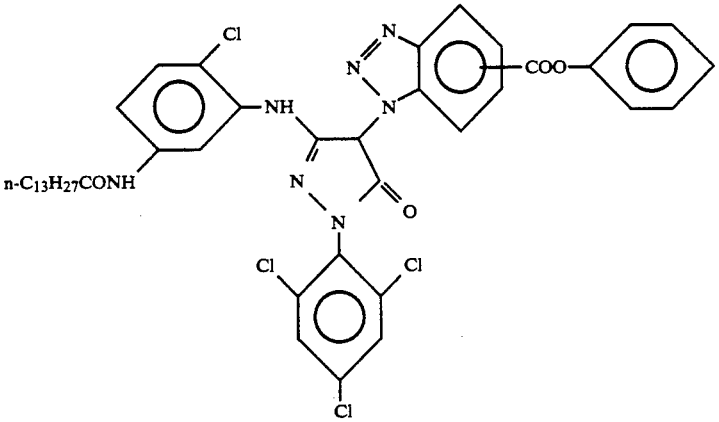
(IV-30)
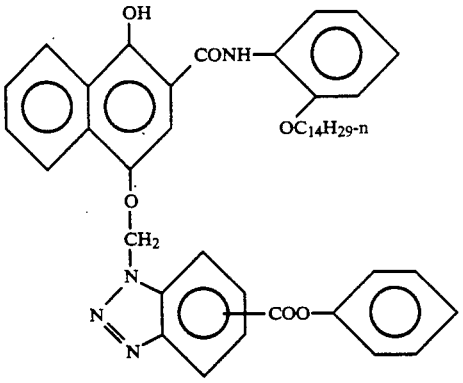
(IV-31)
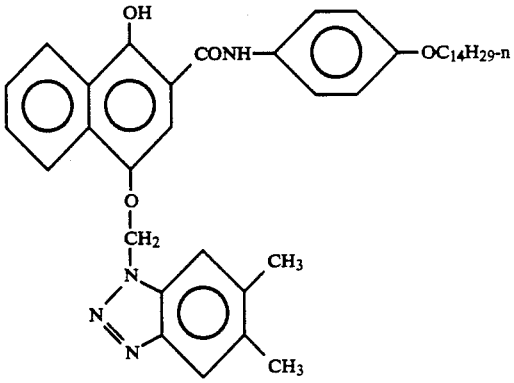

-continued
(IV-32)
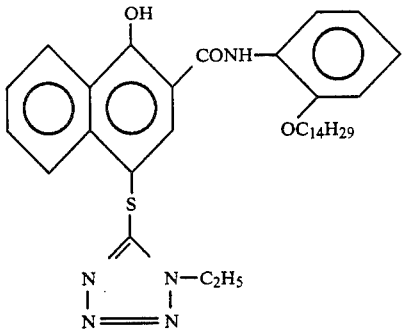
(IV-33)
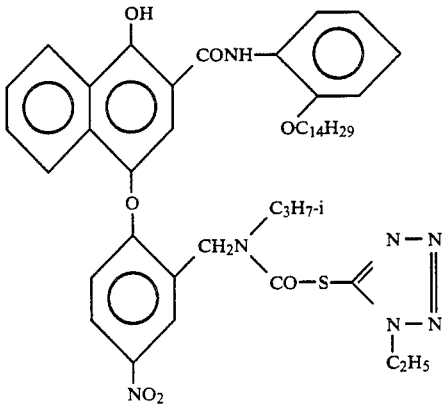
(IV-34)
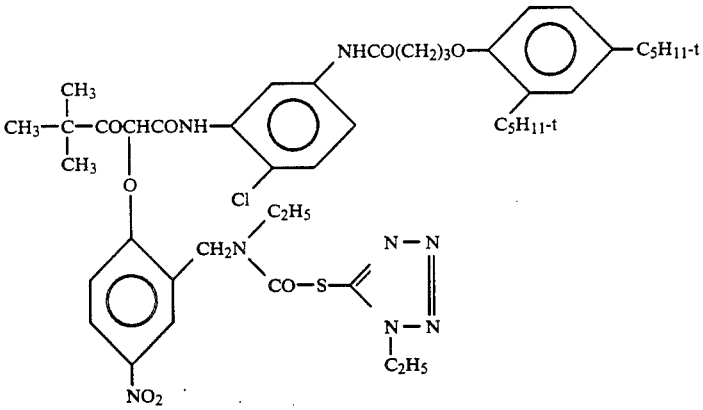
(IV-35)
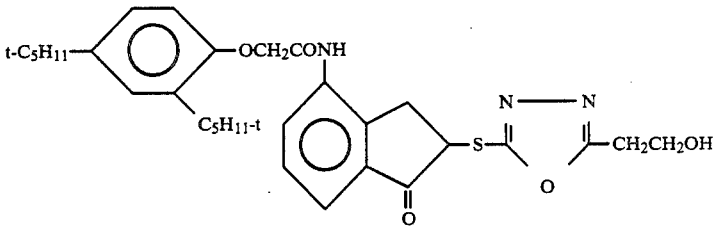

-continued
(IV-36)
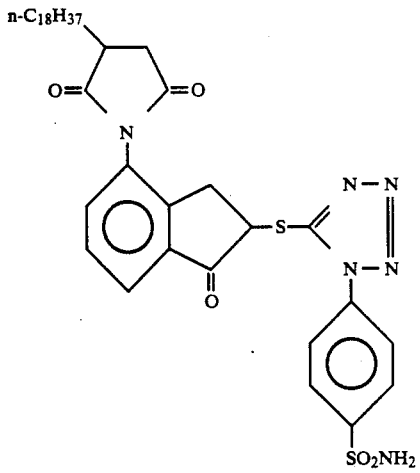
(IV-37)
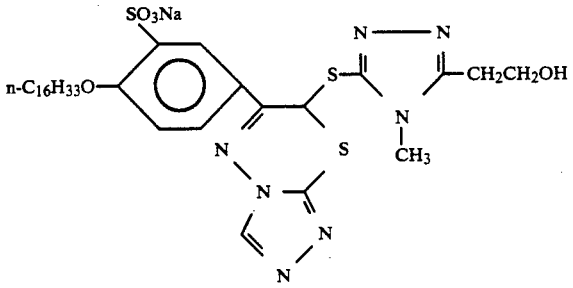
(IV-38)
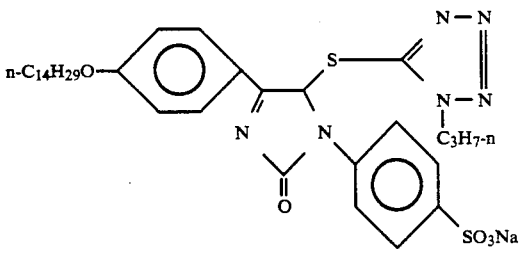
(IV-39)
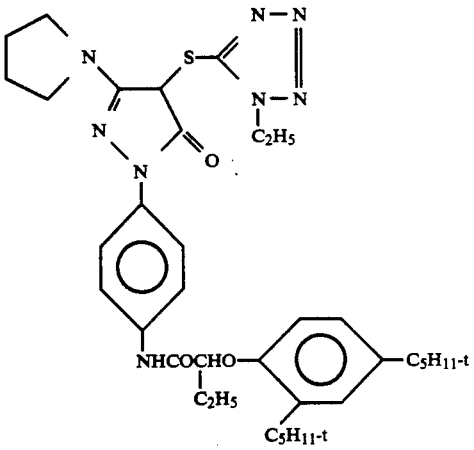

-continued (IV-40)

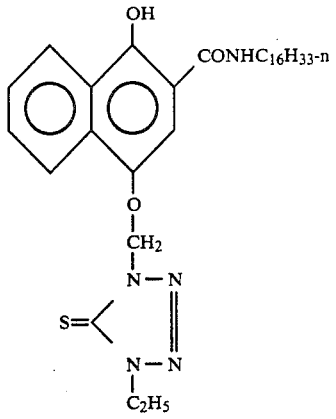

(IV-41)

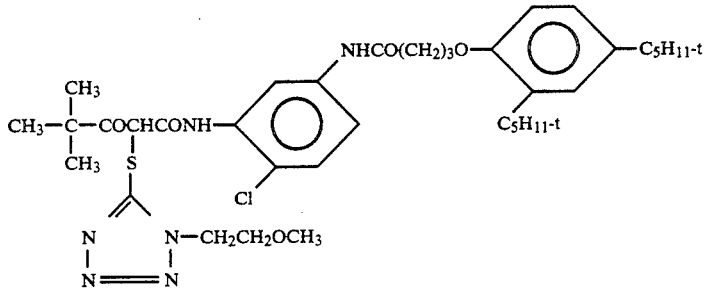

These DIR compounds can be syntehsized using the methods described in U.S. Pat. Nos. 4,174,966, 4,183,752, 4,421,845 and 4,477,563, Japanese Patent Application (OPI) Nos. 145135/79, 151944/82, 154234/82, 188035/82, 98728/83, 162949/83, 209736/83, 209737/83, 209738/83 and 209740/83, and so on.

It is possible in the present invention to increase a photographic speed by using a compound capable of forming a development accelerator or a fogging agent (called a FR compound hereinafter) in proportion to the progress of silver development. Such FR compounds can be synthesized with ease using the methods described in U.S. Pat. Nos. 4,390,618, 4,518,682, 4,526,863 and 4,482,629, Japanese Patent Application (OPI) Nos. 157638/84, 170840/84, 185950/85 and 107029/85, and so on.

Two or more of FR compounds may be used together. Such an FR compound is added in an amount of $10^{-10}$ to 0.2 mole, preferably $10^{-7}$ to 0.02 mole, per mole of silver contained in the same layer or an adjacent layer thereof. An FR compound alone or together with a color image-forming coupler is introduced into a silver halide emulsion layer using an oil-in-water dispersion method known as an oil protecting method, whereby the desired end can be achieved.

Typical examples of FR compounds are illustrated below.

FR-1

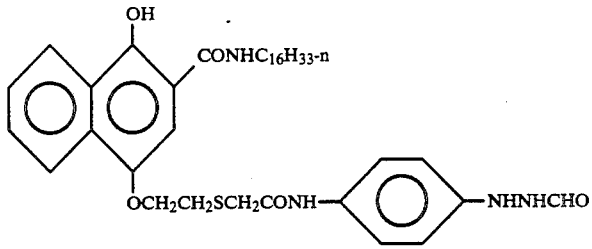

-continued
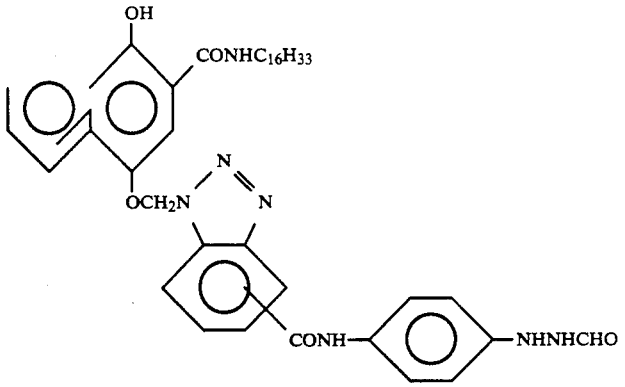
FR-2
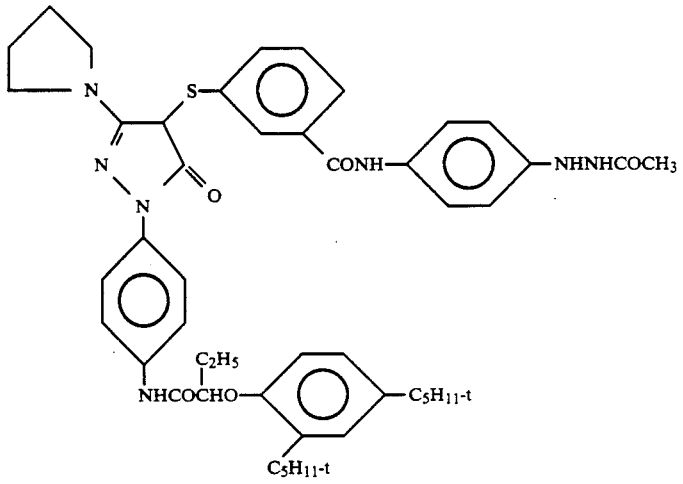
FR-3
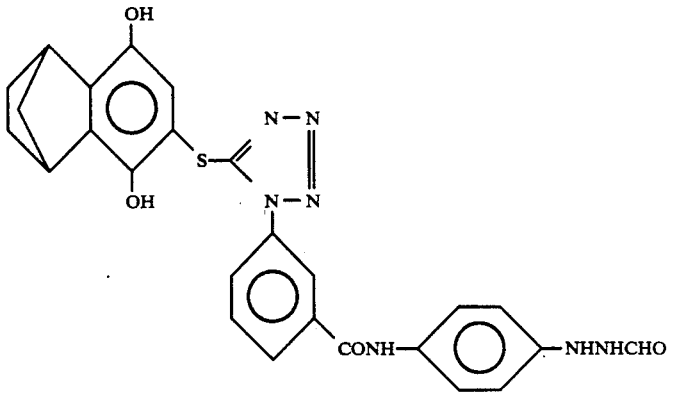
FR-4

-continued
FR-5
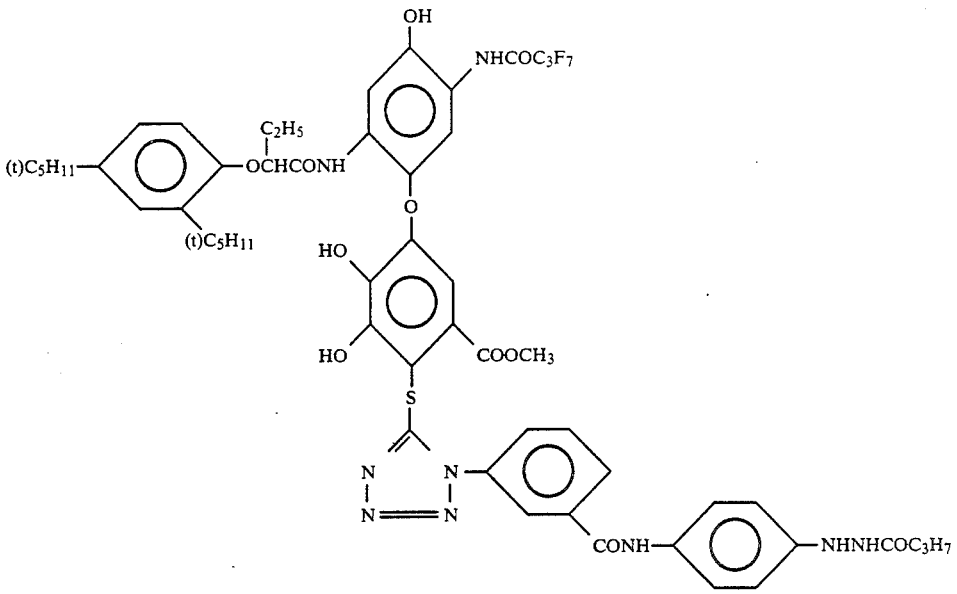
FR-6
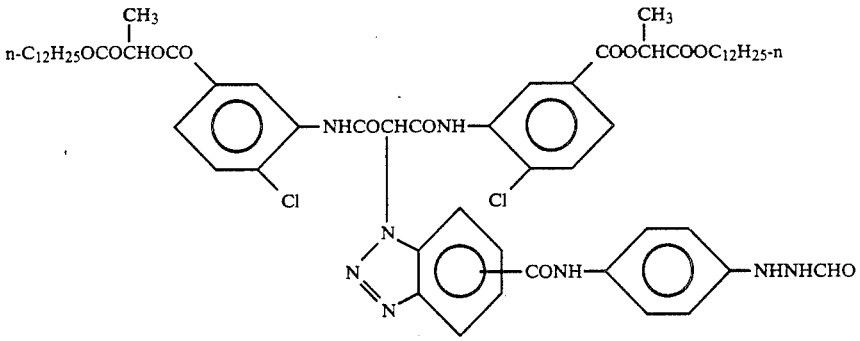
FR-7
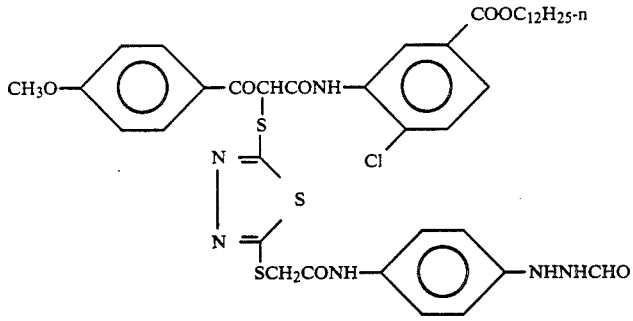
FR-8
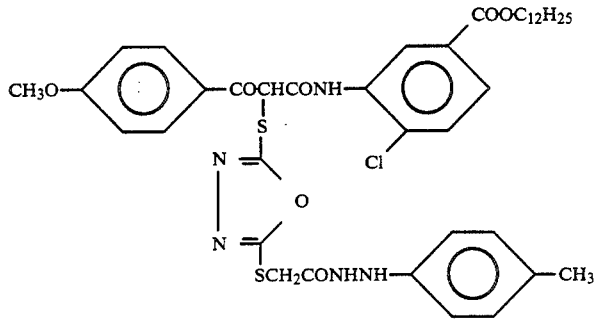

-continued
FR-9
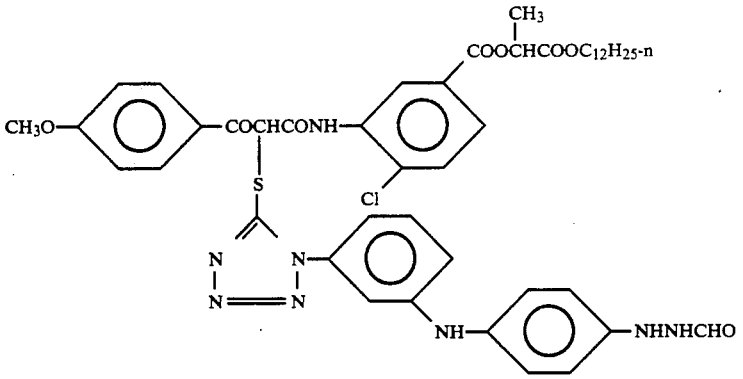
FR-10
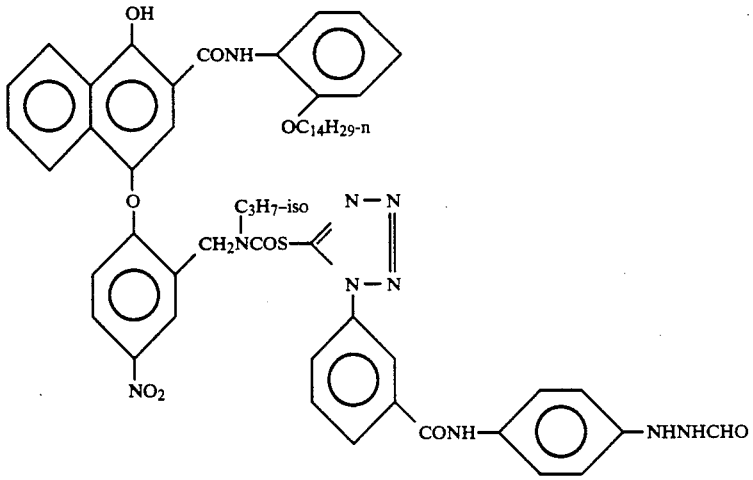
FR-11
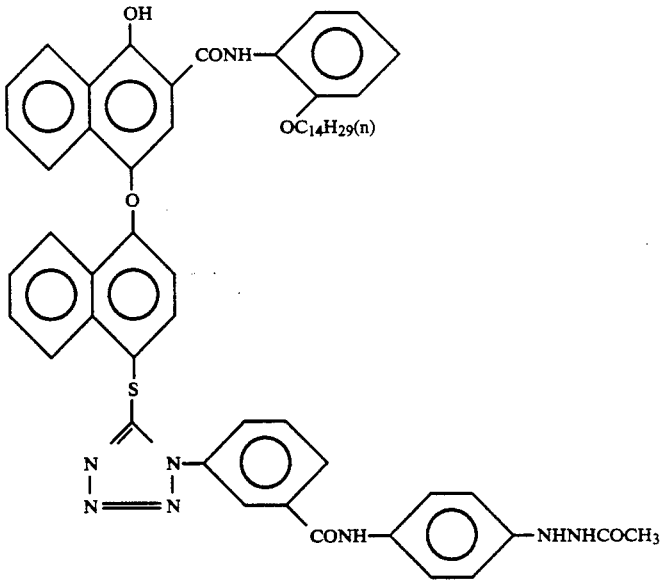

-continued
FR-12
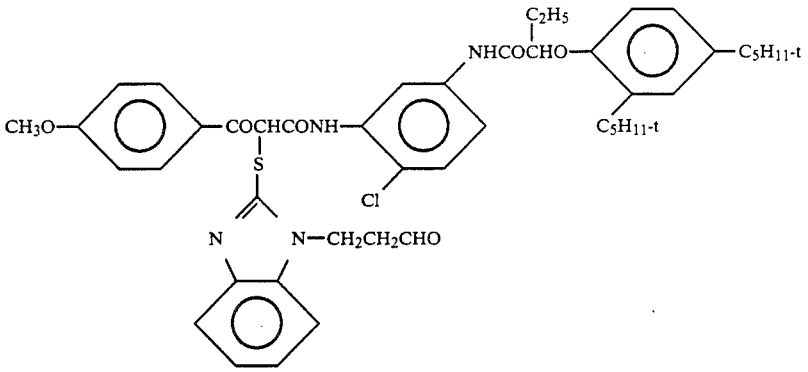
FR-13
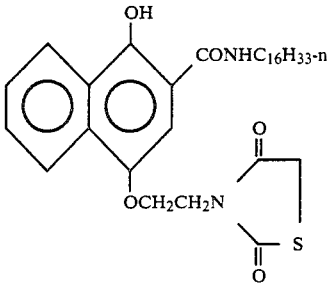
FR-14
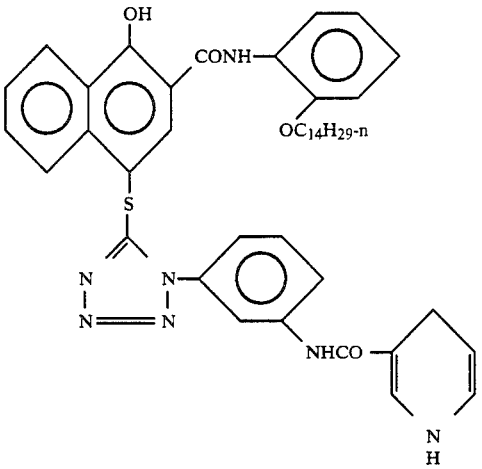
FR-15
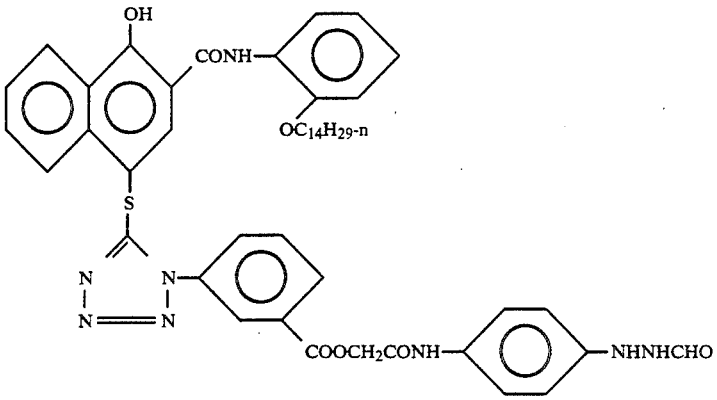

-continued
FR-16
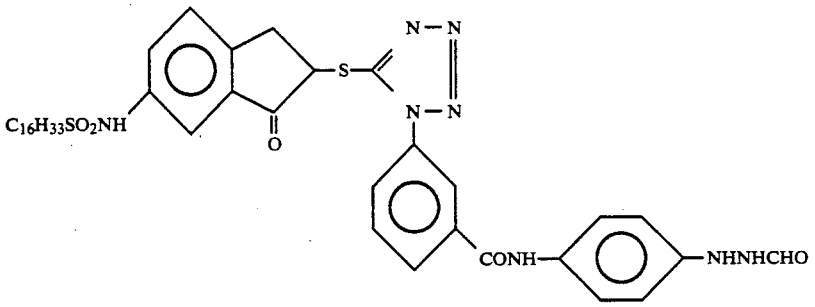
FR-17
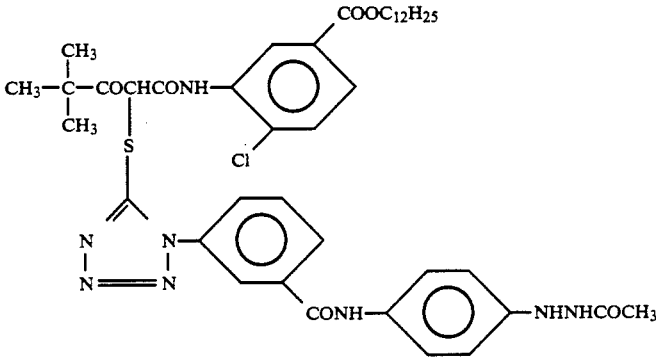
FR-18
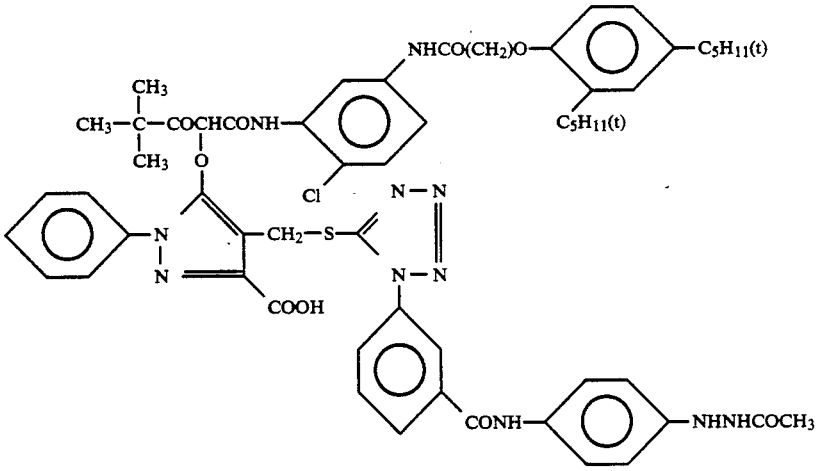

-continued
FR-19
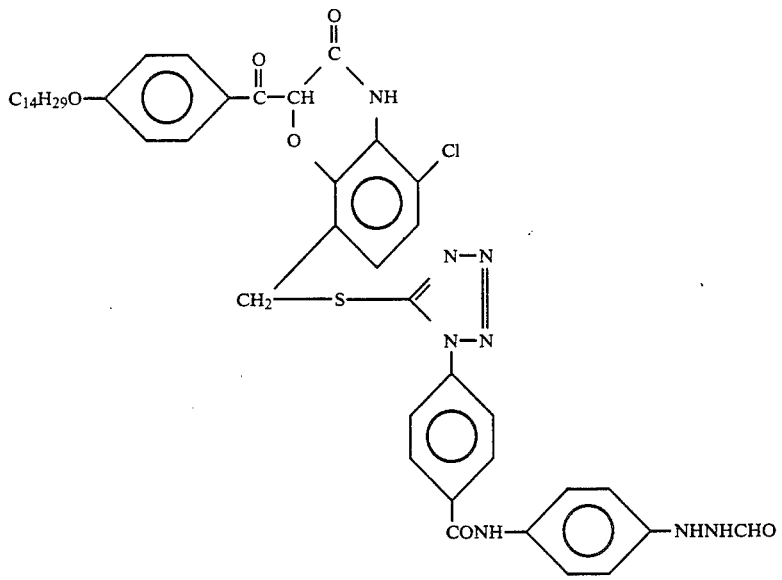
FR-20
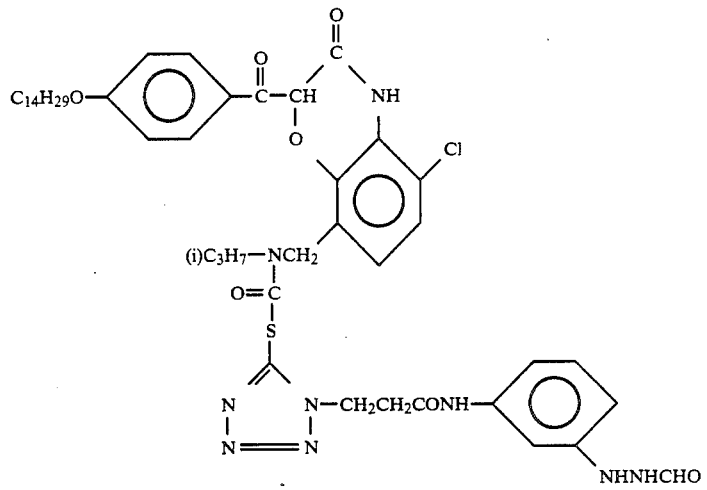
FR-21
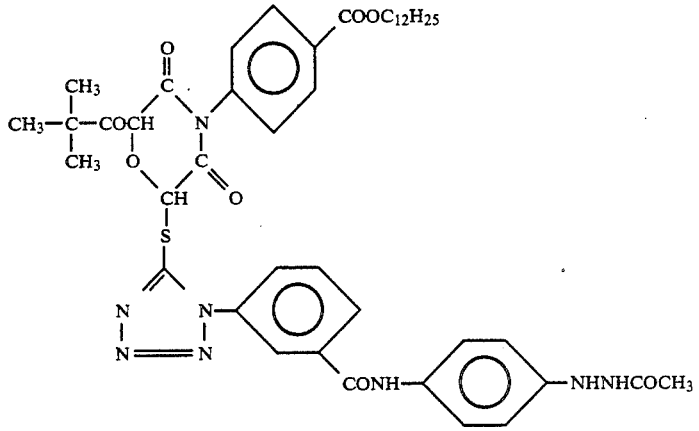

-continued

FR-22

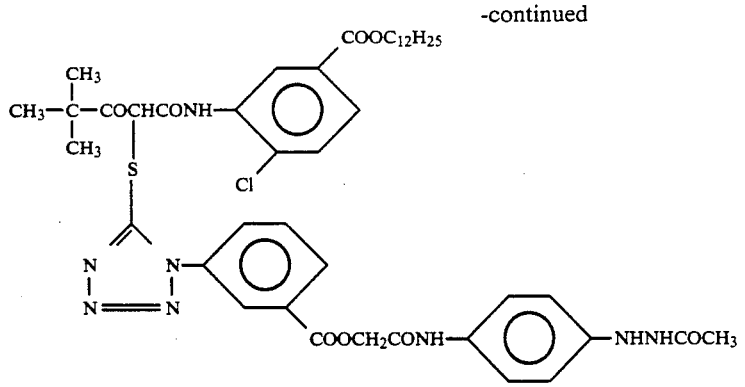

FR-23

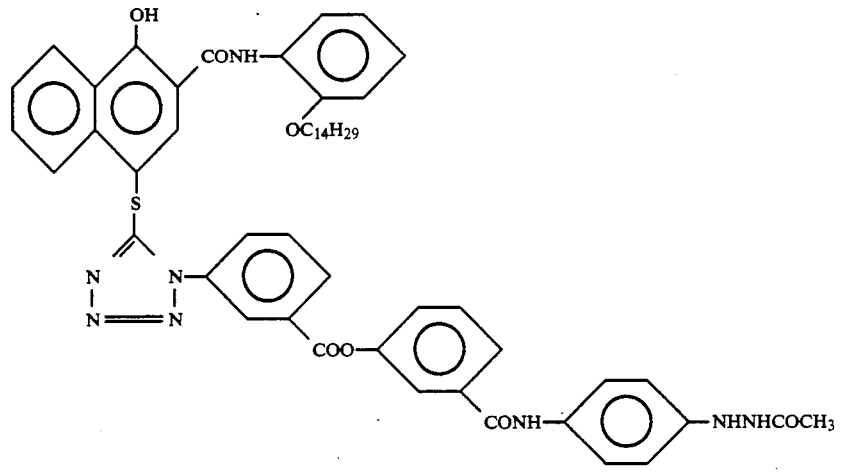

For the purpose of satisfying photographic characteristics required of the photosensitive material, two or more of the above-described couplers and like compounds can be incorporated together in the same layer, and also, the same compound can be added to two or more of defferent layers separately.

The couplers can be introduced into silver halide emulsion layers using known methods as described, for example, in U.S. Pat. No. 2,322,027. For instance, after dissolving the couplers in a high boiling organic solvent, such as phthalic acid alkyl esters (e.g., dibutyl phthalate, dioctyl phthalate, etc.), phosphoric acid esters (e.g., diphenyl phosphate, triphenyl phosphate, tricresyl phosphate, dioctyl butyl phosphate, etc.), citric acid esters (e.g., tributyl acetylcitrate), benzoic acid esters (e.g., octyl benzoate), alkylamides (e.g., diethyllaurylamide), fatty acid esters (e.g., dibutoxyethyl succinate, diethylazelate, etc.), trimesic acid esters (e.g., tributyl trimesate) or so on, or in an organic solvent having a boiling point of about 30° C. to 150° C. such as lower alkyl acetates like ethyl acetate and butyl acetate, ethyl propionate, secondary butyl alcohol, methyl isobutyl ketone, β-ethoxyethyl acetate, methyl cellosolve acetate, or so on, the resuslting solution is dispersed in a hydrophilic colloid. In dissolving the couplers, the above-described high boiling organic solvents and low boiling solvents may be used in the form of a mixture.

In addition, the dispersion technique using the polymers described in Japanese Patent Publication 39853/76 and Japanese Patent Application (OPI) 59943/76 can be employed.

When the couplers contain an acid group such as carboxyl group or sulfo group, they are introduced into a hydrophilic colloid in the form of an alkaline aqueous solution.

It is favourable to select photographic color couplers to be used in the invention so as to provide images of neutral gray. It is to be desired that the cyan dyes produced from the cyan couplers should show their absorption maxima in the wavelength range of about 600 nm to about 720 nm, the magenta dyes produced from the magenta couplers should show their absorption maxima in the wavelength range of about 500 nm to 580 nm, and the yellow dyes produced from the yellow couplers should show their absorption maxima in the wavelength range of about 400 nm to 480 nm.

The photosensitive material of the present invention may contain dyes in hydrophilic colloid layers for various purposes, e.g., as a filter dye, for prevention of irradiation, and so on. Dyes suitable for such purposes include oxonol dyes, hemioxonol dyes, styryl dyes, merocyanine dyes, cyanine dyes and azo dyes. Of these dyes, oxonol dyes, hemioxonol dyes and merocyanine dyes are used to advantage. Specific examples of dyes which can be used are described in British Patents 584,609 and 1,177,429, Japanese Patent Application (OPI) Nos. 85130/73, 99620/74, 114420/74 and 108115/77, and U.S. Pat. Nos. 2,255,077, 2,274,782, 2,390,707, 2,493,747, 2,533,472, 2,843,486, 2,956,879, 3,148,187, 3,177,078, 3,247,127, 3,540,887, 3,575,704, 3,653,905, 3,718,472, 4,071,312, 4,070,352 and 4,420,555.

When dyes and ultraviolet absorbents are contained in hydrophilic colloid layers of the photosensitive material of the present invention, they may be mordanted by cationic polymers or the like. For instance, polymers described in British Patent 685,475, U.S. Pat. Nos.

2,675,316, 2,839,401, 2,2882,156, 3,048,487, 3,184,309 and 3,445,231, West German Patent Application (OLS) No. 1,914,362, Japanese Patent Application (OPI) Nos. 47624/75 and 71332/75, and so on can be used as mordant.

The color negative photographic material of the present invention has, in general, a yellow filter layer. In the yellow filter layer, colloidal silver or various kinds of dyes as described above are used. It is particularly preferable in the present invention to use a yellow filter dye which does not decolorized upon a developing processing, for example, as represented by the following general formula (VI), which is described in detail in Japanese patent Application No. 183945/86, because such dyes have an excellent filtering effect, and can impart remarkably high photographic sensitivity to the green-sensitive emulsion layer, compared with colloidal silver.

(VI)

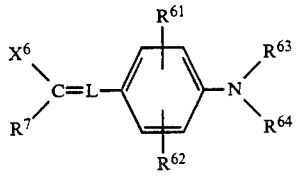

In the foregoing formula, $X^6$ and $X^7$ may be the same or different, and each represents a cyano group, a carboxy group, an alkylcarbonyl group, an arylcarbonyl group, an alkoxycarbonyl group, an aryloxycarbonyl group, a carbamoyl group, a sulfonyl group, or a sulfamoyl group. However, the case where the combination of $X^6$ and $X^7$ is that of a cyano group and a substituted or unsubstituted alkylcarbonyl group, or that of a cyano group and a sulfonyl group is excluded therefrom. $R^{61}$ and $R^{62}$ may be the same or different, and each represents a hydrogen atom, a halogen atom, an alkyl group, an alkoxy group, a hydroxy group, a carboxy group, a substituted amino group, a carbamoyl group, a sulfamoyl group, or an alkoxycarbonyl group. $R^{63}$ and $R^{64}$ may be the same or different, and each represents a hydrogen atom, an alkyl group, or an aryl group. Also, $R^{63}$ and $R^{64}$ may combine with each other to form a 5- or 6-membered ring.

In addition, $R^{61}$ and $R^{63}$, and $R^{62}$ and $R^{64}$ may be connected to each other to form 5- or 6-membered rings, respectively.

L represents a methine group.

Specific examples of the yellow dyes represented by general formula (VI) are illustrated below.

YF-1

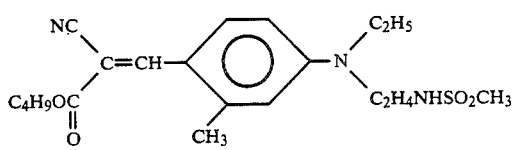

YF-2

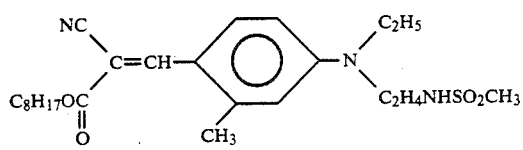

YF-3

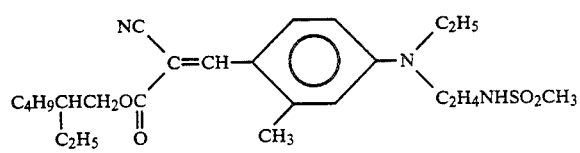

YF-4

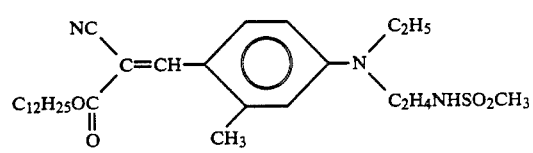

YF-5

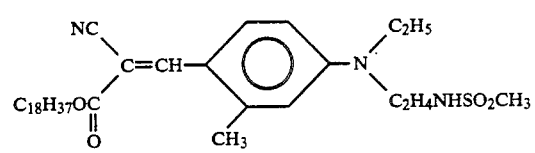

YF-6

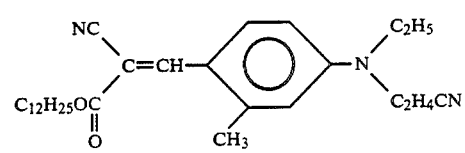

-continued

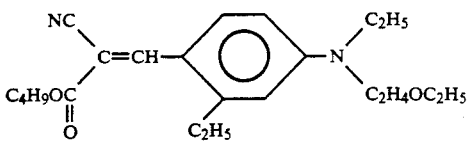

YF-7

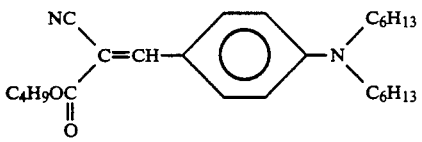

YF-8

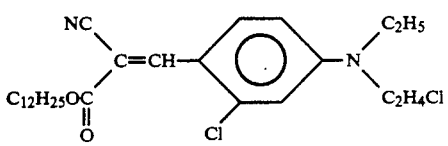

YF-9

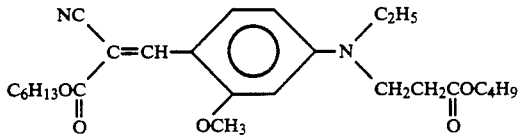

YF-10

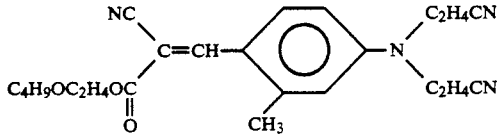

YF-11

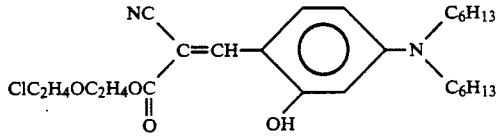

YF-12

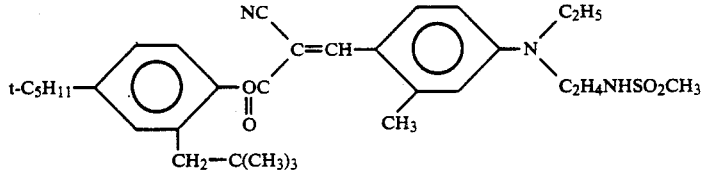

YF-13

8

Furthermore, dyes which is decolorized upon a developing process which are disclosed, for example, in U.S. Pat. Nos. 3,672,989 and 3,698,901 may also be used.

The above-illustrated yellow dyes do only save the use of yellow colloidal silver so as to reduce the content of silver in the photographic material, but also contribute to a peculiar sensitizing effect. This is because these yellow dyes have such a sharp light-absorption characteristic as to transmit light of wavelengths effective to green- and red-sensitive silver halide emulsion layers without absorbing such light, so they are used to great advantage in increasing the photographic speed of the lower layer. In addition, the use of a yellow dye filter has another advantage in that it enables evasion of physical development which tends to occur by the influence of the neighboring colloidal silver, and thereby high-speed emulsions which have received an after-ripening treatment to the fullest are easily used in blue-and green-sensitive emulsion layers.

As the use of yellow dyes can give aide in increasing the photographic speed of a green-sensitive emulsion layer, it becomes feasible to maintain a prescribed level of photographic speed even when the silver content in the green-sensitive layer is reduced. In addition, the use of a two-equivalent coupler in the green-sensitive layer, particularly in both the constituent layer of a high photographic speed and that of a low photographic speed, can increase the dye forming efficiency, and thereby a reduction of silver becomes feasible without being attended by deterioration in graininess.

Moreover, a reduction of the content of silver in the green-sensitive layer leads to an improvement in the efficient use of light in the red-sensitive layer located under the green-sensitive layer, and when a filter dye represented by general formula (VI) is used a high sensitivity can be maintained accompanying with the super sensitizing effect of the dye.

In the photosensitive material of the present invention, various additives which have so far been employed in general silver halide photosensitive materials can be used. Such additives are described, e.g., in U.S. Pat. No. 4,599,301.

As representative examples of such additives, mention may be made of those described in the specification of the above-cited patent from the 12-th line in column 33 to the 45-th line in column 38, more specifically surface active agents (column 33), polymers insoluble or slightly soluble in water (columns 33 and 34), ultraviolet absorbents (columns 37 and 38), antifoggants (column 37), color fog inhibitors (column 38), hydroquinones (column 38) and so on.

The photosensitive material of the present invention can be development-processed according to the method described, e.g., in the specification of the foregoing U.S. Patent, from column 34 to column 35.

After a desilvering step, e.g., fixation, bleach-fix or like step, the silver halide color negative photographic material of the present invention is, in general, subjected to a washing step, a stabilizing step, and/or so on.

The volume of washing water required can be determined depending on the characteristics of photosensitive materials to be processed (specifically, depending, e.g., on what kinds of the couplers are incorporated therein). The end-use purposes of the photosensitive materials to be processed, the temperature of the washing water, the number of washing tanks (stage number), the way of replenishing the washing water (e.g., whether a current of water flows in the counter direction, or not), and other various conditions. In particular, the relation between the number of washing tanks and the volume of washing water in the multistage counter current process can be determined using the method described in *Journal of the Society of Motion Picture and Television Engineers*, volume 64, pages 248–253 (May 1955).

According to the multistage counter current process described in the above-cited reference, the volume of washing water can be sharply decreased. However, the process suffers from disadvantages in that bacteria grow in the tanks because of an increase in the staying time of the water in the tanks, and the suspended matter produced from the bacteria sticks to the photosensitive materials processed therein. As a means of solving such a problem in the processing of the color photosensitive material of the present invention when the above-described process is applied, the method of reducing the contents of calcium and magnesium, which is described in Japanese Patent Application 131632/86, can be employed to enormous advantage. Further, the bactericides such as isothiazolone compounds described in Japanese Patent Application (OPI) No. 8542/82, sodium salt of chlorinated isocyanuric acid, benzotriazole described in Hiroshi Horiguchi *Bohkun Bohkun Zai no Kagaku* (which means "Chemistry of Antibacteria and Antimold"), and *Biseibutshu no Mekkin Sakkin Bohkun no Kagaku* (which means "Arts of sterilizing and pasteurizing microbes, and proofing against mold"), compiled by Eisei Gijutsu Kai can be used.

Washing water to be used in the processing of the photosensitive material of the present invention is adjusted to pH 4–10, preferably to pH 5–9.

Also, the photosensitive material of the present invention can be processed directly with a stabilizing solution in place of using the above-described washing water. Known methods, all of which are described in Japanese Patent Application (OPI) Nos. 8543/82, 14834/83 and 118749/86, can be applied to the stabilization processing of the photosensitive material of the present invention.

The present invention is illustrated in more detail by reference to the following examples. However, the invention should not be construed as being limited to these examples. Unless indicated otherwise, all parts and percentages are by weight.

EXPERIMENT

This experiment was performed to show that a high-speed color negative photographic material suffers deterioration in photographic properties due to storage, and to prove that this deterioration is caused by the influence of natural radiations.

A high-speed multilayer color negative photographic material was prepared by coating the first to sixteenth layers described below on a cellulose triacetate film support. The combined total of silver coverages therein was 9.6 g/m$^2$. This photographic material was called Sample 001.

The first layer (Antihalation layer):

Gelatin layer containing 0.18 g/m$^2$ of black colloidal silver, 0.12 g/m$^2$ of Ultraviolet Absorbent C-1, and 0.17 g/m$^2$ of Ultraviolet Absorbent C-2.

The second layer (Interlayer):

Gelatin layer containing 0.18 g/m$^2$ of 2,5-di-t-pentadecylhydroquinone, 0.11 g/m$^2$ of Coupler C-3, and 0.15 g/m$^2$ (on a silver basis) of a silver iodobromide emulsion (having iodide content of 1 mol %, and a mean grain size of 0.07 micron The third layer (First red-sensitive emulsion layer):

Gelatin layer containing 0.72 g/m$^2$ (on a silver basis) of a silver iodobromide emulsion (having a mean grain size of 0.9 micron and an average iodide content of 6 mol %), $7.0\times10^{-5}$ mol/mol silver of Sensitizing Dye I, $2.0\times10^{-5}$ mol/mol silver of Sensitizing Dye II, $2.8\times10^{-5}$ mol/mol silver of Sensitizing Dye III, $2.0\times10^{-5}$ mol/mol silver of Sensitizing Dye IV, 0.093 g/m$^2$ of Coupler C-4, 0.31 g/m$^2$ of Coupler C-5, and 0.010 g/m$^2$ of Coupler C-6.

The fourth layer (Second red-sensitive emulsion layer):

Gelatin layer containing 1.2 g/m$^2$ (on a silver basis) of a silver iodobromide emulsion (having a mean grain size of 1.3 microns and an averrage iodide content of 10 mol%), $5.2\times10^{-5}$ mol/mol silver of Sensitizing Dye I, $1.5\times10^{-5}$ mol/mol silver of Sensitizing Dye II, $2.1\times10^{-5}$ mol/mol silver of Sensitizing Dye III, $1.5\times10^{-5}$ mol/mol silver of Sensitizing Dye IV, 0.10 g/m$^2$ of Coupler C-4, 0.061 g/m$^2$ of Coupler C-5, and 0.046 g/m$^2$ of Coupler C-7.

The fifth layer (Third red-sensitive emulsion layer):

Gelatin layer containing 2.0 g/m$^2$ (on a silver basis) of a silver iodobromide emulsion (having a mean grain size of 2.0 micron, and an average iodide content of 10 mol %), $5.5\times10^{-5}$ mol/mol silver of Sensitizing Dye I, $1.6\times10^{-5}$ mol/mol silver of Sensitizing Dye II, $2.2\times10^{-5}$ mol/mol silver of Sensitizing Dye III, $1.6\times10^{-5}$ mol/mol silver of Sensitizing Dye IV, 0.044 g/m$^2$ of Coupler C-5, and 0.16 g/m$^2$ of Coupler C-7.

The sixth layer (Interlayer):

Gelatin layer.

The seventh layer (First green-sensitive emulsion layer):

Gelatin layer containing 0.55 g/m$^2$ (on a silver basis) of a silver iodobromide emulsion (having a mean grain size of 0.7 micron, and an average iodide content of 6 mol %), $3.8\times10^{-4}$ mol/mol silver of Sensitizing Dye V, $3.0\times10^{-5}$ mol/mol silver of Sensitizing Dye VI, $1.2\times10^{-4}$ mol/mol silver of Sensitizing Dye VII, 0.29 g/m$^2$ of Coupler C-8, 0.040 g/m$^2$ of Coupler C-9, 0.055 g/m$^2$ of Coupler C-10, and 0.058 g/m$^2$ of Coupler C-11.

The eighth layer (Second green-sensitive emulsion layer):

Gelatin layer containing 1.0 g/m$^2$ (on a silver basis) of a silver iodobromide emulsion (having a mean grain size of 1.3 micron, and an average iodide content of 8 mol %), $2.7\times10^{-4}$ mol/mol silver of Sensitizing Dye V, $2.1\times10^{-5}$ mol/mol silver of Sensitizing Dye VI, $8.5\times10^{-5}$ mol/mol silver of Sensitizing Dye VII, 0.25 g/m$^2$ of Coupler C-8, 0.013 g/m$^2$ of Coupler C-9, 0.009 g/m$^2$ of Coupler C-10, and 0.011 g/m$^2$ of Coupler C-11.

The ninth layer (Third green-sensitive emulsion layer):

Gelatin layer containing 2.0 g/m$^2$ (on a silver basis) of a silver iodobromide emulsion (having a mean grain size of 2.0 microns, and an average iodide content of 10 mol %), $3.0\times10^{-4}$ mol/mol silver of Sensitizing Dye V, $2.4\times10^{-5}$ mol/mol silver of Sensitizing Dye VI, $9.5\times10^{-5}$ mol/mol silver of Sensitizing Dye VII, 0.070 g/m$^2$ of Coupler C-12, and 0.013 g/m$^2$ of Coupler C-9.

The tenth layer (Yellow filter layer):

Gelating layer containing 0.08 g/m$^2$ of yellow colloidal silver, and 0.031 g/m$^2$ of 2,5-di-t-pentadecylhydroquinone.

The eleventh layer (First blue-sensitive emulsion layer):

Gelatin layer containing 0.32 g/m$^2$ (on a silver basis) of a silver iodobromide emulsion (having a mean grain size of 0.6 micron, and an average iodide content of 6 mol %), 0.68 g/m$^2$ of Coupler C-13, and 0.030 g/m$^2$ of Coupler C-14.

The twelfth layer (Second blue-sensitive emulsion layer):

Gelatin layer containing 0.30 g/m$^2$ (on a silver basis) of a silver iodobromide emulsion (having a mean grain size of 1.2 microns, and an average iodide content of 10 mol %), 0.22 g/m$^2$ of Coupler C-13, and $2.2\times10^{-4}$ mol/mol silver of Sensitizing Dye VIII.

The thirteenth layer (Gelatin layer):

The fourteenth layer (Third blue-sensitive emulsion layer):

Gelatin layer containing 0.80 g/m$^2$ (on a silver basis) of a silver iodobromide emulsion (having a mean grain size of 2.2 microns, and an average iodide content of 13 mol %), 0.19 g/m$^2$ of Coupler C-13, 0.001 g/m$^2$ of Coupler C-15, and $2.3\times10^{-4}$ mol/mol silver of Sensitizing Dye VIII.

The fifteenth layer (First protective layer):

Gelatin layer containing 0.14 g/m$^2$ of Ultraviolet Absorbent C-1, and 0.22 g/m$^2$ of Ultraviolet Absorbent C-2.

The sixteenth layer (Second protective layer):

Gelatin layer containing 0.05 g/m$^2$ of polymethylmethacrylate particles (having a diameter of 1.5 microns), and 0.30 g/m$^2$ of a silver iodobromide emulsion (having an iodide content of 2 mole %, and a mean grain size of 0.07 micron).

In addition to the above-described ingredients, Gelatin Hardener C-16 and an anion surface active agent were added to each layer composition and they are coated.

COMPOUND USED

C-1: A polymer having the following repeating units.

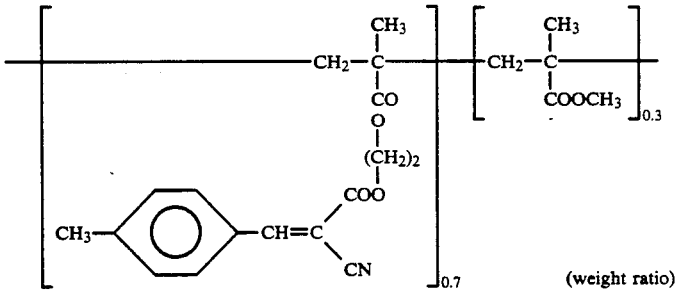

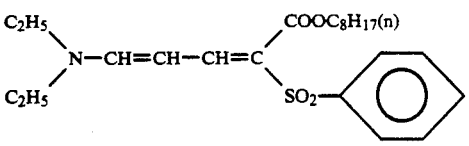

C-2

-continued
C-3
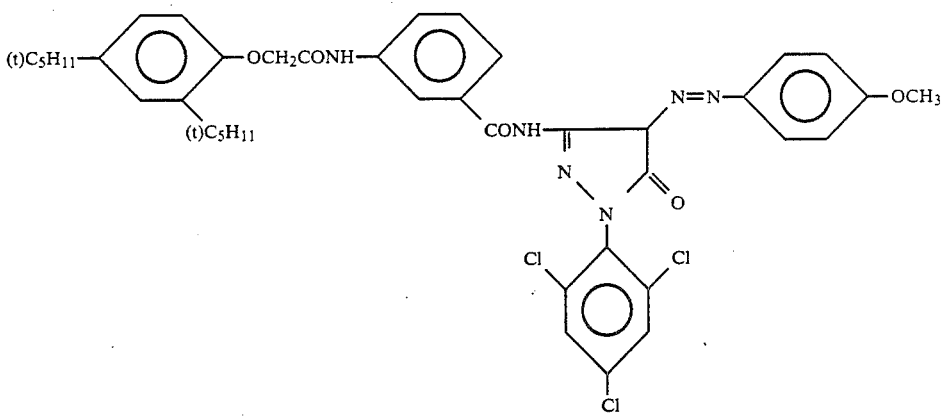
C-4
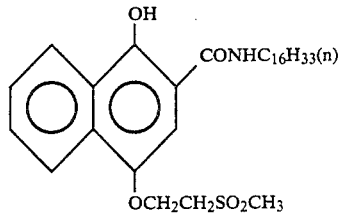
C-5
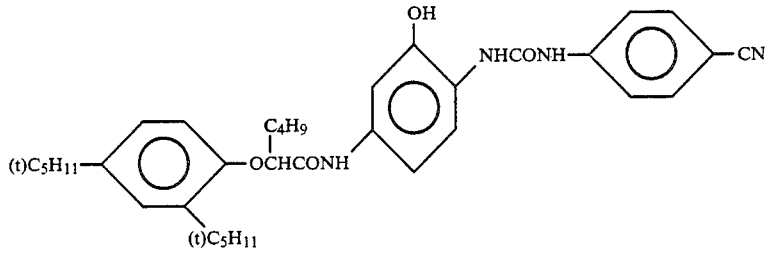
C-6
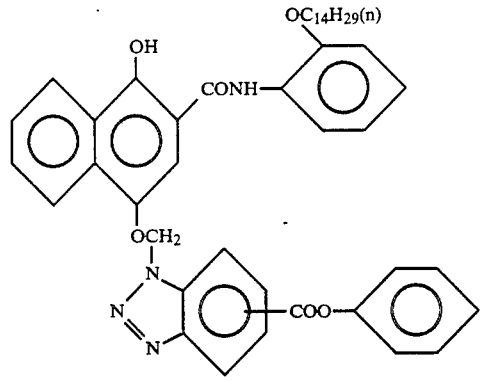
C-7
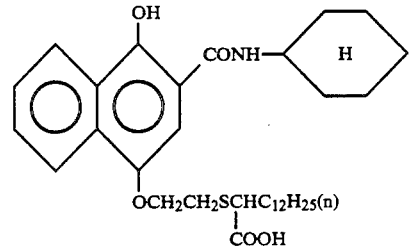
C-8: A polymer having the following repeating units.

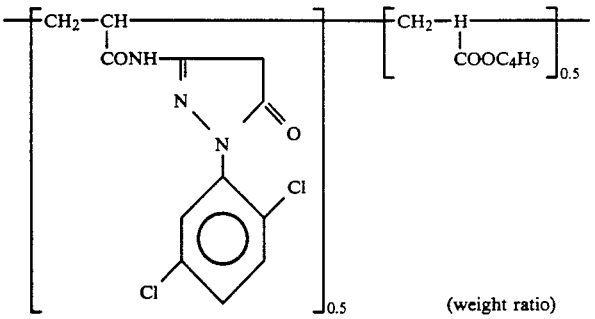
C-9
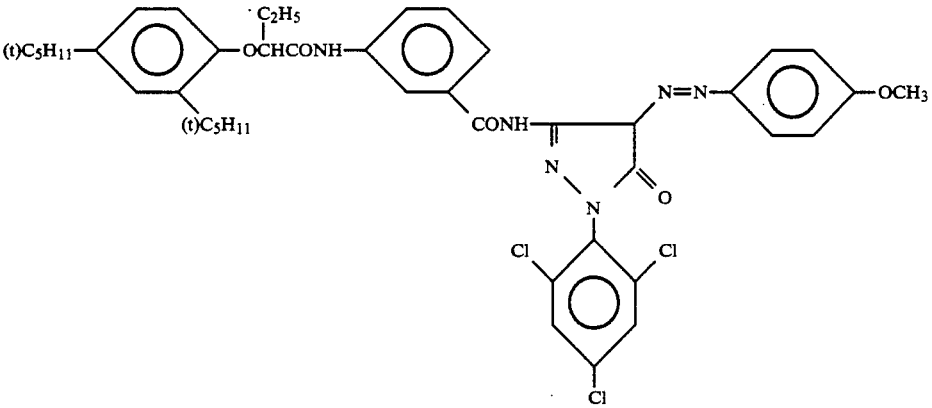
C-10
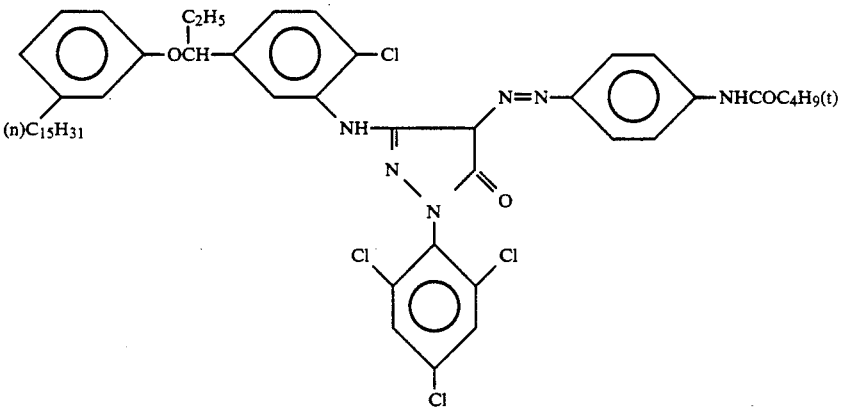
C-11
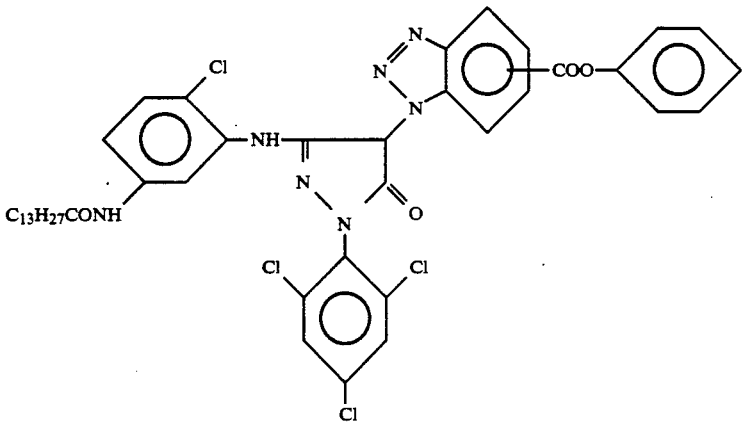

-continued
C-12
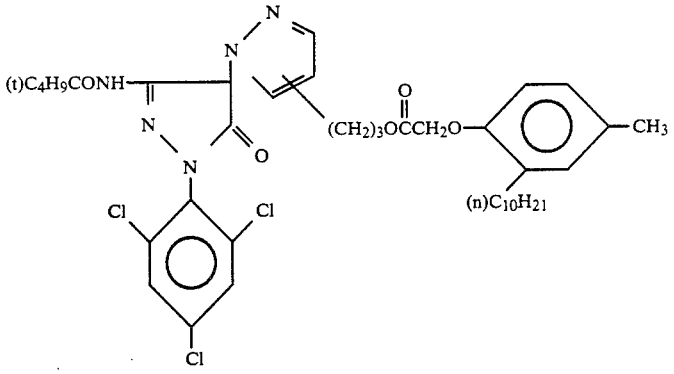
C-13
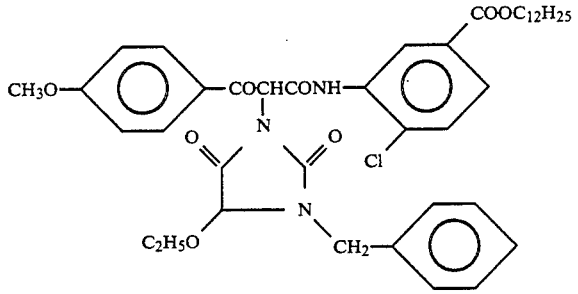
C-14
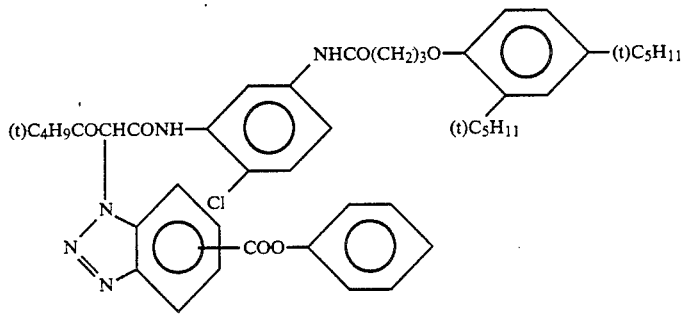
C-15
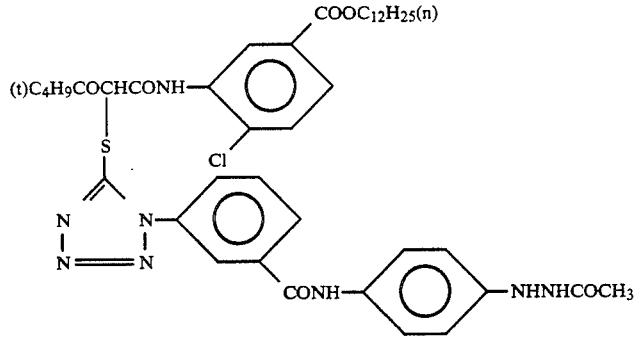
C-16
$CH_2{=}CH{-}SO_2{-}CH_2{-}CONH(CH_2)_2{-}NHCOCH_2{-}SO_2{-}CH{=}CH_2$
Sensitizing Dye
I
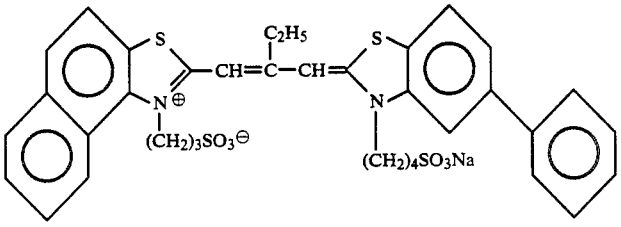

-continued

II

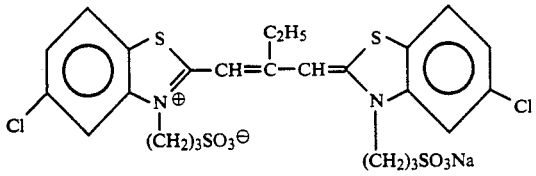

III

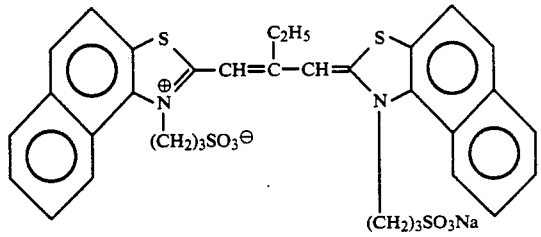

IV

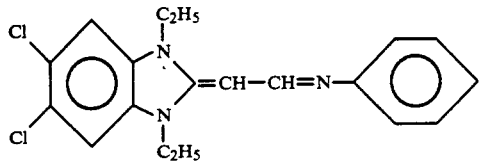

V

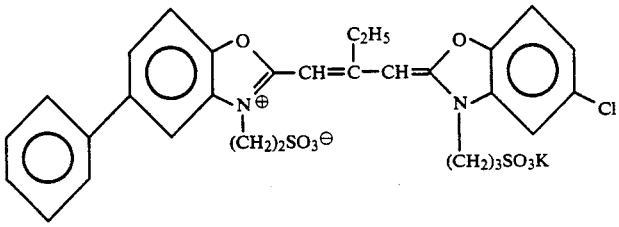

VI

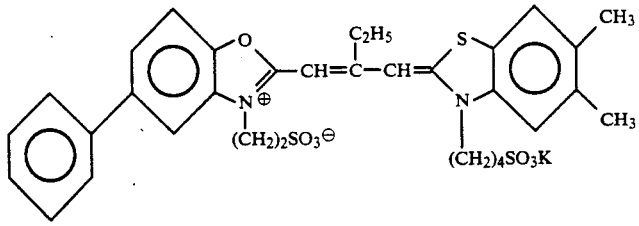

VII

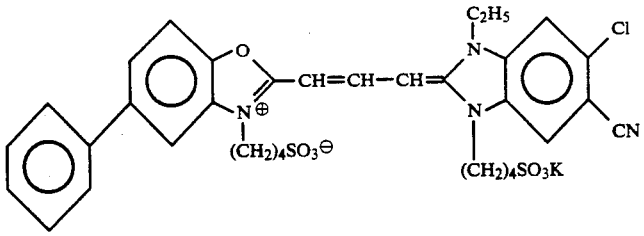

VIII

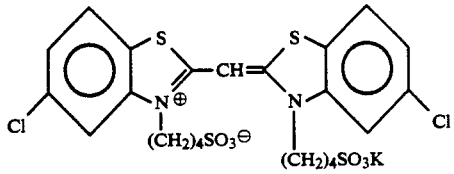

The thus prepared Sample 001 was preserved for 2 weeks at a temperature of 30°±1° C. and a relative humidity of 60±5% to complete the reaction of the gelatin hardener. Thereafter, the sample pieces were stored separately under four different storage conditions as described in Table 1 below. The resulting sample pieces were examined for sensitivity, fog density and granularity. The sensitivity and the fog density were determined in accordance with the process for measuring the specific photographic sensitivity, which is described hereinbefore in this specification. As for the granularity, it was determined using the conventional RMS (Root Mean Square) method after the sample pieces were processed in the same manner as carried out for the determination of the specific photographic sensitivity.

TABLE 1: STORAGE CONDITION (A) No storage.
(B) Natural storage for one year inside the Fuji Photo Film Ashigara Research Institute, which is located in Minami-ashigara City, Kanagawa Prefecture (about 23° C., 55% RH).
(C) Cold storage (at about 7° C.) for one year inside the Fuji Photo Film Ashigara Research Institute.
(D) Storage for one year in a refrigerator (at about 7° C.), wherein the sample was enclosed with a 2 cm-thick oxygen-free copper plate, and further with a 15 cm-thick lead block, installed in the Fuji Photo Film Ashigara Research Institute.

In storage condition (B), the sample piece was stored for one year under natural conditions. In storage condition (C), the storage temperature was lowered so that a thermal change in the photographic properties might be made as small as possible. In storage condition (D), the influences of the surrounding radiations were made negligibly small by using lead blocks and oxygen-free copper plates in addition to the restriction on thermal changes in storage condition (C). The radiation dose inside the Research Institute was about 40 mR/year according as measured with a ILD (Thermo-Luminescence Detector).

The sensitivity, for density and granularity data measurements are shown in Table 2 below. As for the photographic sensitivity, the photographic sensitivities obtained are as defined in this specification (S), and the blue-, green- and red-sensitivities where determined as relative values, with storage condition (A) with respect to each color sensitivity being taken as 100. As for the RMS granularity, the values obtained under a exposure of 0.0005 lux·sec are shown.

TABLE 2

| | | Stoarage Condition | | | |
|---|---|---|---|---|---|
| | | (A) | (B) | (C) | (D) |
| Sensitivity | Blue | 100 | 85 | 89 | 98 |
| | Green | 100 | 72 | 83 | 99 |
| | Red | 100 | 65 | 75 | 96 |
| Specific Photographic Sensitivity (S) | | 1650 | 1129 | 1302 | 1609 |
| Fog | Blue | 0.98 | 1.08 | 1.06 | 0.99 |
| | Green | 0.60 | 0.74 | 0.70 | 0.61 |
| | Red | 0.26 | 0.39 | 0.38 | 0.26 |
| RMS | Blue | 0.048 | 0.067 | 0.068 | 0.049 |
| | Green | 0.035 | 0.047 | 0.045 | 0.037 |
| | Red | 0.027 | 0.042 | 0.040 | 0.028 |

As can be clearly seen from the data shown in Table 2 above. Sample 001 which had a specific photographic sensitivity of 1650 and a combined total of silver converages of 9.6 g/m$^2$ caused a sharp decrease in the sensitivity, a great increase in the fog and considerable deterioration in the granularity by the lapse of one year under natural conditions, and the influence of natural radiations upon these photographic properties was proved to be much greater than that of heat.

EXAMPLE 1

Samples 102 and 103 were prepared in the same manner as Sample 001 except that coverages of silver iodobromide emulsions (on a silver basis) in the fourth, fifth, eighth, nineth, twelfth and fourteenth layers, respectively were changed to those set froth in Table 3 below.

TABLE 3

| | Sample 001 | Sample 102 | Sample 103 |
|---|---|---|---|
| The fourth layer | 1.2 g/m$^2$ | 1.2 g/m$^2$ | 1.0 g/m$^2$ |
| The fifth layer | 2.0 g/m$^2$ | 1.7 g/m$^2$ | 1.4 g/m$^2$ |
| The eighth layer | 1.0 g/m$^2$ | 1.0 g/m$^2$ | 0.8 g/m$^2$ |
| The nineth layer | 2.0 g/m$^2$ | 1.7 g/m$^2$ | 1.4 g/m$^2$ |
| The twelfth layer | 0.3 g/m$^2$ | 0.3 g/m$^2$ | 0.25 g/m$^2$ |
| The fourteenth layer | 0.8 g/m$^2$ | 0.7 g/m$^2$ | 0.6 g/m$^2$ |
| Combined total of silver coverages | 9.6 g/m$^2$ | 8.9 g/m$^2$ | 7.75 g/m$^2$ |

These three kinds of samples each was divided into two pieces, and kept under the storage condition (A) and the storage condition (B), separately. The resulting samples were examined for sensitivity, fog and RMS granularity in the same manner as in the foregoing EXPERIMENT. The results obtained are shown in Table 4 below.

TABLE 4

| | | Sample 001 Storage Condition | | Sample 102 Storage Condition | | Sample 103 Storage Condition | |
|---|---|---|---|---|---|---|---|
| | | (A) | (B) | (A) | (B) | (A) | (B) |
| Sensitivity | Blue | 100 | 85 | 95 | 83 | 90 | 80 |
| | Green | 100 | 72 | 96 | 73 | 92 | 74 |
| | Red | 100 | 65 | 96 | 69 | 93 | 72 |
| Specific Photographic Sensitivity (S) | | 1650 | 1129 | 1584 | 1171 | 1526 | 1204 |
| Fog | Blue | 0.98 | 1.08 | 0.98 | 1.06 | 0.97 | 1.03 |
| | Green | 0.60 | 0.74 | 0.59 | 0.70 | 0.57 | 0.67 |
| | Red | 0.26 | 0.39 | 0.25 | 0.35 | 0.23 | 0.31 |
| RMS | Blue | 0.048 | 0,067 | 0.050 | 0.063 | 0.052 | 0.058 |
| | Green | 0.035 | 0.047 | 0.035 | 0.042 | 0.036 | 0.040 |
| | Red | 0.027 | 0.042 | 0.028 | 0.036 | 0.029 | 0.033 |

As can be seen from the data a shown in Table 4 above, the decrease in the sensitivity and the degree of deterioration in the granularity under storage condition (A) were somewhat less in the samples of the present invention, 102 and 103, than in Comparative Sample 001, but the differences were negligible small in a practical point of view. Under storage condition (B), on the other hand, Samples 102 and 103 prepared in accordance with the present invention caused less deterioration in the photographic properties over the course of time, so they showed somewhat high sensitivity and tolerably improved granularity, compared with Comparative Sample 001. Deterioration of granularity, which is important from a practical point of view, was greatly improved even in Sample 102 which had a combined total of silver coverage of 8.9 g/m$^2$.

EXAMPLE 2

A high-speed multilayer color negative photographic material was prepared by coating the layers described below, from the first to seventeenth layers, on a cellulose triacetate film support, and named Sample 204.

The first layer:

The same as the first layer in Sample 001.

The second layer:

The same as the second layer in Sample 001.

The third layer:

The same as the third layer in Sample 001, except that 0.320 g/m$^2$ of Coupler C-18, 0.010 g/m$^2$ of Coupler C-6 and 0.050 g/m$^2$ of Coupler C-17 were employed in place of the couplers used therein.

The fourth layer:

The same as the fourth layer in Sample 001, except that 0.050 g/m$^2$ of Coupler C-18, 0.210 g/m$^2$ of Coupler C-19 and 0.090 g/m$^2$ of Coupler C-17 were employed in place of the couplers used therein.

The fifth layer:

The same as the fifth layer in Sample 001, except that 0.180 g/m$^2$ of Coupler C-19 and 0.005 g/m$^2$ of Coupler C-17 were employed in place of the couplers used therein.

The sixth layer:

The same as the sixth layer in Sample 001.

The seventh layer:

The same as the seventh layer in Sample 001, except that 0.290 g/m$^2$ of Coupler C-20, 0.040 g/m$^2$ of Coupler C-21 and 0.060 g/m$^2$ of Coupler C-11 were employed in place of the couplers used therein.

The eighth layer:

The same as the eighth layer in Sample 001, except that 0.210 g/m$^2$ of Coupler C-20, 0.012 g/m$^2$ of Coupler C-21, 0.009 g/m$^2$ of Coupler C-11 and 0.011 g/m$^2$ of Coupler C-22 were employed in place of the couplers used therein.

The ninth layer (Interlayer):

Gelatin layer.

The tenth layer (Third green-sensitive emulsion layer):

Gelatin layer containing 1.9 g/m$^2$ (on a silver basis) of a silver iodobromide emulsion (having a mean grain size of 1.8 microns, and an average iodide content of 11 mol %), $3.0\times10^{-4}$ mol/mol silver of Sensitizing Dye V, $2.4\times10^{-5}$ mol/mol silver of Sensitizing Dye VI, $9.5\times10^{-5}$ mol/mol silver of Sensitizing Dye VII, 0.025 g/m$^2$ of Coupler C-12, and 0.008 g/m$^2$ of Coupler C-22.

The eleventh layer (Yellow filter layer):

Gelatin layer containing 0.11 g/m$^2$ of Dye C-23, and 0.031 g/m$^2$ of 2,5-di-pentadecylhydroquinone.

The twelfth layer:

The same as the eleventh layer in Sample 001.

The thirteenth layer:

The same as the twelfth layer in Sample 001.

The fourteenth layer (Fine-grained emulsion layer):

Gelatin layer containing 0.25 g/m$^2$ (on a silver basis) of a silver iodobromide emusion (having a mean grain size of 0.15 micron, and an average iodide content of 2 mol %).

The fifteenth layer (Third blue-sensitive emulsion layer):

Gelatin layer containing 1.20 g/m$^2$ (on a silver basis) of a silver iodobromide emulsion (having a mean grain size of 2.3 microns and an average iodide content of 13.5 mol %), $2.3\times10^{-4}$ mol/mol silver of Sensitizing Dye VIII, and 0.20 g/m$^2$ of Coupler C-13.

The sixteenth layer:

The same as the fifteenth layer in Sample 001.

The seventeenth layer:

The same as the sixteenth layer in Sample 001.

In addition to the above-described ingredients, Gelatin Hardener C-16 and a surface active agent were added on each constituent layer composition.

C-17

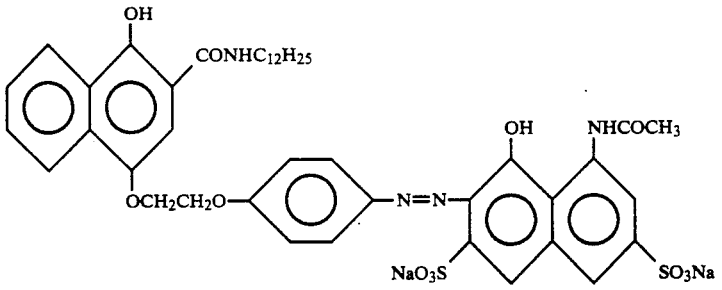

C-18

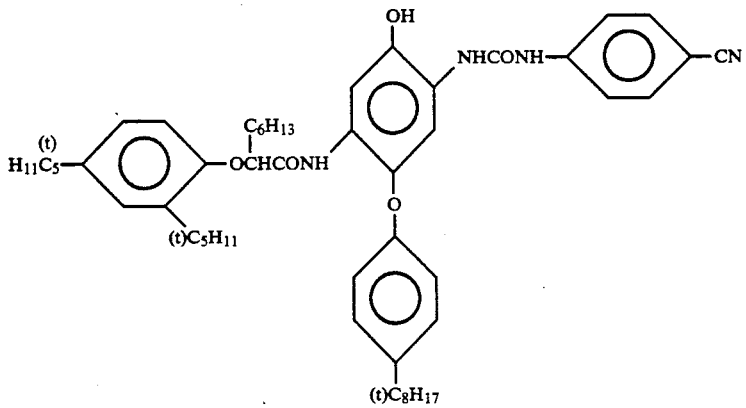

-continued
C-19
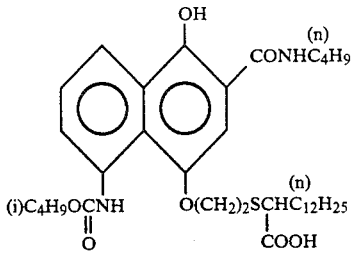
C-20
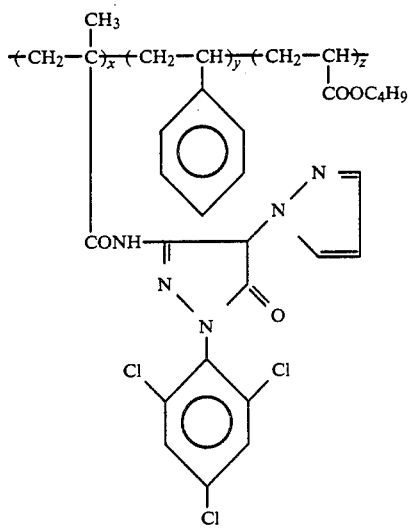
x + y + z = 1
y/z = 1(weight)
Molecular Weight:
about 40,000
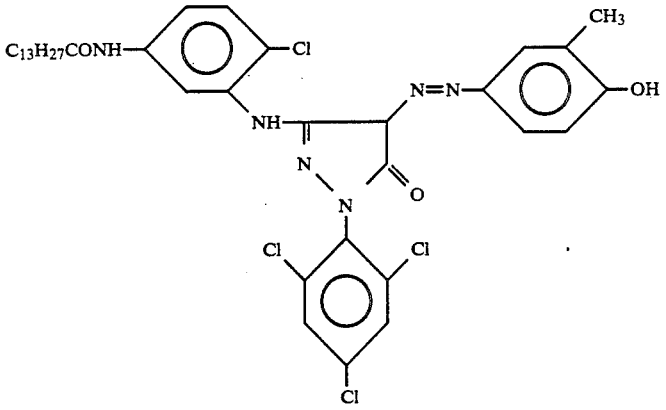

-continued

C-22

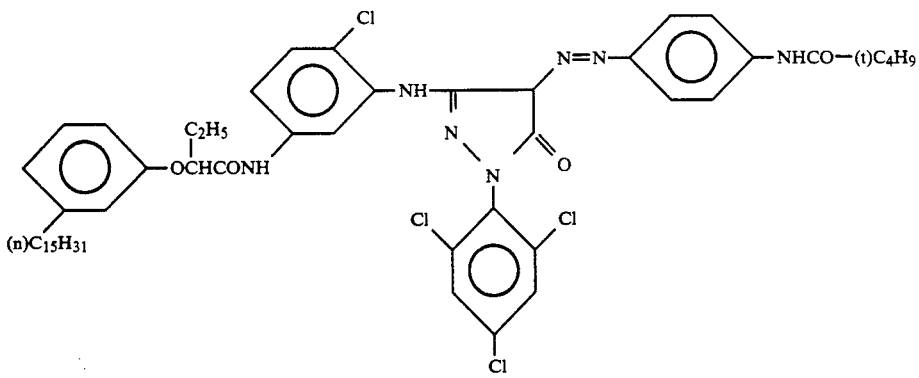

C-23

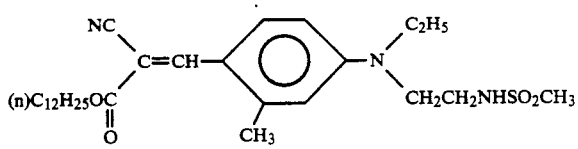

Samples 205 and 206 were prepared in the same manner as Sample 204, except that coverages of silver iodobromide emulsions (on a silver basis) in the fourth, fifth, eighth, tenth, thirteenth and fifteenth layers, respectively, were changed to those shown in Table 5 below.

TABLE 5

| | Sample 204 | Sample 205 | Sample 206 |
|---|---|---|---|
| The fourth layer | 1.2 g/m$^2$ | 1.0 g/m$^2$ | 0.9 g/m$^2$ |
| The fifth layer | 2.0 g/m$^2$ | 1.6 g/m$^2$ | 1.2 g/m$^2$ |
| The eighth layer | 1.0 g/m$^2$ | 1.0 g/m$^2$ | 0.8 g/m$^2$ |
| The tenth layer | 1.9 g/m$^2$ | 1.6 g/m$^2$ | 1.2 g/m$^2$ |
| The thirteenth layer | 0.3 g/m$^2$ | 0.3 g/m$^2$ | 0.25 g/m$^2$ |
| The fifteenth layer | 1.2 g/m$^2$ | 1.0 g/m$^2$ | 0.9 g/m$^2$ |

TABLE 5-continued

| | Sample 204 | Sample 205 | Sample 206 |
|---|---|---|---|
| Combined total of silver coverages | 10.07 g/m$^2$ | 8,97 g/m$^2$ | 7.72 g/m$^2$ |

In addition, Samples 207, 208 and 209 were prepared in the same manner as Samples 204, 205 and 206, respectively, except that 0.060 g/m$^2$ of Coupler C-24 was used in the tenth layer in place of the mixture of Coupler C-12 and Coupler C-22.

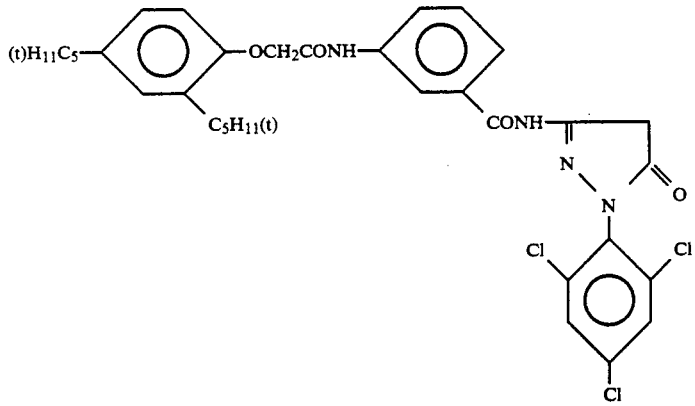

These 6 kinds of samples each was processed in the same manner as in Example 1, and the results shown in Table 6 were obtained.

TABLE 6

| | | Sample 204 Storage Condition | | Sample 205 Storage Condition | | Sample 206 Storage Condition | | Sample 207 Storage Condition | | Sample 208 Storage Condition | | Sample 209 Storage Condition | |
|---|---|---|---|---|---|---|---|---|---|---|---|---|---|
| | | (A) | (B) | (A) | (B) | (A) | (B) | (A) | (B) | (A) | (B) | (A) | (B) |
| Sensitivity | Blue | 110 | 85 | 105 | 85 | 102 | 86 | 113 | 88 | 108 | 88 | 105 | 89 |
| | Green | 100 | 74 | 95 | 77 | 92 | 80 | 80 | 60 | 67 | 54 | 55 | 48 |
| | Red | 105 | 70 | 100 | 77 | 96 | 83 | 106 | 72 | 101 | 78 | 97 | 84 |
| Specific Photographic Sensitivity (S) | | 1690 | 1188 | 1608 | 1271 | 1551 | 1345 | 1519 | 1084 | 1357 | 1071 | 1205 | 1048 |
| Fog | Blue | 1.03 | 1.18 | 1.03 | 1.15 | 1.02 | 1.12 | 1.03 | 1.18 | 1.03 | 1.15 | 1.02 | 1.12 |
| | Green | 0.55 | 0.68 | 0.54 | 0.63 | 0.53 | 0.59 | 0.53 | 0.66 | 0.52 | 0.61 | 0.51 | 0.57 |
| | Red | 0.30 | 0.42 | 0.29 | 0.37 | 0.28 | 0.33 | 0.30 | 0.42 | 0.29 | 0.37 | 0.28 | 0.33 |
| RMS | Blue | 0.040 | 0.062 | 0.044 | 0.058 | 0.046 | 0.052 | 0.040 | 0,062 | 0.044 | 0.058 | 0.046 | 0.052 |

TABLE 6-continued

| | Sample 204 Storage Condition | | Sample 205 Storage Condition | | Sample 206 Storage Condition | | Sample 207 Storage Condition | | Sample 208 Storage Condition | | Sample 209 Storage Condition | |
|---|---|---|---|---|---|---|---|---|---|---|---|---|
| | (A) | (B) | (A) | (B) | (A) | (B) | (A) | (B) | (A) | (B) | (A) | (B) |
| Green | 0.030 | 0.043 | 0.031 | 0.036 | 0.032 | 0.035 | 0.028 | 0.040 | 0.029 | 0.034 | 0.030 | 0.033 |
| Red | 0.025 | 0.039 | 0.026 | 0.032 | 0.027 | 0.030 | 0.025 | 0.039 | 0.027 | 0.033 | 0.027 | 0.030 |

As can be seen from the data shown in Table 6, Samples 205, 206, 208 and 209 produced in accordance with the present invention caused less deterioration in the photographic properties, particularly in the granularity, over the curse of time than Comparative Samples 204 and 207. That is, the samples of the present invention had a great improving effect, in analogy with Example 1.

On the other hand, in Samples 207, 208 and 209 which did not contain any two-equivalent coupler in the third green-sensitive emulsion layer (which had the highest photographic sensitivity of the green-sensitive constituent layers), although derioration in the photographic properties due to storage was greatly improved in the samples of the present invention, 208 and 209, in analogy with other samples of the present invention, compared with Comparative Sample 207, Samples 205 and 206, which contained the two-equivalent coupler were superior to Samples 208 and 209 since the drop in sensitivity became slightly great in the latter samples when the silver content in the third green-sensitive emulsion layer was reduced.

EXAMPLE 3

The same Samples 204 and 206 as prepared in Example 2 were processed in the same manner as described in Example 1, except that the development-processing steps were changed to those described below, and the processing was carried out using an automatic developing machine.

| Steps | Processing Time | Volume of Replenisher |
|---|---|---|
| Color development | 3 min. 15 sec. | 45 ml |
| Bleaching | 1 min. 00 sec. | 20 ml |
| Bleach-Fix | 3 min. 15 sec. | 30 ml |
| Washing (1) | 40 sec. | Cascade piping from (2) to (1) |
| Washing (2) | 1 min. 00 sec. | 30 ml |
| Stabilization | 40 sec. | 20 ml |
| Drying (at 50° C.) | 1 min. 15 sec. | |

The volumes of replenishers were expressed in ml per 1 m long by 35 mm wide.

| (Color Developer) | Mother Solution | Replenisher |
|---|---|---|
| Diethylenetriaminepentaacetic Acid | 1.0 g | 1.1 g |
| 1-Hydroxyethylidene-1,1-diphosphonic Acid | 2.0 g | 2.2 g |
| Sodium Sulfite | 4.0 g | 4.9 g |
| Potassium Carbonate | 30.0 g | 42.0 g |
| Potassium Bromide | 1.6 g | — |
| Potassium Iodide | 2.0 mg | — |
| Hydroxylamine | 2.4 g | 3.6 g |
| 4-(N-Ethyl-N-β-hydroxyethylamino)-2-methylaniline Sulfate | 5.0 g | 7.3 g |
| Water to make | 1 l | 1 l |
| pH adjusted to | 10.00 | 10.05 |

(Bleaching Bath)
Common to mother solution and replenisher

-continued

| | |
|---|---|
| Ammonium Ethylenediaminetetraacetatoferrate (III) | 120.0 g |
| Disodium Ethylenediaminetetraacetate | 10.0 g |
| Ammonium Sulfate | 10.0 g |
| Ammonium Bromide | 100.0 g |
| Bleach Accelerator | $5 \times 10^{-3}$ mol |

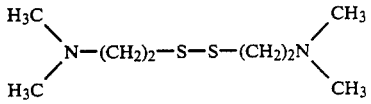

| | |
|---|---|
| Aqueous Ammonia to adjust to | pH 6.3 |
| Water to make | 1 l |
| (Bleach-Fix Bath) | |
| Common to mother solution and replenisher | |
| Ammonium Ethylenediaminetetraacetatoferrate (III) | 50.0 g |
| Disodium Ethylenediaminetetraacetate | 5.0 g |
| Sodium Sulfate | 12.0 g |
| Aqueous Solution of Ammonium Thiosulfate (70%) | 240 ml |
| Aqueous Ammonia to adjust to | pH 7.3 |
| Water to make | 1 l |
| (Washing Water) | |

City water containing 29 mg/l of calcium and 10 mg/l of magnesium was passed through a column in which a strong acid H-type cation exchange resin (Diaion SK-1B, produced by Mitsubishi Chemical Industries, Ltd.) and a strong base OH-type anion exchange resin (Diaion SA-10A, produced by Mitsubishi Chemical Industries, Ltd.) were mixed in the same amount and packed, whereby the water quality described below was obtained. To the resulting water, 20 mg/l of sodium salt of chlorinated isocyanurate was added as a bactericide.

| | |
|---|---|
| pH | 6.9 |
| Calcium | 2.5 mg/l |
| Magnesium | 1.1 mg/l |

| (Stabilizing Bath) | Mother Solution | Replenisher |
|---|---|---|
| Formaldehyde Aqueous Solution (37% W/V) | 2.0 ml | 3.0 ml |
| Polyoxyethylene-p-monononylphenyl Ether (average polymerization degree: 10) | 0.3 g | 0.45 g |
| Disodium Ethylenediamine- | 0.05 g | 0.07 g |
| tetraacetate | 0.05 g | 0.07 g |
| Water to make | 1 l | 1 l |
| pH to adjust to | about 6.0 | about 6.0 |

The results obtained were the same as those obtained in Example 2, so the usefulness of the present invention was again demonstrated.

EXAMPLE 4

Samples 210 and 211 were prepared in the same manner as the Samples 205 and 206, respectively, except that couplers C-12 and C-22 in the tenth layer was changed to 0.040 g/m² of coupler C-25 illustrated below.

Further, Samples 212 and 213 were prepared in the same manner as the Samples 205 and 206, respectively, except that compound A-1 illustrated below was additionally contained in the fifth layer.

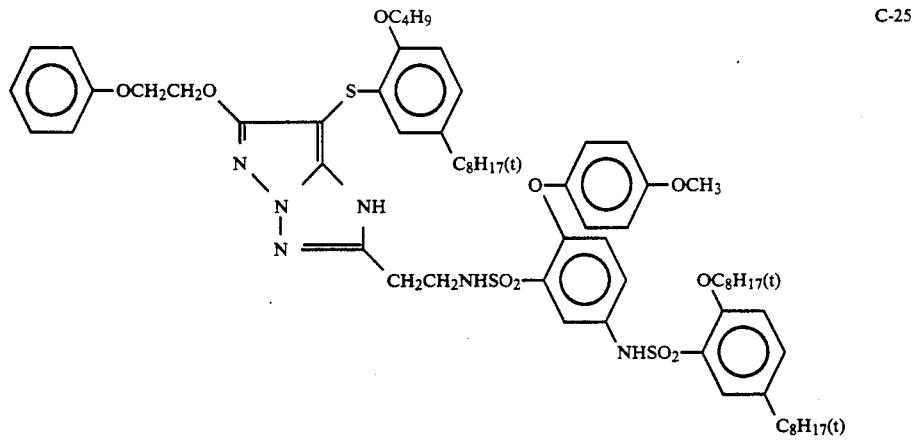

C-25

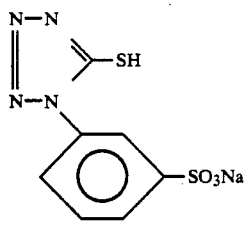

A-1

These four kinds of samples were processed in the same manner as in Example 1, and the results set forth in Table 7 were obtained.

TABLE 7

| | | Sample 210 Storage Condition | | Sample 211 Storage Condition | | Sample 212 Storage Condition | | Sample 213 Storage Condition | |
|---|---|---|---|---|---|---|---|---|---|
| | | (A) | (B) | (A) | (B) | (A) | (B) | (A) | (B) |
| Sensitivity | | | | | | | | | |
| Blue | | 105 | 85 | 102 | 86 | 106 | 87 | 103 | 87 |
| Green | | 92 | 76 | 90 | 79 | 97 | 80 | 94 | 83 |
| Red | | 100 | 77 | 96 | 83 | 105 | 84 | 101 | 86 |
| Specific Phtographic Sensitivity (S) | | 1584 | 1262 | 1535 | 1337 | 1667 | 1353 | 1609 | 1394 |
| Fog | Blue | 1.03 | 1.15 | 1.02 | 1.12 | 1.00 | 1.10 | 0.99 | 1.07 |
| | Green | 0.53 | 0.61 | 0.52 | 0.57 | 0.51 | 0.59 | 0.50 | 0.57 |
| | Red | 0.29 | 0.37 | 0.28 | 0.33 | 0.25 | 0.32 | 0.24 | 0.28 |
| RMS | Blue | 0.044 | 0.058 | 0.046 | 0.052 | 0.042 | 0.055 | 0.044 | 0.049 |
| | Green | 0.030 | 0.035 | 0.031 | 0.034 | 0.030 | 0.034 | 0.031 | 0.033 |
| | Red | 0.026 | 0.032 | 0.027 | 0.030 | 0.025 | 0.030 | 0.026 | 0.028 |

As can be seen from the data shown in Table 7, the samples of the present invention 210 to 213 caused less deterioration in the photographic properties, particularly in the granularity, over the course of time than the comparative samples 204 and 207 shown in Table 6, and achieved a great improving effect.

Also, Samples 210 and 211, which contained the two-equivalent coupler C-25 in the third green-sensitive emulsion layer, were superior in the photographic proerties to the samples 208 and 209, in analogy with Samples 205 and 206.

On the other hand, Samples 212 and 213 which contained the compound A-1 had high sensitivities and small increases in fog during storage, compared with Samples 205 and 206 which did not contain the compound A-1. Accordingly, Samples 212 and 213 were proved to be very excellent.

EXAMPLE 5

Samples 214 and 215 were prepared in the same manner as the Samples 205 and 206, except that the emulsions contained in the fifth, tenth and fifteenth layers, respectively, were changed to monodisperse emulsions having a variation coefficient of 13%.

Further, Samples 216 and 217 were prepared in the same manner as Samples 214 and 215, respectively, except that the emulsions contained in the fifth, tenth and fifteenth layers were changed to monodisperse emulsions having a clear double structure. An X-ray diffraction profile of each of the emulsion grain is shown in FIG. 1. The measurements of the X-ray diffraction patterns were made using a K$\beta$-ray of copper.

These four kinds of samples were processed in the same manner as in Example 1, and the results shown in Table 8 were obtained.

TABLE 8

| | | Sample 214 Storage Condition | | Sample 215 Storage Condition | | Sample 216 Storage Condition | | Sample 217 Storage Condition | |
|---|---|---|---|---|---|---|---|---|---|
| | | (A) | (B) | (A) | (B) | (A) | (B) | (A) | (B) |
| Sensitivity | | | | | | | | | |
| Blue | | 105 | 87 | 102 | 88 | 109 | 91 | 107 | 93 |
| Green | | 96 | 79 | 93 | 81 | 100 | 83 | 99 | 87 |
| Red | | 99 | 79 | 95 | 84 | 103 | 83 | 101 | 90 |
| Specific Phtographic Sensitivity (S) | | 1608 | 1304 | 1551 | 1361 | 1675 | 1370 | 1650 | 1460 |
| Fog | Blue | 1.04 | 1.15 | 1.03 | 1.12 | 1.04 | 1.15 | 1.03 | 1.12 |
| | Green | 0.54 | 0.62 | 0.53 | 0.58 | 0.54 | 0.62 | 0.53 | 0.58 |
| | Red | 0.30 | 0.37 | 0.29 | 0.33 | 0.30 | 0.37 | 0.29 | 0.33 |
| RMS | Blue | 0.042 | 0.055 | 0.043 | 0.048 | 0.040 | 0.053 | 0.041 | 0.046 |
| | Green | 0.030 | 0.034 | 0.030 | 0.033 | 0.029 | 0.033 | 0.029 | 0.032 |
| | Red | 0.025 | 0.031 | 0.026 | 0.029 | 0.024 | 0.030 | 0.025 | 0.028 |

As can be seen from the data shown in Table 8, the samples prepared using the monodisperse emulsions, 214 and 215, were excellent in granularity, and their superiority in granularity became more pronounced after storage.

On the other hand, the Samples 216 and 217, which utilized silver halide grains having a clear double structure, had high sensitivities and excellent granularities. Further, since the lowering of sensitivity due to the reduction of the silver coverage was low, they were demonstrated to be very useful.

EXAMPLE 6

After Samples 204, 205, 206, 214 and 215 each was uniformly exposed to light under an exposure of 0.001 lux sec, the emulsion surface of each sample was scratched at a speed of 5 cm/sec with a stylus whose extreme point was made of sapphire with a radius of about 30 microns having a load of 3 g applied thereto, and subsequently subjected to the same development processing as used for the measurement of the specific photographic sensitivity. The densities of scratch marks made by scratching with the stylus were measured with a microdensitometer and the difference between the density in the scratched area and that in the unscratched area was determined in each sample. The results obtained are shown in Table 9.

TABLE 9

| Increase in Density by Scratching with a Stylus | Sample No. 204* | 205** | 206** | 214** | 215** |
|---|---|---|---|---|---|
| Blue | 0.70 | 0.60 | 0.55 | 0.56 | 0.52 |
| Green | 0.55 | 0.47 | 0.44 | 0.45 | 0.41 |
| Red | 0.10 | 0.09 | 0.08 | 0.08 | 0.07 |

*sample for comparison.
**sample of the present invention.

As can be seen from the data shown in Table 9, the samples of the present invention, 205, 206, 214 and 215 had reduced pressure marks (pressure sensitization), that is, excellent pressure resistance, compared with the Comparative Sample 204.

EXAMPLE 7

Samples 204 to 206 each were development-processed in the same manner as used for the measurement of the specific photographic sensitivity without receiving any exposure and the remaining coverage of silver was measured. Separately, the samples each were subjected to the same processing as described above, except that the fixing time was changed to 2 minutes 10 seconds. The results obtained are shown in Table 10.

After being uniformly exposed to light under an exposure of 0.2 lux sec, Samples 204 to 206 each were development-processed in the same manner as used for the measurement of the specific photographic sensitivity, and a remaining silver coverage was measured. Separately, the samples each were subjected to the same processing as described above, except that the bleaching time was changed to 2 minutes 10 seconds. The results obtained are shown in Table 11.

TABLE 10

| Fixing Time | Remaining silver coverage ($\mu g/m^2$) 204* | 205** | 206** |
|---|---|---|---|
| 6 min. 30 sec. | 3.5 | 2.7 | 2.2 |

TABLE 10-continued

| Fixing Time | Remaining silver coverage ($\mu g/m^2$) 204* | 205** | 206** |
|---|---|---|---|
| 2 min. 10 sec. | 6.9 | 4.2 | 3.4 |

*comparative sample,
**sample of the present invention.

TABLE 11

| Bleaching Time | Remaining silver coverage ($\mu g/m^2$) 204* | 205** | 206** |
|---|---|---|---|
| 3 min. 30 sec. | 1.7 | 1.1 | 0.8 |
| 2 min. 10 sec. | 7.3 | 5.4 | 4.9 |

*comparative sample,
**sample of the present invention.

As can be seen from the data shown in the above tables 10 and 11, the samples of the invention, 205 and 206 were excellent in processability, such as fixability and bleachability.

To date no effort has so far been made to reduce the combined total silver coverages, particularly the coverage of silver in a high-speed layer, with the object of bringing about improvement in the quality of unexposed high-speed color negative photographic materials of the kind which have an ISO speed of 800 or above. In the case where the combined total of silver coverages was increased beyond 9 $g/m^2$ in the photographic materials of the above-described kind, maintaining them under a natural storage condition, that is, under the influences of natural radiations, was attended with deterioration in the photographic sensitivity and granularity. In the present invention, the life span of two years under natural radiations, which is usually required of unprocessed sensitive materials, can be ensured by high-speed color negative photographic materials by designing the color negative photographic material so that the specific sensitivity of 800 or above, which is defined in the present invention in accordance with the ISO speed, may achieved when the combined total of silver coverage (including light-insensitive silver) is controlled to 3 to 9 $g/m^2$. Even when the silver coverage is reduced, undesirable effects attended by reduction of silver can be compensated by using two-equivalent couplers into high-speed and slow emulsion layers, using yellow filter dyes, using supersensitizing combinations of sensitizing dyes with water-soluble mercapto compounds, and so on. Besides compensating for the undesirable effects, the adoption of the above-described methods can enhance synergistically both the image quality and photographic speed. Also, using silver halide grains which have a triple layer structure, or a double structure having an average iodide content of 8 to 20 mol %, and that with a low iodide content in the outer part thereof, can be desirabley used in the present invention.

Further, in accordance with the present invention, a high-speed color negative photographic material which is prevented from suffering deterioration in granularity due to a long lapse of time, has improved sharpness and color reproducibility, and is excellent in pressure resistance can be obtained.

While the invention has been described in detail and with reference to specific embodiments thereof, it will be apparent to one skilled in the art that various changes and modifications can be made therein without departing from the spirit and the scope thereof.

What is claimed is:

1. A color negative photographic material comprising, on a support, at least two red-sensitive silver halide emulsion layers each having different photographic sensitivities, at least two green-sensitive silver halide emulsion layers each having different photographic sensitivities and at least two blue-sensitive silver halide emulsion layers each having different photographic sensitivities and having a specific photographic sensitivity of 800 or above, and each of the red-, blue- and green-sensitive emulsion layers having the highest photographic sensitivity has a silver coverage of 0.3 to 1.8 $g/m^2$, wherein said material contains a combined total of silver coverages of 3.0 $g/m^2$ to 8.5 $g/m^2$ and wherein at least one emulsion layer of said red-, green- and blue-sensitive emulsion layers contains silver halide grains having a double structure comprising a core made up of silver iodobromide having an iodide content of at least 5 mol % and a shell which covers said core and is made up of silver iodobromide having an iodide content lower than that of said core or silver bromide.

2. The color negative photographic material of claim 1, wherein said layer having the highest photographic sensitivity of the emulsion layers classified by color sensitivity has, a silver coverage of 0.3 to 1.6 $g/m^2$.

3. The color negative photographic material of claim 1, wherein at least one of the layers having the highest photographic sensitivity of said emulsion layers having the same color sensitivity contains a two-equivalent coupler.

4. The color negative photographic material of claim 1, wherein at least one of said red-, green- and blue-sensitive emulsion layers contains an emulsion comprising monodisperse silver halide grains having a variation coefficient of not more than 16%.

5. The color negative photographic material of claim 1, wherein a DIR compound represented by the following general formula (IV) is contained in at least one of said red-, green- and blue-sensitive emulsion layers or an adjacent layer thereof:

$$A\text{-}(TIME)_n\text{-}B \qquad (IV)$$

wherein A represents a coupler residue capable of splitting off from $(TIME)_n$-B by a coupling reaction with an oxidation product of an aromatic primary amine developer; TIME represents a timing group which is attached to the coupling active site of A and can release B after splitting-off from A by said coupling reaction; B represents a moiety capable of inhibiting the development of silver halide; and n represents 0 or 1: and when n is 0, B is attached directly to A.

6. The color negative photographic material of claim 1, wherein said combined total of silver coverages ragnes from 3.0 $g/m^2$ to 8.0 $g/m^2$.

7. The color negative photographic material of claim 1, wherein said specific photographic sensitivity is at least 1,200.

8. The color negative photographic material of claim 1, comprising three red-sensitive emulsion layers each different in photographic sensitivity.

9. The color genative photographic material of claim 3, wherein said high-speed reacting two-equivalent coupler is at least one magenta coupler selected from the group consisting of compounds represented by the following general formula (II) and polymers having coupler residues derived from the compounds:

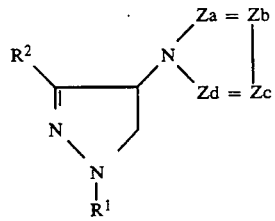

(II)

(wherein $R^1$ represents a aromatic, aliphatic or heterocyclic groups; $R^2$ represents a substituent group; and Za, Zb, Zc and Zd each represents methine group, a substituted methine group, or —N=).

10. The color negative photographic material of claim 3, wherein said high-speed reacting two-equivalent coupler is a magenta coupler represented by the following general formula (III):

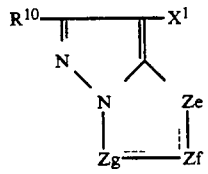

(III)

wherein $R^{10}$ represents a hydrogen atom, or a substituent group; $X^1$ represents a hydrogen atom, or a group capable of splitting away from (III) by reacting with an oxidation product of an aromatic primary amine developing agent; and Ze, Zf and Zg each represents a methine group, a substituted methine group, =N— or —NH—: and either the Ze-Zf bond or the Zf-Zg bond is a single bond and the remainder is a double bond, and when the Zf-Zg is a C—C double bond, it may constitute a part of an aromatic ring; which may form a polymer (including a dimer) via $R^{10}$ or $X^1$, or via Ze, Zf or Zg when it represents a substituted methine.

11. The color negative photographic material of claim 1, wherein an average iodide content in the silver halide emulsion grains which constitute all of said emulsion layers is within the range of from 8 mol % to 20 mol %.

12. The color negative photographic material of claim 1, wherein at least one of said red-, green- and blue-sensitive emulsion layers contains a nitrogen-containing heterocyclic compound represented by the following general formula (I): as a supersensitizing dye:

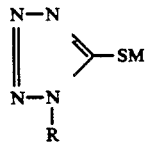

(I)

wherein R represents an aliphatic, aromatic or heterocyclic group substituted by at least one —COOM or —$SO_3M$; and M represents a hydrogen atom, an alkali metal atom, a quaternary ammonium, or a quaternary phosphonium.

13. The color negative photographic material of claim 1, wherein said material contains at least one yellow filter dye represented by the following general formula (VI)

(VI)

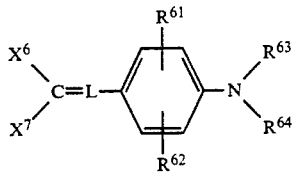

wherein $X^6$ and $X^7$ is the same or different, and each represents a cyano group, a carboxy group, an alkylcarbonyl group, an arylcarbonyl group, an alkoxycarbonyl group, an arkyloxycarbonyl group, a carbamoyl group, a sulfonyl group, or a sulfamoyl group, provided that the case where the combination of $X^6$ and $X^7$ is that of a cyano group and a substituted or unsubstituted alkylcarbonyl group, or that of a cyano group and a sulfonyl group is excluded therefrom; $R^{61}$ and $R^{62}$ is the same or different, and each represents a hydrogen atom, a halogen atom, an alkyl group, an alkoxy group, a hydroxy group, a carboxy group, a substituted amino group, a carbamoyl group, a sulfamoyl group, or an alkoxycarbonyl group; $R^{63}$ and $R^{64}$ is the same or different, and each represents a hydrogen atom, an alkyl group, or an aryl group: and further, $R^{63}$ and $R^{64}$ may combine with each other to form a 5- or 6-membered ring, and furthermore, $R^{61}$ and $R^{63}$, and $R^{62}$ and $R^{64}$ may be connected to each other to form 5- or 6-membered rings, respectively; and L represents a methine group.

14. A color negative photographic material comprising a support having thereon at least two red-sensitive silver halide emulsion layers each having different photographic sensitivities, at least two green-sensitive silver halide emulsion layers each having different photographic sensitivities and at least two blue-sensitive silver halide emulsion layers each having different photographic sensitivities and having a specific photographic sensitivity of 800 or above, and each of the red-, blue- and green-sensitive emulsion layers having the highest photographic sensitivity has a silver coverage of 0.3 to 1.8 $g/m^2$, wherein said material contains a combined total of silver coverages of 3.0 $g/m^2$ to 8.5 $g/m^2$ and wherein at least one of said emulsion layers contains tabular silver halide grains having an aspect ratio of at least 5.

15. The color negative photographic material of claim 1, comprising three blue-sensitive emulsion layers each different in photographic sensitivity.

16. The color negative photographic material of claim 1, comprising three green-sensitive emulsion layers each different in photographic sensitivity.

* * * * *